US006802716B1

(12) United States Patent
Wiley

(10) Patent No.: US 6,802,716 B1
(45) Date of Patent: Oct. 12, 2004

(54) EDUCATIONAL GAME APPARATUS AND METHOD FOR PLAYING A GAME

(75) Inventor: Kathleen R. Wiley, Ogden, UT (US)

(73) Assignee: Funtime Learning, Inc., Ogden, UT (US)

( * ) Notice: Subject to any disclaimer, the term of this patent is extended or adjusted under 35 U.S.C. 154(b) by 0 days.

(21) Appl. No.: 10/751,185

(22) Filed: Jan. 2, 2004

(51) Int. Cl.[7] ..... G09B 19/22
(52) U.S. Cl. ..... 434/128
(58) Field of Search ..... 434/128, 129, 434/159, 167, 178, 188, 276, 433; 273/236, 242, 248, 249, 253, 254, 256, 257, 287

(56) References Cited

U.S. PATENT DOCUMENTS 4,640,510 A * 2/1987 Braddock et al. ..... 273/459
4,889,345 A * 12/1989 Wawryk ..... 273/249
5,004,244 A * 4/1991 Johnson ..... 273/240
5,167,503 A * 12/1992 Jordan ..... 434/128
5,377,991 A 1/1995 Olsen
5,707,239 A * 1/1998 Butler ..... 434/191
5,860,652 A 1/1999 Ruff
5,871,211 A * 2/1999 Was ..... 273/242
5,918,882 A * 7/1999 Truong ..... 273/249
6,120,028 A 9/2000 Boyer
6,120,296 A * 9/2000 Lim ..... 434/128
6,224,056 B1 5/2001 Jones
6,224,057 B1 5/2001 Morton
6,270,077 B1 * 8/2001 Cohen ..... 273/273
6,279,908 B1 8/2001 Hunsberger
6,308,955 B1 10/2001 Slatter
6,375,466 B1 * 4/2002 Juranovic ..... 434/107
6,422,562 B1 7/2002 Daniel
6,520,504 B2 2/2003 Loder
6,547,245 B1 4/2003 Olutunfese
6,648,648 B1 * 11/2003 O'Connell ..... 434/188
6,659,774 B1 * 12/2003 Ramos et al. ..... 434/128

* cited by examiner

*Primary Examiner*—Kurt Fernstrom
(74) *Attorney, Agent, or Firm*—Clayton, Howarth & Cannon, P.C.

(57) ABSTRACT

An educational game apparatus and method for playing a game is disclosed. Each game disclosed herein comprises a plurality of teaching concepts that compete against each other, such that no individual game participant wins or loses. There are two categories of games disclosed herein: (i) board games; and (ii) concept searching games. The board games category comprises two sub-categories: (a) forward-backward-forward games, and (b) continuous play games. The concept searching games category comprises three sub-categories: (a) word searching games, (b) number searching games, and (c) answer searching games. A method for playing each category of games is also disclosed.

24 Claims, 97 Drawing Sheets

Elapsed (Lapsed) Time

| Perimeter | Area | Volume |
|---|---|---|
| 5 x 7 = | 6 x 2 x 4 = | 5 + 2 + 5 + 2 = |
| 6 x 6 x 3 = | Go Back to Start | 8 x 8 = |
| 4 + 6 + 4 + 6 = | 1 x 7 x 9 = | 5 x 3 = |
| 5 x 5 x 5 = | 5 + 9 + 5 + 9 = | 4 + 8 + 4 + 8 = |
| 7 x 2 x 9 = | 6 x 3 x 7 = | 9 x 3 = |
| 6 x 3 = | 3 + 3 + 3 + 3 = | 4 x 3 = |
| 3 + 6 + 3 + 6 = | | |
| START | | |

FIG. 44

102 NOUNS VS. 102 *NOT* NOUNS 218 210 222

| | | | | | | | | | | | | | | |
|---|---|---|---|---|---|---|---|---|---|---|---|---|---|---|
| B | R | S | I | L | L | Y | W | S | L | O | W | B | W | S |
| E | M | O | V | I | E | C | A | M | E | R | A | E | H | O |
| C | A | T | T | I | C | J | J | D | O | G | J | T | E | M |
| A | S | T | O | R | Y | M | U | S | T | J | J | W | N | E |
| U | W | O | M | A | N | Y | D | O | O | R | J | E | E | T |
| S | S | H | I | R | T | O | J | J | G | J | J | E | V | I |
| E | S | C | A | R | Y | U | H | A | I | R | J | N | E | M |
| H | S | H | E | J | S | E | E | M | R | W | A | S | R | E |
| O | W | H | E | N | C | A | K | E | L | Y | O | J | R | S |
| S | L | E | A | F | F | I | R | E | M | A | N | J | J | P |
| P | C | I | J | P | O | C | K | E | T | B | O | O | K | E |
| I | S | U | P | P | O | S | E | B | E | C | A | M | E | N |
| T | N | E | V | E | R | R | G | B | O | Y | J | K | J | T |
| A | P | O | R | C | H | F | W | E | R | E | J | E | J | I |
| L | R | E | S | T | A | U | R | A | N | T | J | G | J | L |
| B | R | O | K | E | N | A | I | R | P | L | A | N | E | J |

220 222 222

216 SILLY BECAUSE SLOW AIRPLANE RESTAURANT MOVIE PORCH 215

SCARY LEAF FIREMAN POCKETBOOK DOG CAMERA MUST

212 WOMAN ATTIC SUPPOSE BOY PENCIL SOMETIMES BETWEEN

NEVER WHENEVER SHIRT HAIR GIRL SEEM WHEN TAKE YOU

HOSPITAL WAS SHE BECAME WERE BROKEN STORY DOOR

214 COLOR ALL NOUNS *BROWN*. COLOR ALL WORDS THAT ARE *not* NOUNS *ORANGE*.

FIG. 91

COMPARING

2? 3 or more?

| | | | | | | | | | | | | | | |
|---|---|---|---|---|---|---|---|---|---|---|---|---|---|---|
| B | I | G | G | E | R | B | L | A | R | G | E | R | D | G |
| P | E | R | S | R | W | I | D | E | S | T | V | N | K | R |
| R | S | B | J | U | O | G | R | E | A | T | E | S | T | E |
| E | I | F | L | O | N | G | E | R | R | S | C | B | Y | A |
| T | L | W | H | I | T | E | R | N | I | C | E | R | F | T |
| T | L | L | O | N | G | E | S | T | R | F | E | S | T | E |
| I | I | L | V | B | F | T | K | I | N | D | E | S | T | R |
| E | E | K | I | N | D | E | R | R | I | P | E | S | T | L |
| R | R | H | E | G | D | R | F | G | R | E | E | N | E | R |
| E | L | A | R | G | E | S | T | E | L | O | W | E | S | T |
| C | S | I | L | L | I | E | S | T | J | H | M | T | E | R |
| I | F | A | S | T | E | R | B | I | G | G | E | S | T | R |
| N | I | C | E | S | T | F | A | S | T | E | S | T | G | J |
| B | L | U | E | S | T | B | L | U | E | R | R | E | S | T |
| B | L | A | C | K | E | R | B | L | A | C | K | E | S | T |
| S | W | E | E | T | E | R | S | W | E | E | T | E | S | T |

BIGGER NICEST WIDEST LARGER LONGER SILLIEST FASTEST PRETTIER

SILLIER NICER KINDEST BLUEST BLACKER KINDER WHITER

LARGEST SWEETEST GREENER LOWEST LONGEST BLACKEST

SWEETER GREATER BIGGEST FASTER GREATEST

COLOR ALL WORDS *BLUE* THAT COMPARE 2 THINGS.

COLOR ALL WORDS *GREEN* THAT COMPARE 3 THINGS OR *MORE*.

FIG. 92

ADJECTIVES VERSUS ADVERBS

| | | | | | | | | | | | | | | |
|---|---|---|---|---|---|---|---|---|---|---|---|---|---|---|
| P | R | E | T | T | Y | S | A | D | L | Y | E | R | S | U |
| C | R | T | G | Y | R | J | L | O | U | D | L | Y | H | N |
| O | I | K | I | N | D | E | S | T | I | C | K | Y | Y | S |
| M | C | T | J | B | V | E | U | N | S | A | F | E | L | A |
| P | H | T | H | V | D | T | Q | U | I | E | T | L | Y | F |
| L | L | T | J | B | X | J | B | L | U | E | H | T | L | E |
| E | Y | H | A | P | P | Y | K | E | L | I | N | T | N | S |
| T | F | G | D | H | A | P | P | I | L | Y | T | R | I | D |
| E | K | I | N | D | L | Y | T | F | E | F | A | S | C | S |
| L | O | N | G | V | J | D | R | F | J | S | L | V | E | S |
| Y | Q | U | I | C | K | L | Y | F | N | Y | L | P | O | K |
| S | H | O | R | T | S | O | F | T | L | Y | O | D | D | L |
| S | A | F | E | L | Y | L | O | Y | A | L | G | R | E | E |
| U | N | S | A | F | E | L | Y | G | R | E | E | N | K | D |
| Y | E | L | L | O | W | S | W | E | E | T | L | Y | R | G |
| C | L | E | A | N | N | I | C | E | L | Y | R | J | Y | N |

PRETTY RICHLY KINDLY SHORT KINDEST COMPLETELY BLUE

UNSAFE SWEETLY NICELY HAPPY CLEAN SADLY TALL QUIETLY

NICE SHYLY LONG HAPPILY SOFTLY LOYAL SAFELY GREEN

YELLOW QUICKLY UNSAFELY

COLOR ALL ADJECTIVES *RED*. COLOR ALL ADVERBS *BLUE*.

FIG. 93

NOUNS versus ADJECTIVES

| | | | | | | | | | | | | | | |
|---|---|---|---|---|---|---|---|---|---|---|---|---|---|---|
| T | S | C | A | R | Y | C | A | N | D | L | E | C | A | R |
| A | L | D | O | L | L | D | R | E | S | S | R | E | D | H |
| B | I | T | S | M | E | L | L | Y | D | B | O | O | K | K |
| L | P | W | I | S | E | P | D | V | D | V | L | Y | Y | I |
| E | P | R | E | D | D | O | G | S | T | O | R | Y | S | S |
| J | E | S | S | Y | R | G | R | T | O | R | N | S | S | K |
| E | R | E | E | T | S | H | I | N | Y | S | H | O | E | M |
| R | Y | R | R | R | J | U | N | K | Y | R | S | S | S | A |
| C | A | T | B | I | G | S | S | S | P | I | G | S | S | J |
| W | E | R | T | D | F | B | E | N | T | A | S | O | E | E |
| G | O | O | D | B | I | R | D | O | A | T | S | L | P | E |
| Z | X | C | V | B | S | I | R | J | J | S | T | D | R | Y |
| T | I | G | H | T | H | J | E | L | S | D | M | E | A | N |
| M | M | L | C | K | S | G | S | E | R | T | S | E | T | S |
| S | D | F | G | H | O | U | S | E | B | W | E | T | T | S |
| B | O | A | T | S | E | R | P | N | E | W | S | D | Y | F |

BIRD WET DOLL CAR NEW WISE BOOK PIGS SHOE STORY GOOD

RING DRESS HOUSE RED STICK TIGHT TOY BOAT CANDLE PRETTY

MEAN BIG JUNKY STAIRS OLD DIRTY DOG CAT SCARY SLIPPERY

SMELLY TABLE SHINY TORN FISH BENT OWL

**(Color the *nouns* BROWN. Color the *adjectives* BLUE.)**

FIG. 94

NOUNS versus PRONOUNS

| | | | | | | | | | | | | | | |
|---|---|---|---|---|---|---|---|---|---|---|---|---|---|---|
| I | I | T | P | A | P | E | R | B | S | D | O | G | X | W |
| M | D | R | E | H | E | R | L | O | G | S | S | H | E | A |
| Y | H | X | N | H | E | R | S | O | W | L | D | R | V | G |
| D | I | F | C | Y | O | U | R | K | S | D | V | E | R | O |
| D | S | D | I | F | T | B | F | L | Y | O | U | R | S | N |
| S | R | T | L | T | A | B | L | E | B | C | H | E | R | C |
| O | U | R | S | R | S | D | R | T | O | Y | Y | F | C | S |
| B | O | O | K | E | C | R | D | R | Y | T | H | E | I | R |
| P | C | S | D | E | X | H | O | U | S | E | C | F | B | J |
| A | M | I | N | E | C | F | G | N | T | O | U | R | C | Y |
| I | D | R | A | G | O | N | U | S | M | E | K | J | H | O |
| N | S | E | R | P | N | M | L | C | H | A | I | R | E | U |
| T | A | B | L | E | T | T | H | E | Y | I | H | G | E | W |
| S | A | B | C | N | D | C | A | T | E | F | Y | A | L | C |
| M | Y | S | E | L | F | A | H | I | M | T | H | E | M | D |
| C | U | C | U | M | B | E | R | S | J | E | W | E | L | S |

IT SHE PENCIL HE WE TABLET BOOK YOU ME THEY DRAGON THEM HIM HOUSE HER OUR US MYSELF BOOKLET MINE HERS PAINTS YOUR LOG JEWELS YOURS HIS DOG CAT WAGON CHAIR BOY TOY OWL TREE I MY TABLE PEN PAPER OURS THEIR CLAY CUCUMBERS (Color all *pronouns* RED. Color all *nouns* BROWN.)

FIG. 95

NOUNS VERSUS PRONOUNS

| | | | | | | | | | | | | | | |
|---|---|---|---|---|---|---|---|---|---|---|---|---|---|---|
| B | O | O | K | M | Y | S | E | L | F | S | T | O | R | E |
| I | T | O | W | E | L | O | U | R | S | H | A | F | J | H |
| R | H | A | I | R | S | H | O | E | J | F | C | E | A | G |
| D | T | H | E | I | R | S | P | A | P | E | R | V | E | A |
| F | I | S | H | E | R | S | G | T | S | F | P | D | H | R |
| S | D | H | E | R | S | E | L | F | K | G | Y | O | U | R |
| H | H | V | R | F | E | E | T | O | U | R | N | B | S | D |
| O | U | R | S | H | A | R | K | D | O | J | E | S | R | O |
| V | O | U | R | S | E | L | V | E | S | T | O | E | S | G |
| E | D | I | V | E | R | F | I | N | G | E | R | S | H | I |
| L | S | C | S | E | V | L | E | S | M | E | H | T | E | H |
| B | U | C | K | E | T | H | E | Y | T | H | E | I | R | V |
| M | E | S | A | N | D | W | E | U | S | H | E | L | L | S |
| P | R | N | C | I | L | H | O | R | S | E | G | E | X | T |
| H | I | M | S | E | L | F | E | S | Y | B | A | C | Z | Z |
| A | D | B | Y | R | V | K | S | F | F | M | I | H | S | D |

BOOK THEIR FEET MYSELF TOES STORE PENCIL OUR I PAPER WE YOUR PEN HE HORSE HIMSELF CAT HIS BIRD SHE FISH HER SHOE TOWEL HERS BUCKET HERSELF SAND SHOVEL US SHELLS SHARK OURSELVES DIVER THEY HAIR THEMSELVES FINGERS THEIRS OURS ME DOG HIM (COLOR *NOUNS* RED. COLOR *PRONOUNS* BLUE.)

FIG. 96

VERBS VS. ADVERBS

| | | | | | | | | | | | | | | |
|---|---|---|---|---|---|---|---|---|---|---|---|---|---|---|
| R | A | N | S | M | O | O | T | H | L | Y | B | G | I | Y |
| U | S | P | E | A | K | S | F | L | I | L | O | N | L | I |
| N | M | E | E | K | L | Y | L | Y | W | W | L | O | Y | L |
| S | T | A | R | E | S | H | L | L | A | L | D | I | I | L |
| T | A | L | K | E | D | O | E | J | L | Y | L | S | F | O |
| I | L | W | T | L | L | P | S | E | K | A | Y | I | A | U |
| L | I | I | A | Y | O | S | I | I | S | L | I | L | S | D |
| W | A | L | K | E | D | L | J | U | M | P | S | Y | T | L |
| T | A | L | K | S | L | Y | I | Q | U | I | C | K | L | Y |
| A | L | Y | E | L | Y | I | D | E | E | P | L | Y | I | H |
| A | Y | L | D | S | L | E | E | P | S | C | R | I | E | S |
| L | S | W | E | E | T | L | Y | S | J | A | E | P | S | H |
| A | H | A | P | P | I | L | Y | L | I | Y | A | L | I | I |
| R | E | A | D | S | S | L | O | W | L | Y | T | Y | L | G |
| L | Y | E | A | S | I | L | Y | L | Y | L | S | L | I | H |
| S | O | F | T | L | Y | Q | U | I | E | T | L | Y | N | J |

SMOOTHLY FLIES CRIES STARES FAST EATS WALKED QUIETLY

SPEAKS TALKS HAPPILY READS SLEEPS QUICKLY SOFTLY MEEKLY

SWEETLY WALKS SLOWLY HOPS RUNS BOLDLY HIGH LOUDLY

JUMPS NOISILY EASILY TALKED DEEPLY RAN

**(Color *verbs* YELLOW. Color *adverbs* BLUE.)**

FIG. 97

EDUCATIONAL GAME APPARATUS AND METHOD FOR PLAYING A GAME

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

1. The Field of the Invention

The present disclosure relates generally to an apparatus and method for playing games, and more particularly, but not necessarily entirely, to a unique educational gaming concept where multiple teaching concepts compete against each other instead of individuals competing against each other.

2. Description of Related Art

It is known to provide games to promote education and learning. Games have been utilized to help teach a variety of educational subjects, including mathematics (e.g., U.S. Pat. No. 6,648,648), science (e.g., U.S. Pat. No. 6,279,908), and history (e.g., U.S. Pat. No. 5,660,389). In addition to common school subjects, there are a variety of educational games that teach skills, such as critical thinking (e.g., U.S. Pat. No. 6,120,028) and occupational skills (e.g., U.S. Pat. No. 6,224,056).

A majority of games, such as those disclosed above, are designed for competition between individual players of the game. In an educational setting, especially for primary education aged children, competition may inhibit learning. One reason is competition has a tendency to create an inhibition effect that may make it harder for some individuals to learn new things or generate new ideas. It will be appreciated that competition may inhibit learning and creativity in an educational setting simply because individuals may be, inter alia, worrying too much about the outcome of the game, concentrating too heavily on the strategy of their opponents, and feeling anxiety over the reactions of their peers if a wrong answer is given or if their team loses, rather than focusing on the primary objective, which is learning. Competition may also inhibit the sharing of ideas and helping others to learn.

For example, U.S. Pat. No. 6,019,370 (granted Feb. 1, 2000 to Morris) discloses an educational game where multiple players use individual playing pieces to advance along a travel path of the board from start to finish. Players take turns attempting to advance along the travel path by correctly answering questions from a selection of questions and answers printed in a book according to selected subject matter categories. This game is characterized by several disadvantages, including inhibiting an atmosphere of learning in an educational setting because players are competing against one another to obtain the most points to win the game.

There are many other educational games known in the prior art, such as that disclosed in U.S. Pat. No. 6,648,648 (granted Nov. 18, 2003 to O'Connell). This patent reference discloses an educational game for teaching mathematics. The game board is a continuous play path, where spaces are labeled with a mathematical category and a monetary amount. Each mathematical category has its own deck of cards with questions, answers and explanations. At least one of the spaces of the game board is labeled with the help category. When a player lands on this space they receive a help card, which permits that player to ask another player for help in solving a question. When a marker stops on a space that has a mathematical category the player selects a corresponding card. If the player's solution to the question and answer on the card match the player collects play money in the amount printed on the space. If not, play proceeds to the next player and the first player continues to work on the question, giving that player the ability to self-correct. All solutions may be collected as an assignment by a teacher in a classroom setting. The first player to accumulate a specified amount of play money is the winner. This game is also characterized by several disadvantages, including inducing players to compete with one another in order to obtain the most money and win the game, thereby fostering competition and inhibiting learning.

It is noteworthy that none of the prior art known to applicant provides a game that fosters learning and inhibits competition in the manner described herein. There is a long felt, but unmet need, for an educational game apparatus and method of playing a game that fosters learning by one concept competing against at least one other concept, rather than individual players or teams competing against each other.

The prior art is thus characterized by several disadvantages that are potentially addressed by the present disclosure. The present disclosure minimizes, and in some aspects eliminates, the above-mentioned failures, and other problems, by utilizing the methods and features described herein.

The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which:

FIG. 44 is an illustrative embodiment of a concept versus concept game as disclosed herein entitled "Perimeter Area Volume", which is an example of a forward-backward-forward game;

FIG. 91 is an illustrative embodiment of a concept versus concept game as disclosed herein entitled "NOUNS vs. NOT NOUNS", which is an example of a concept search game;

FIG. 92 is an illustrative embodiment of a concept versus concept game as disclosed herein entitled "COMPARING 2? 3 or more?", which is an example of a concept search game;

FIG. 93 is an illustrative embodiment of a concept versus concept game as disclosed herein entitled "ADJECTIVES VERSUS ADVERBS", which is an example of a concept search game;

FIG. 94 is an illustrative embodiment of a concept versus concept game as disclosed herein entitled "NOUNS versus ADJECTIVES", which is an example of a concept search game;

FIG. 95 is an illustrative embodiment of a concept versus concept game as disclosed herein entitled "NOUNS versus PRONOUNS", which is an example of a concept search game;

FIG. 96 is an illustrative embodiment of a concept versus concept game as disclosed herein entitled "NOUNS VERSUS PRONOUNS", which is an example of a concept search game; and FIG. 97 is an illustrative embodiment of a concept versus concept game as disclosed herein entitled "VERBS VS. ADVERBS", which is an example of a concept search game.

DETAILED DESCRIPTION

Figure 1:
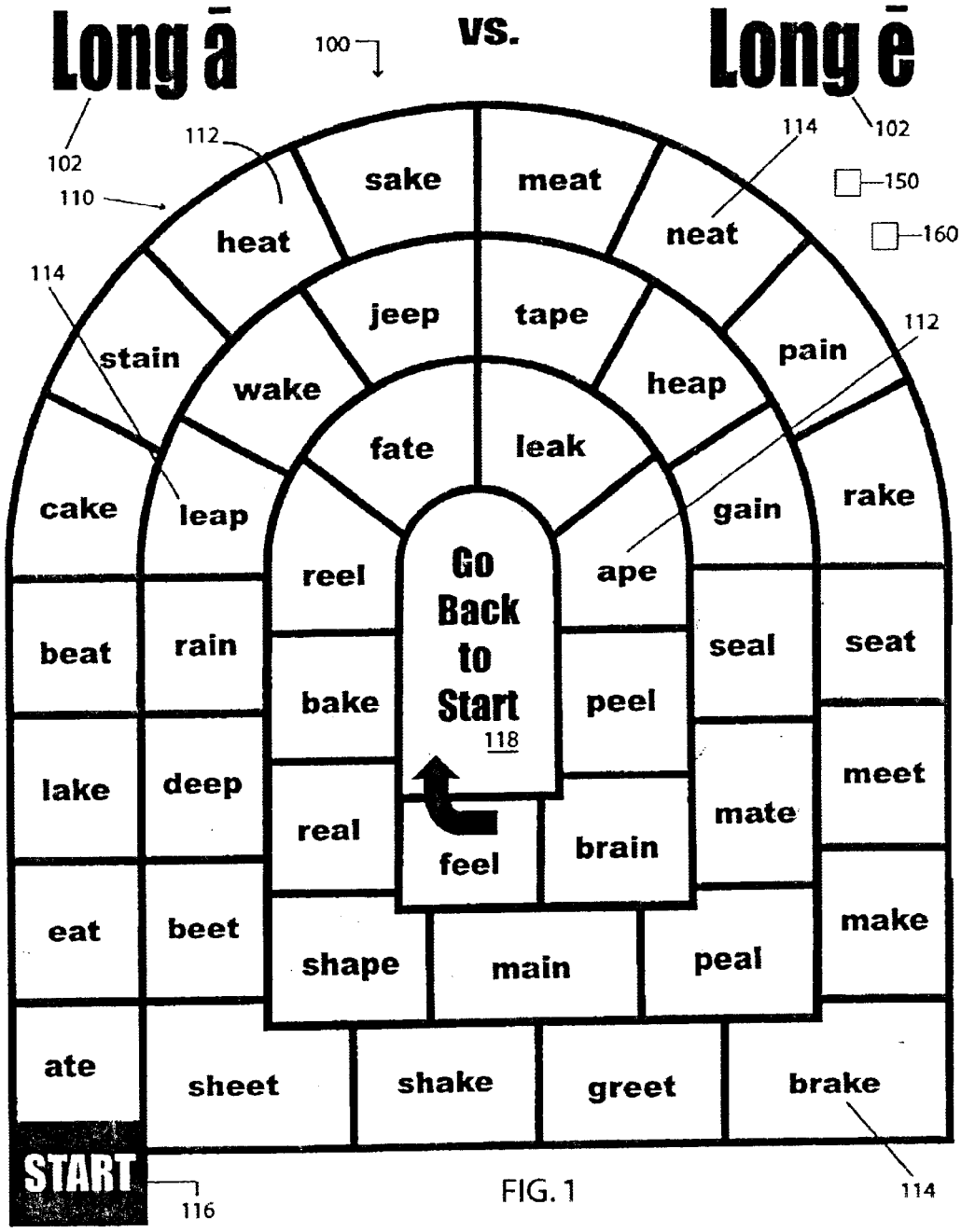
FIG. 1 is an illustrative embodiment of a concept versus concept game as disclosed herein entitled "Long a vs. Long e", which is an example of a forward-backward-forward game.
Figure 2:
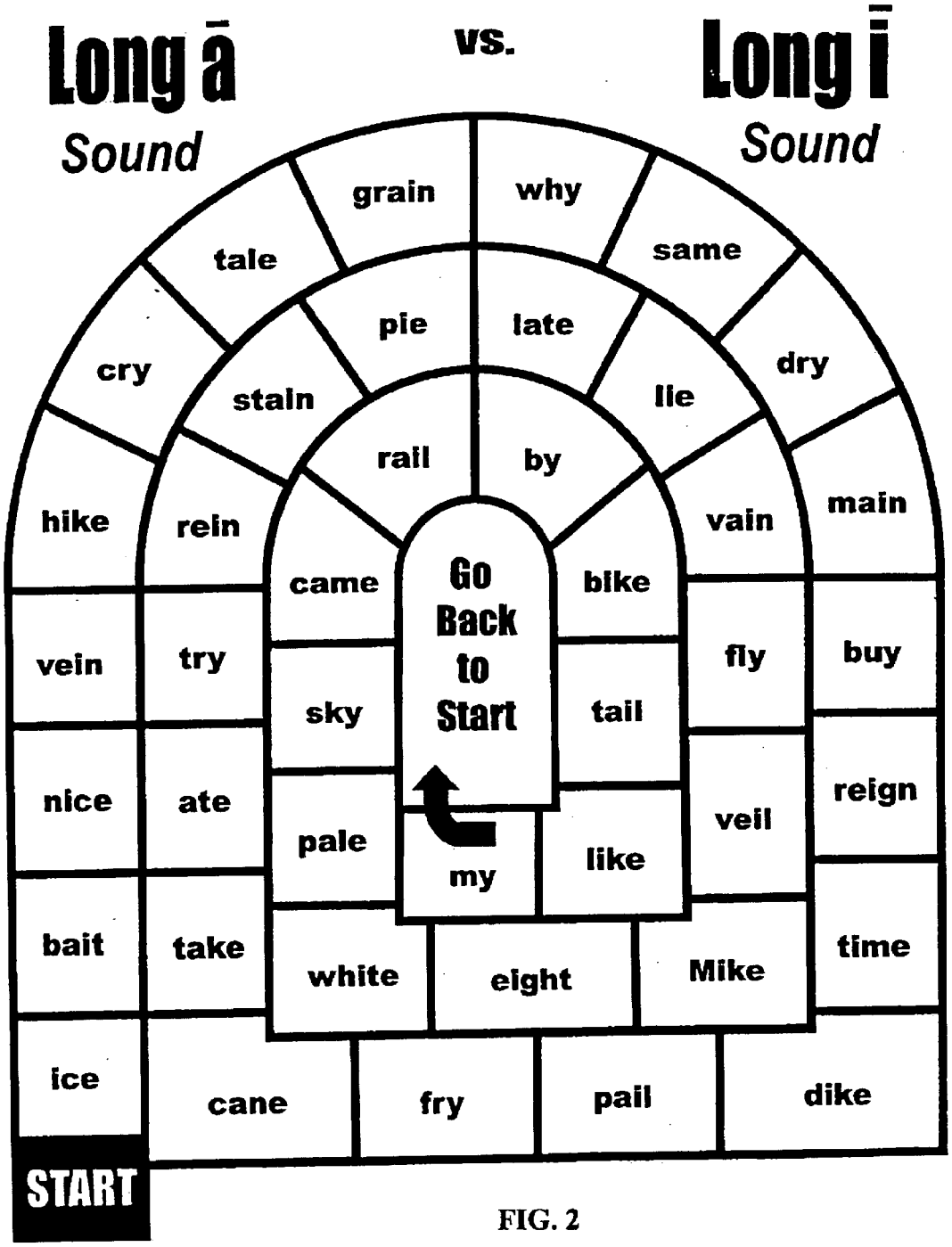
FIG. 2 is an illustrative embodiment of a concept versus concept game as disclosed herein entitled "Long a. Sound vs. Long i Sound", which is an example of a forward-backward-forward game.
Figure 3:
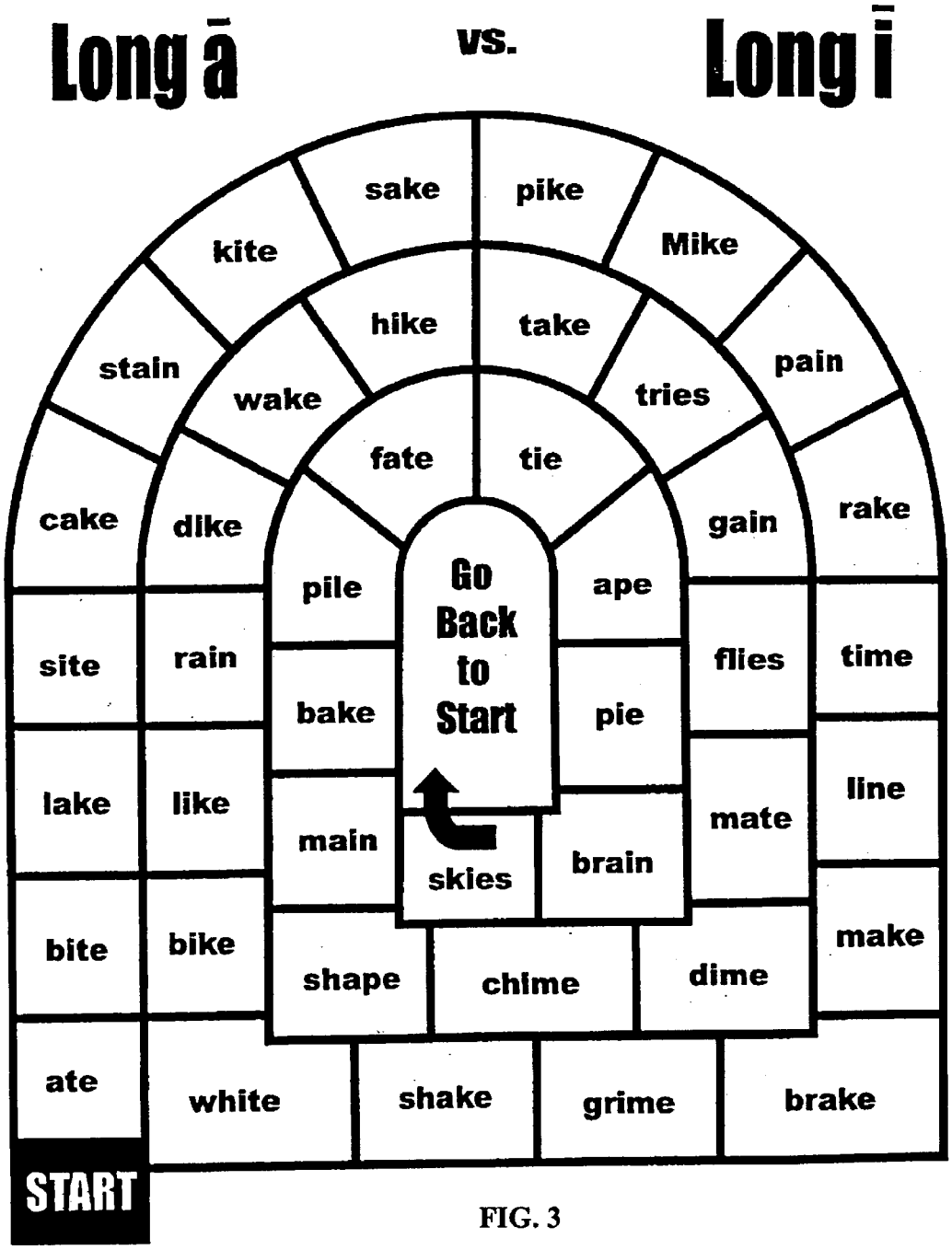
FIG. 3 is an illustrative embodiment of a concept versus concept game as disclosed herein entitled "Long a vs. Long i", which is an example of a forward-backward-forward game.
Figure 4:
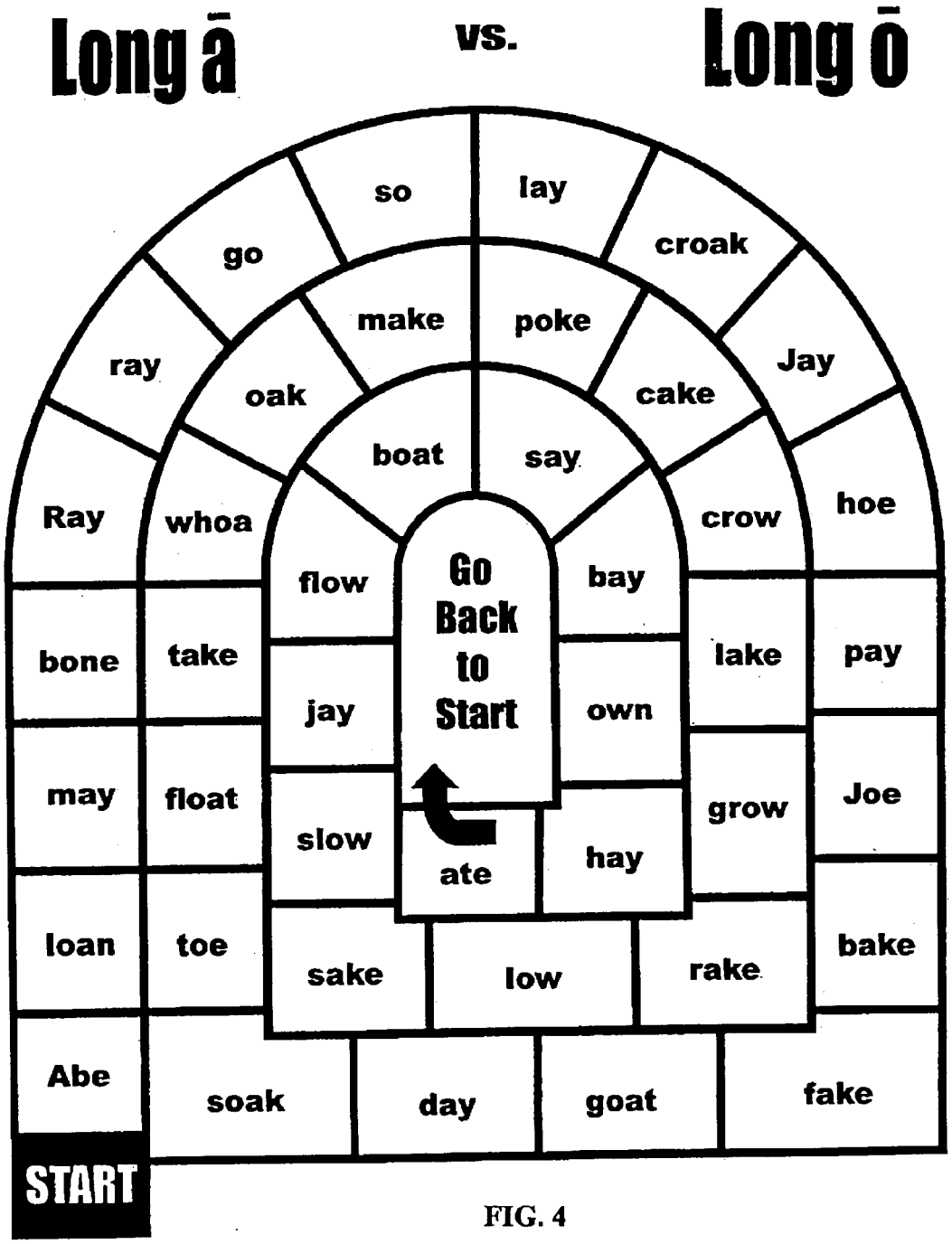
FIG. 4 is an illustrative embodiment of a concept versus concept game as disclosed herein entitled "Long a vs. Long o", which is an example of a forward-backward-forward game.
Figure 5:
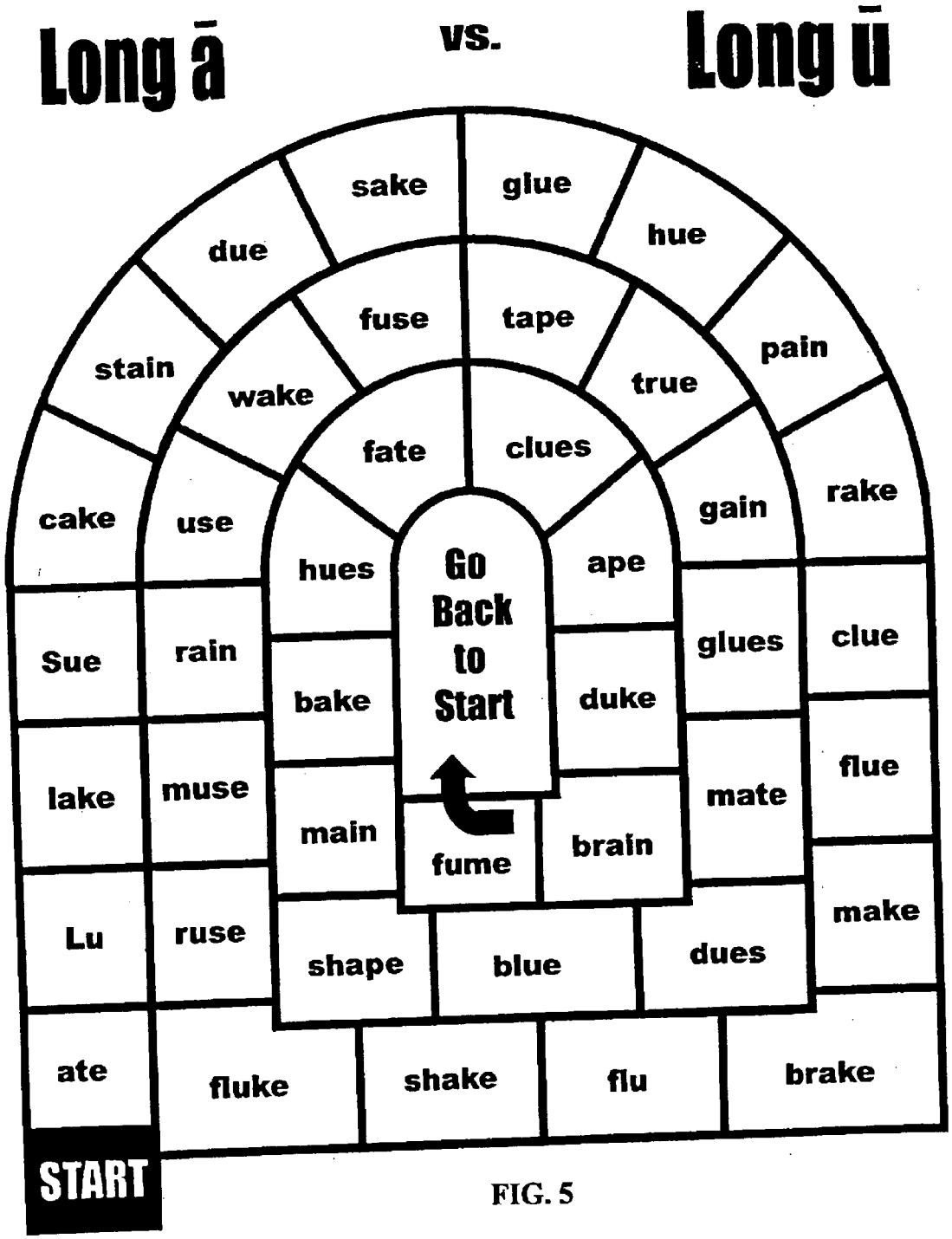
FIG. 5 is an illustrative embodiment of a concept versus concept game as disclosed herein entitled "Long a vs. Long u", which is an example of a forward-backward-forward game.
Figure 6:
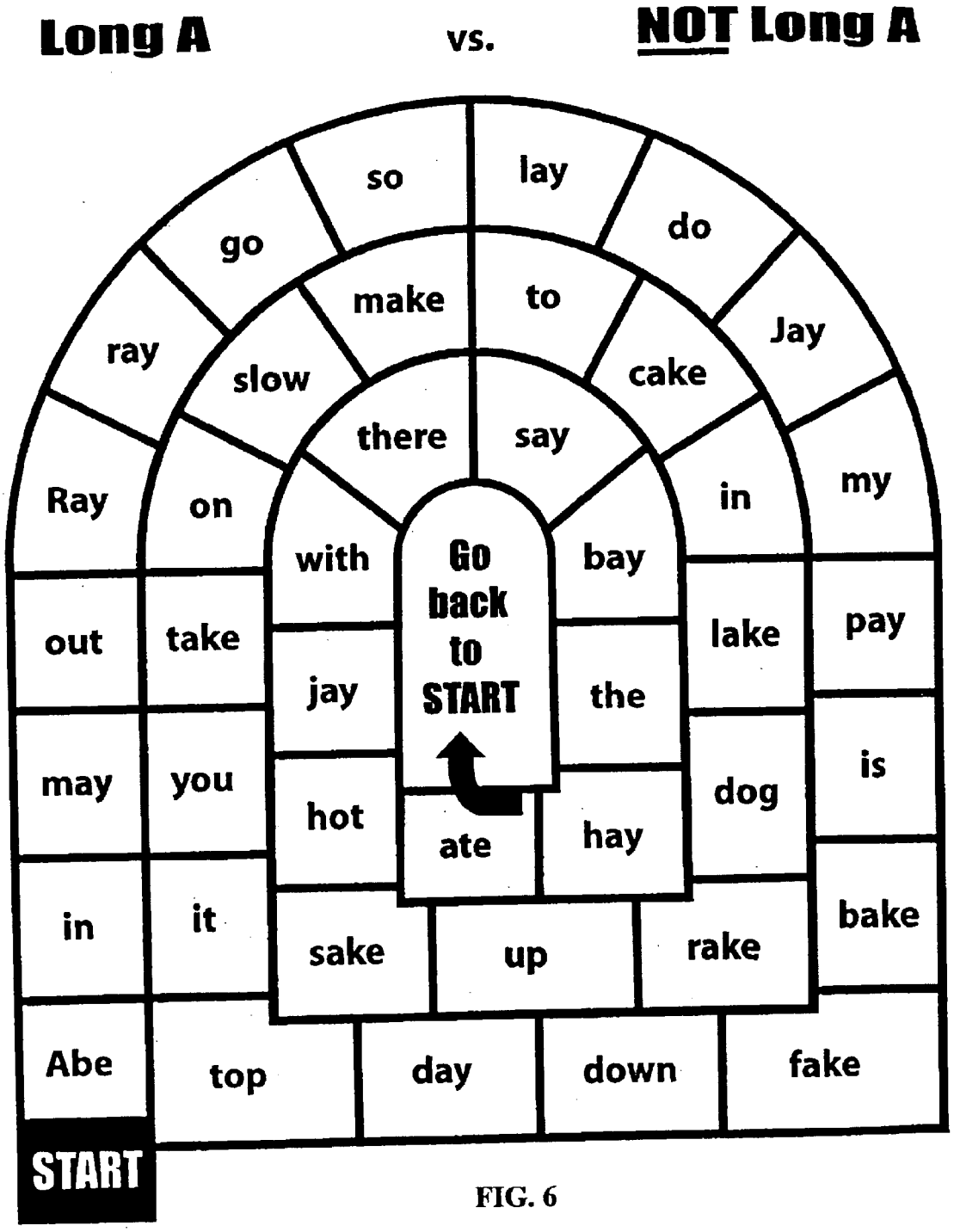
FIG. 6 is an illustrative embodiment of a concept versus concept game as disclosed herein entitled "Long A vs. Not Long A", which is an example of a forward-backward-forward game.
Figure 7:
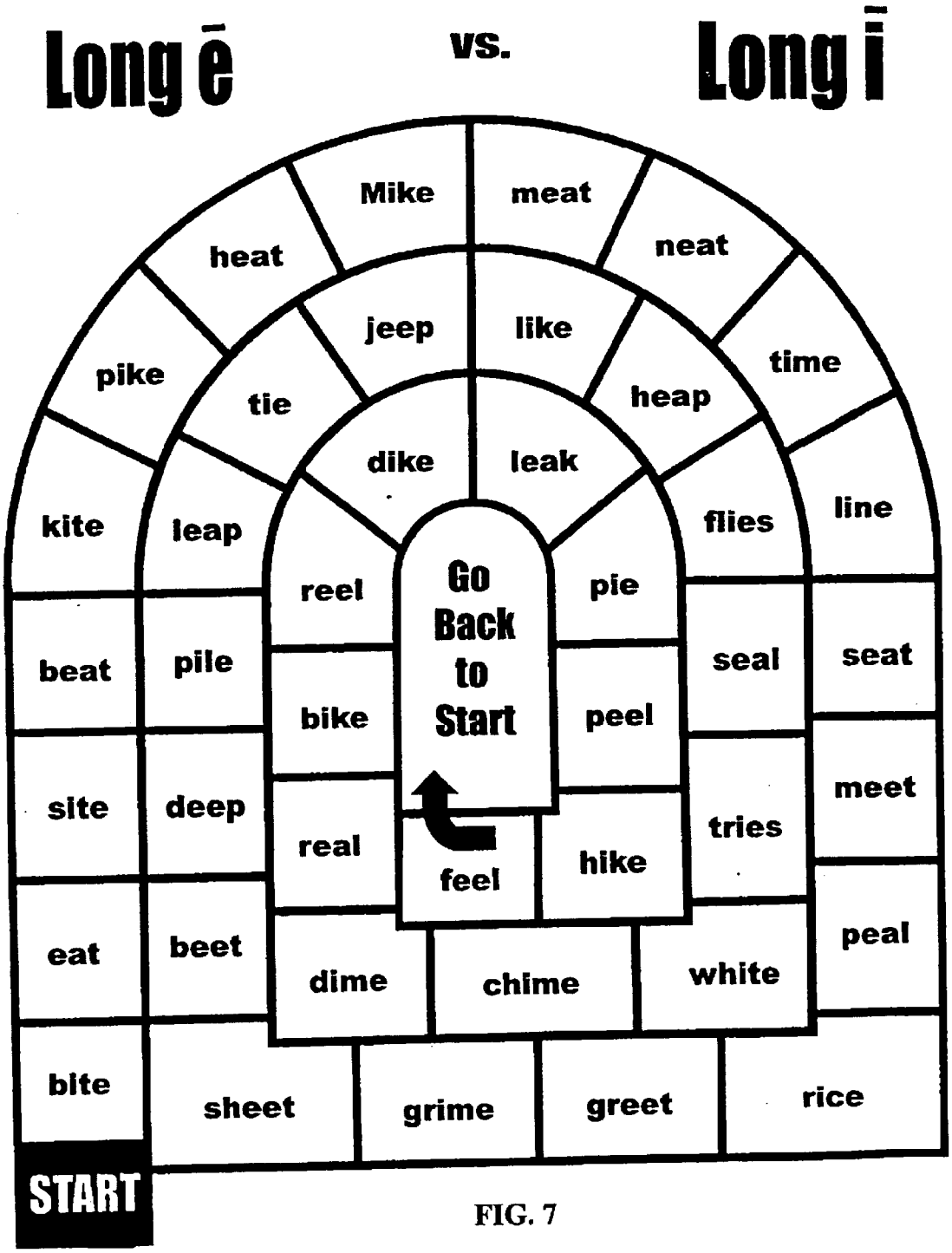
FIG. 7 is an illustrative embodiment of a concept versus concept game as disclosed herein entitled "Long e vs. Long i", which is an example of a forward-backward-forward game.
Figure 8:
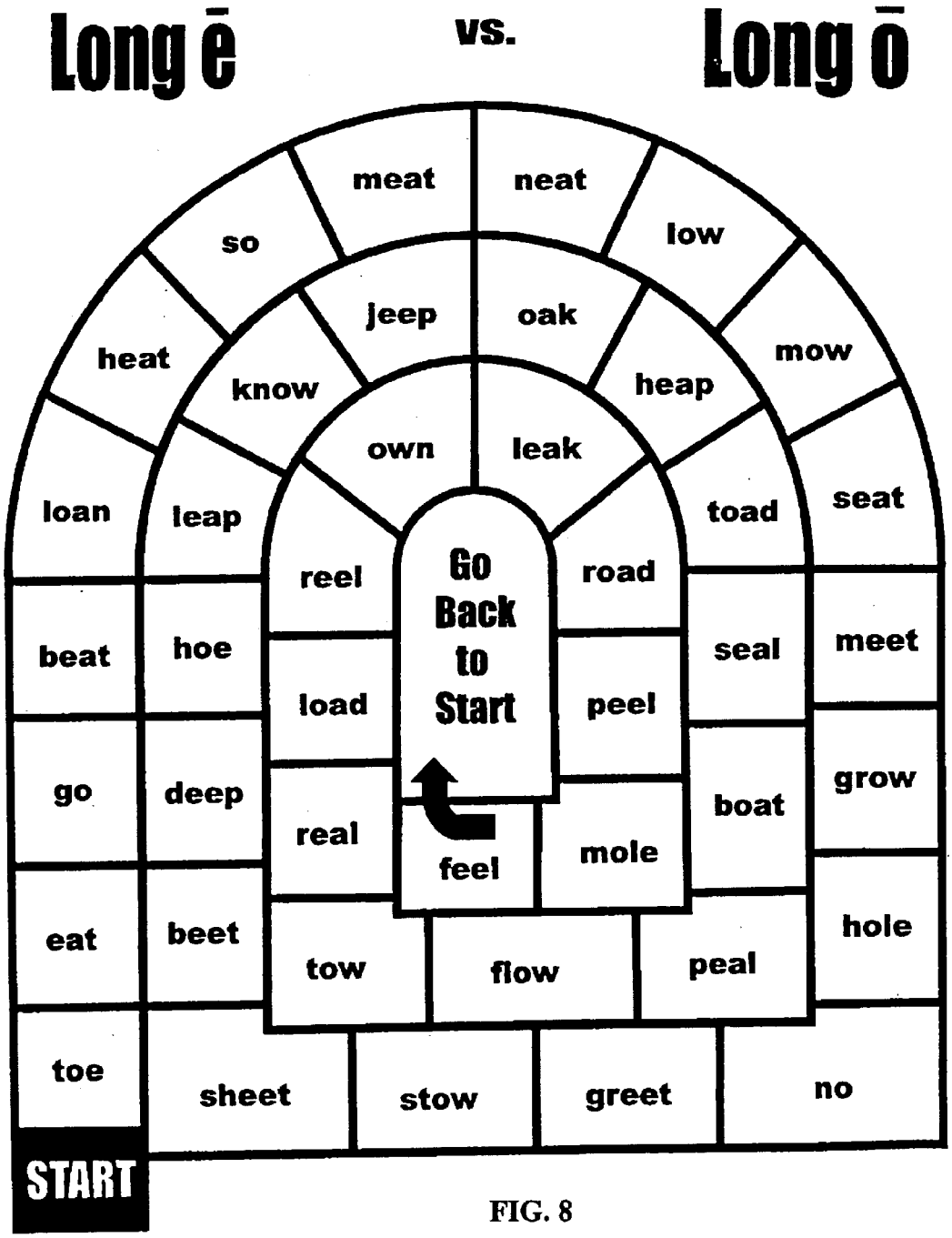
FIG. 8 is an illustrative embodiment of a concept versus concept game as disclosed herein entitled "Long e vs. Long o", which is an example of a forward-backward-forward game.
Figure 9:
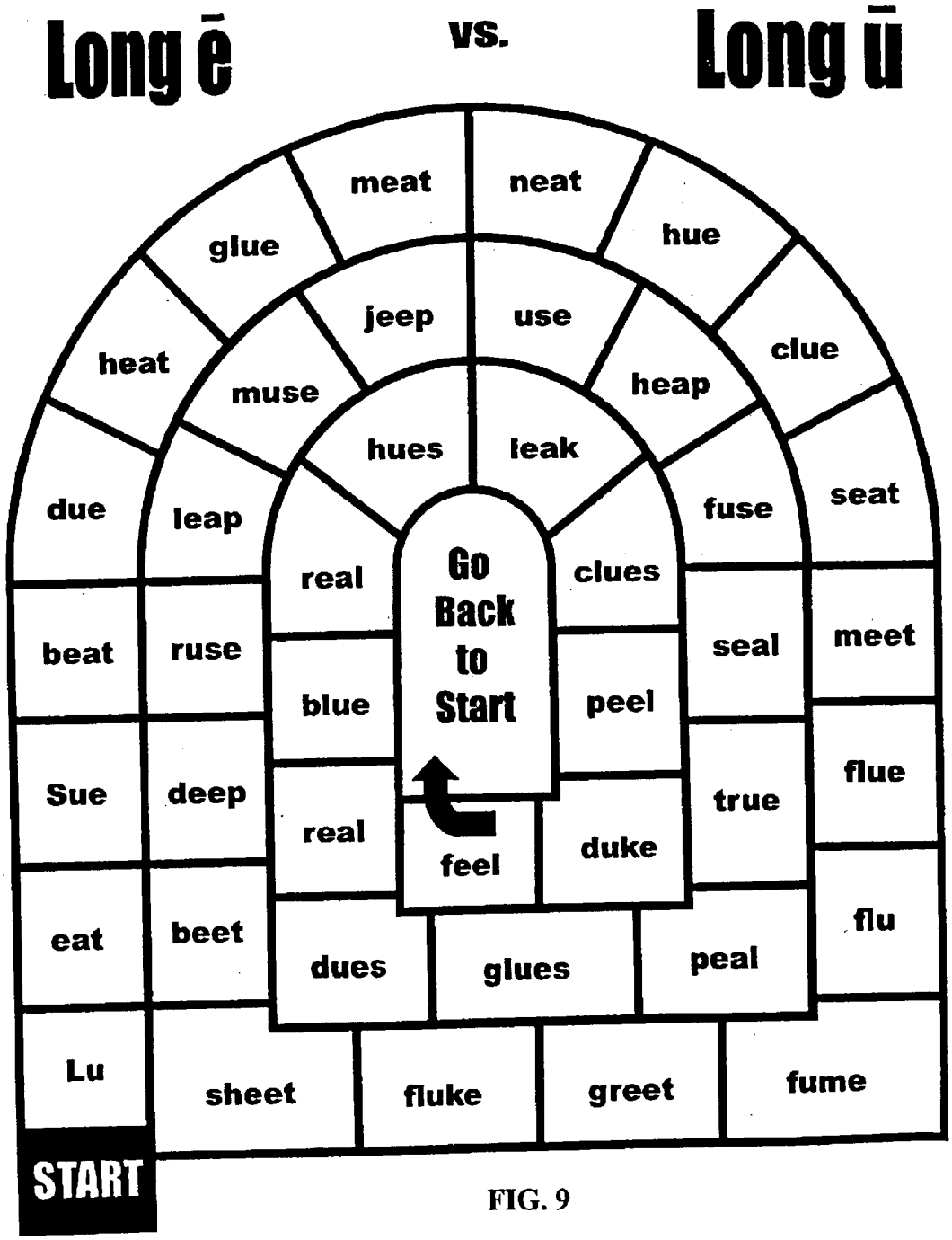
FIG. 9 is an illustrative embodiment of a concept versus concept game as disclosed herein entitled "Long e vs. Long u", which is an example of a forward-backward-forward game.
Figure 10:
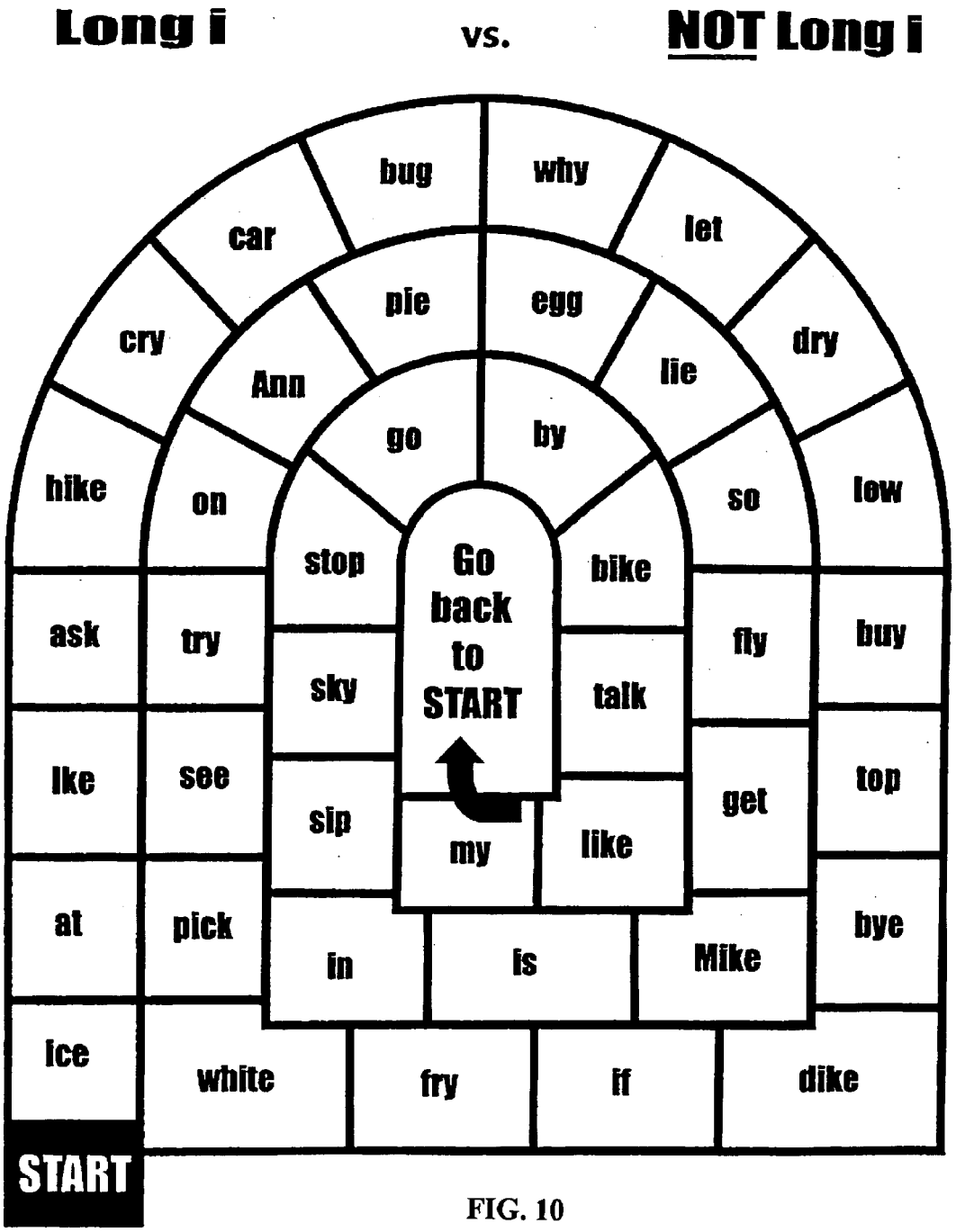
FIG. 10 is an illustrative embodiment of a concept versus concept game as disclosed herein entitled "Long i vs. Not Long i", which is an example of a forward-backward-forward game.
Figure 11:
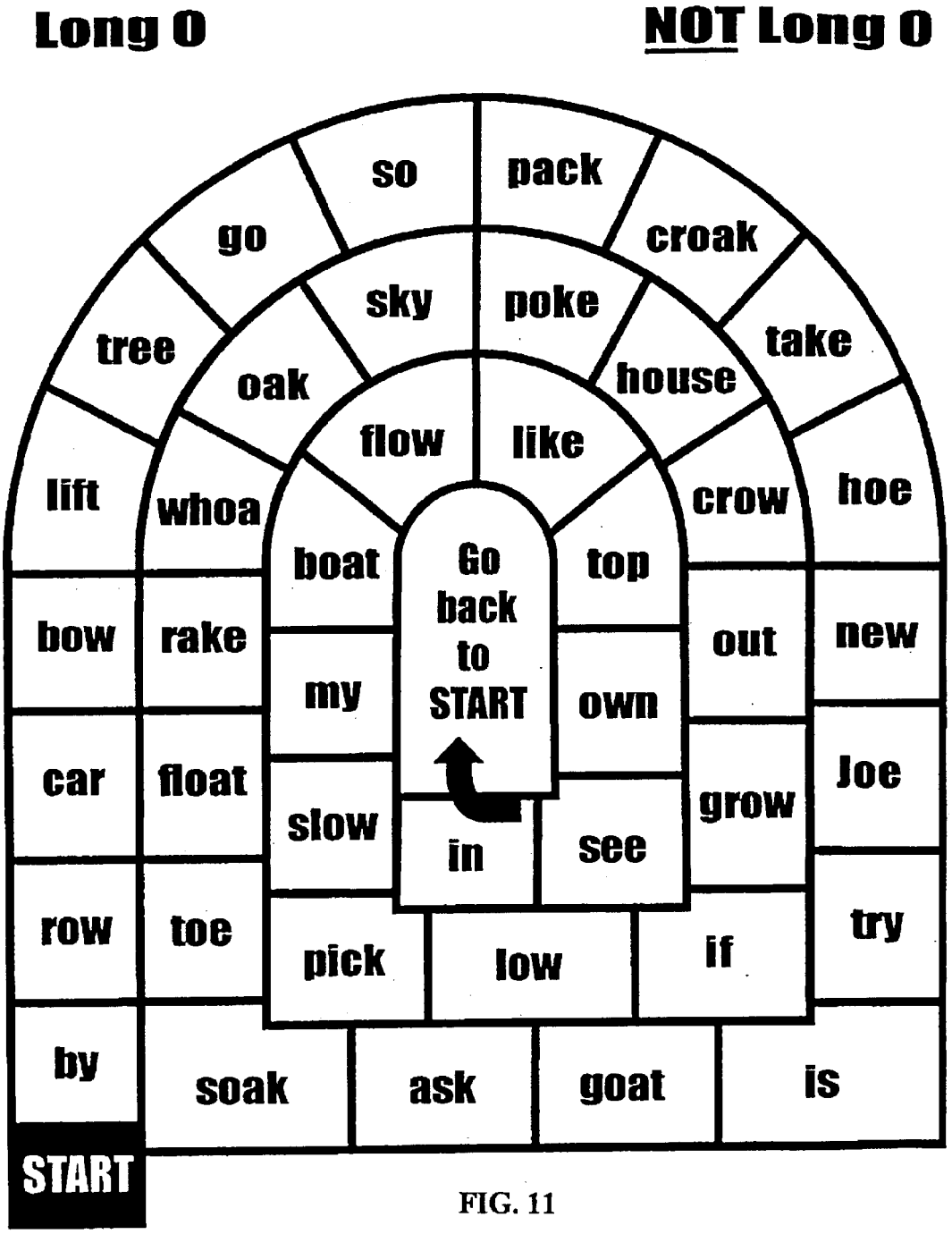
FIG. 11 is an illustrative embodiment of a concept versus concept game as disclosed herein entitled "Long O vs. Not Long O", which is an example of a forward-backward-forward game.
Figure 12:
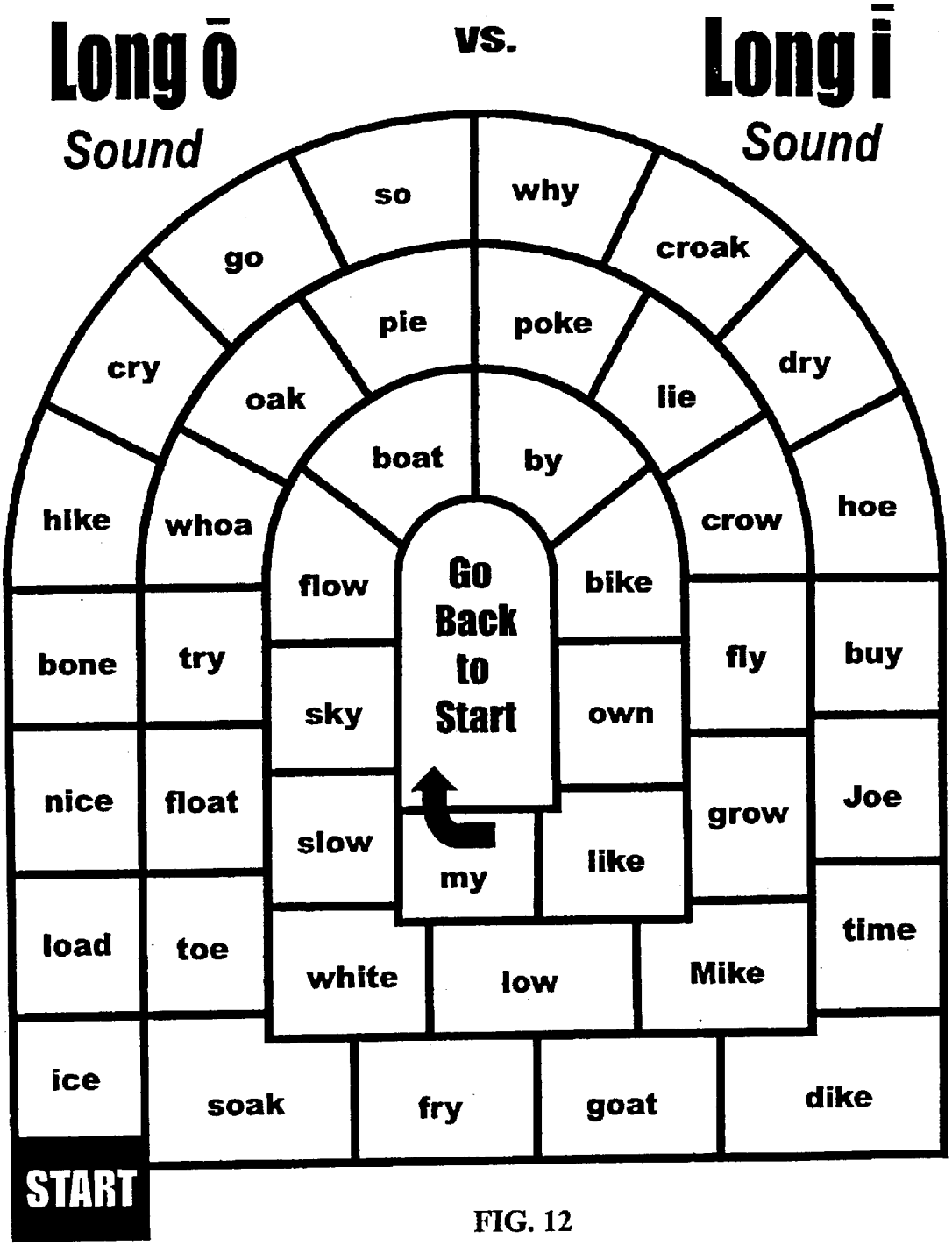
FIG. 12 is an illustrative embodiment of a concept versus concept game as disclosed herein entitled "Long 0 Sound vs. Long i Sound", which is an example of a forward-backward-forward game.
Figure 13:
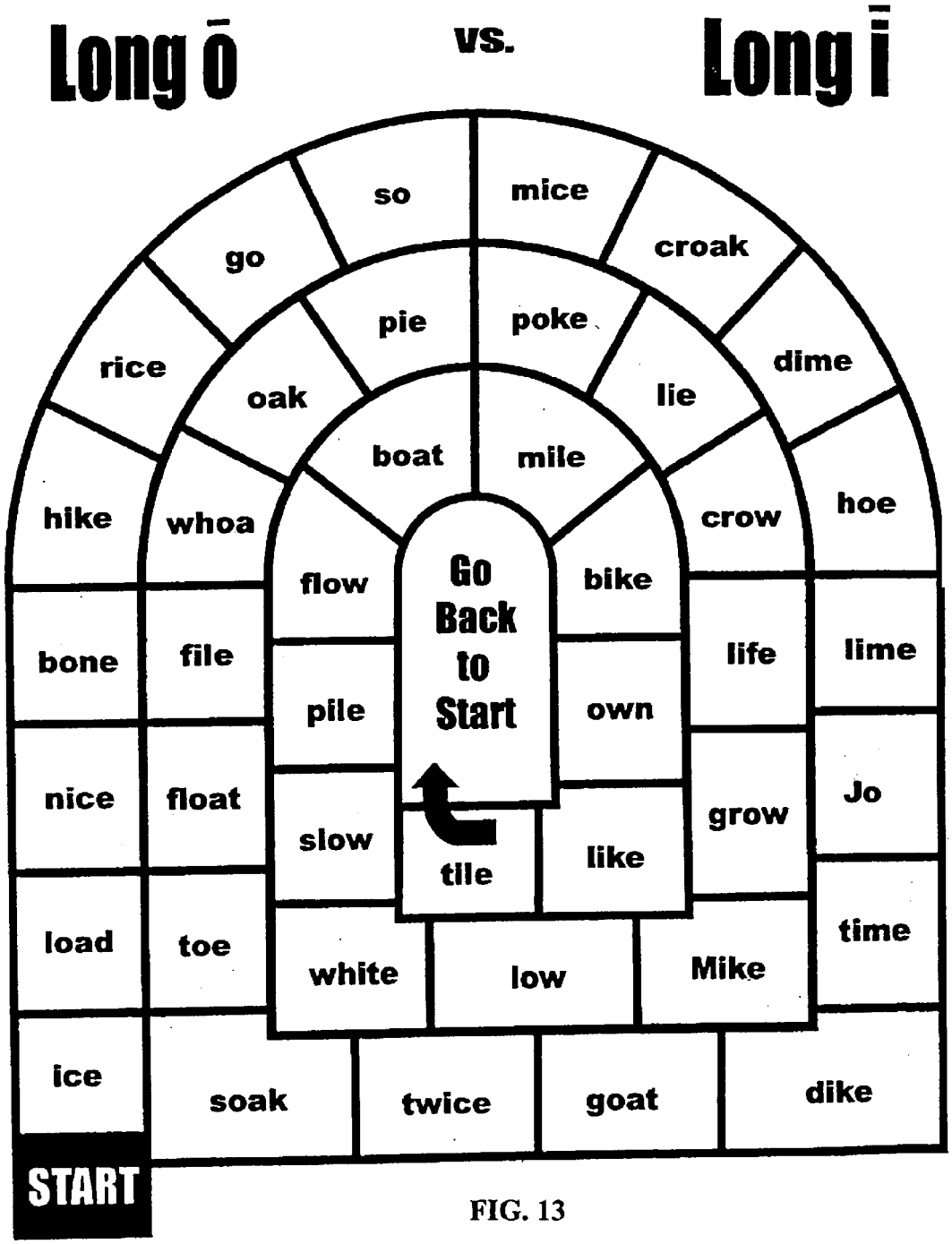
FIG. 13 is an illustrative embodiment of a concept versus concept game as disclosed herein entitled "Long o vs. Long i", which is an example of a forward-backward-forward game.
Figure 14:
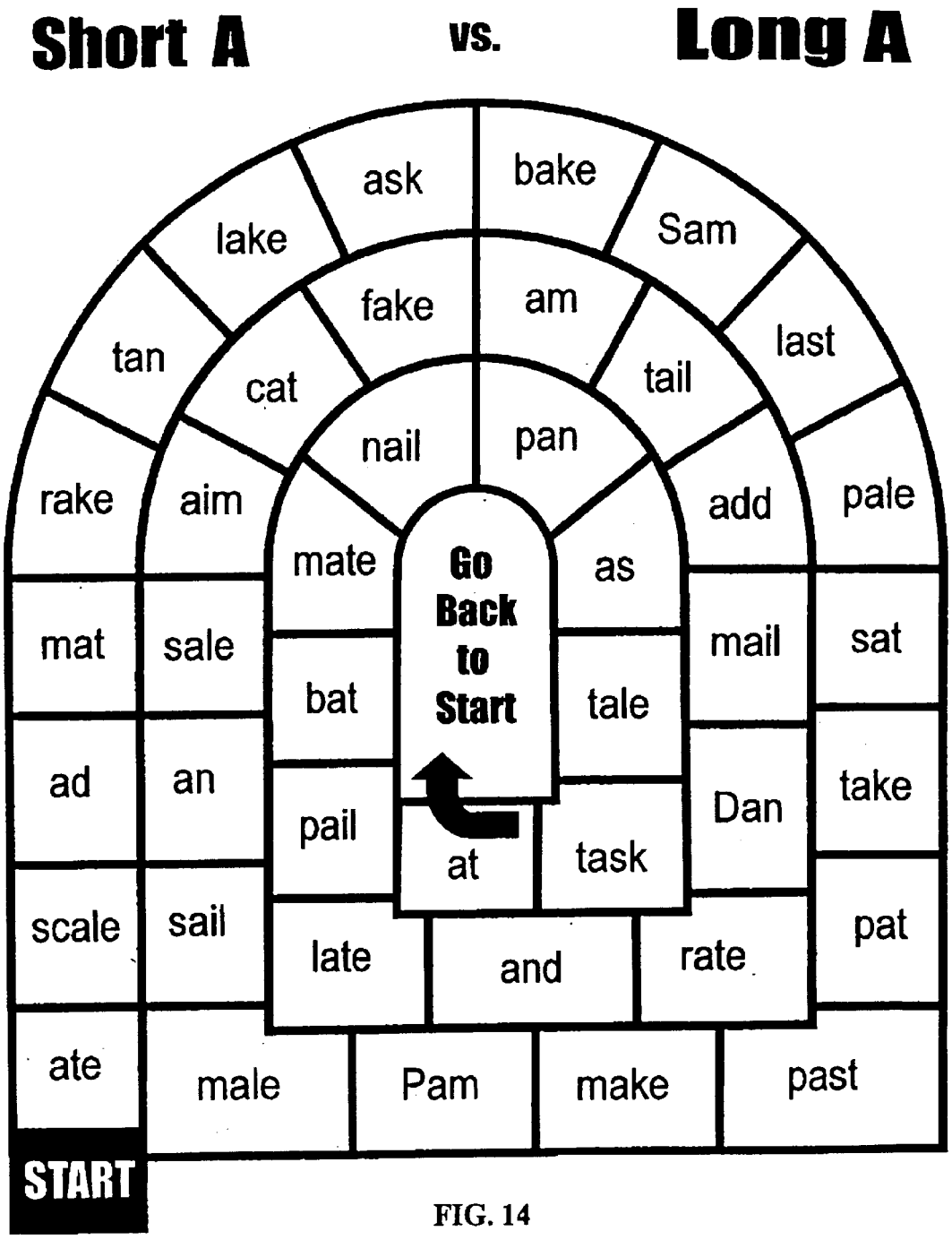
FIG. 14 is an illustrative embodiment of a concept versus concept game as disclosed herein entitled "Short A vs. Long A", which is an example of a forward-backward-forward game.
Figure 15:
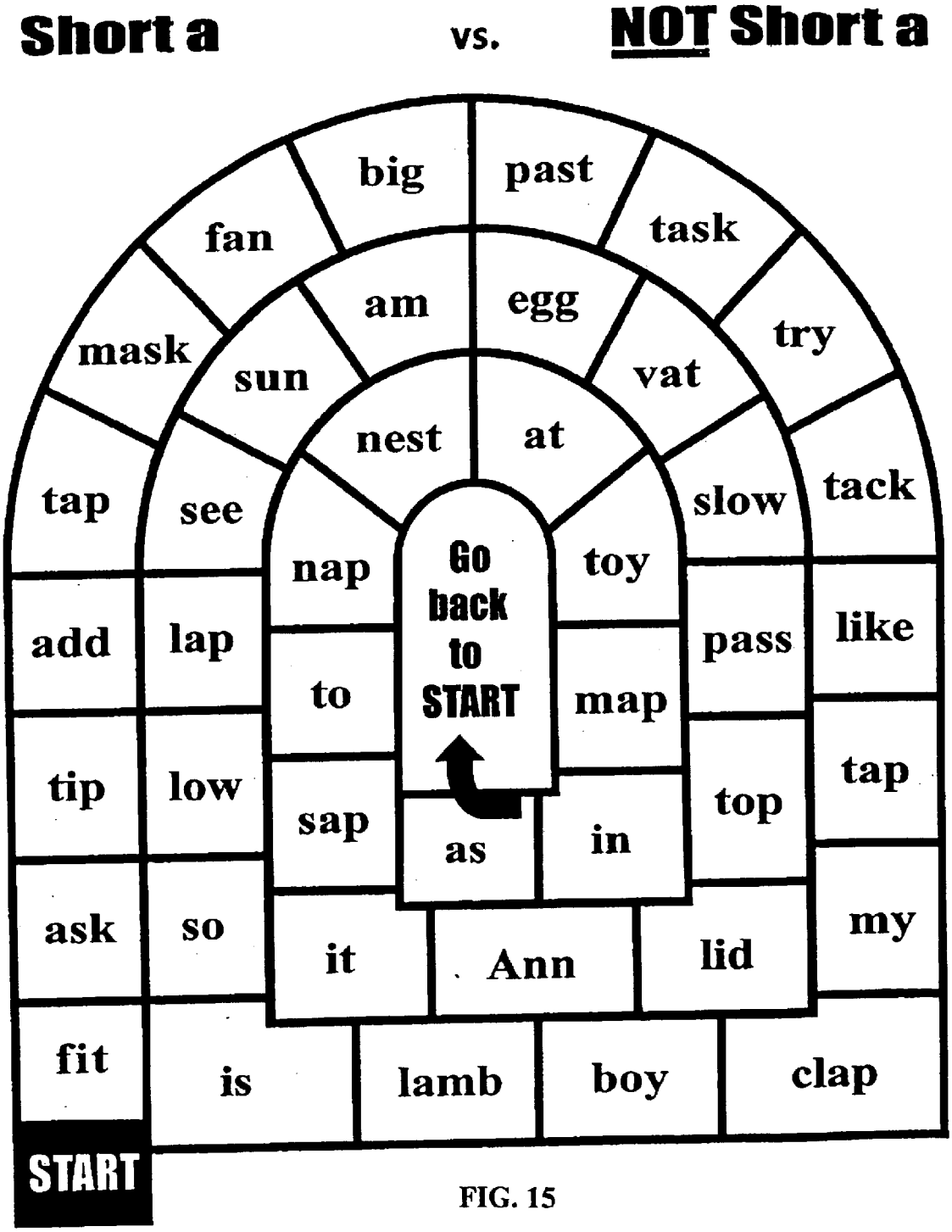
FIG. 15 is an illustrative embodiment of a concept versus concept game as disclosed herein entitled "Short a vs. NOT Short a", which is an example of a forward-backward-forward game.
Figure 16:
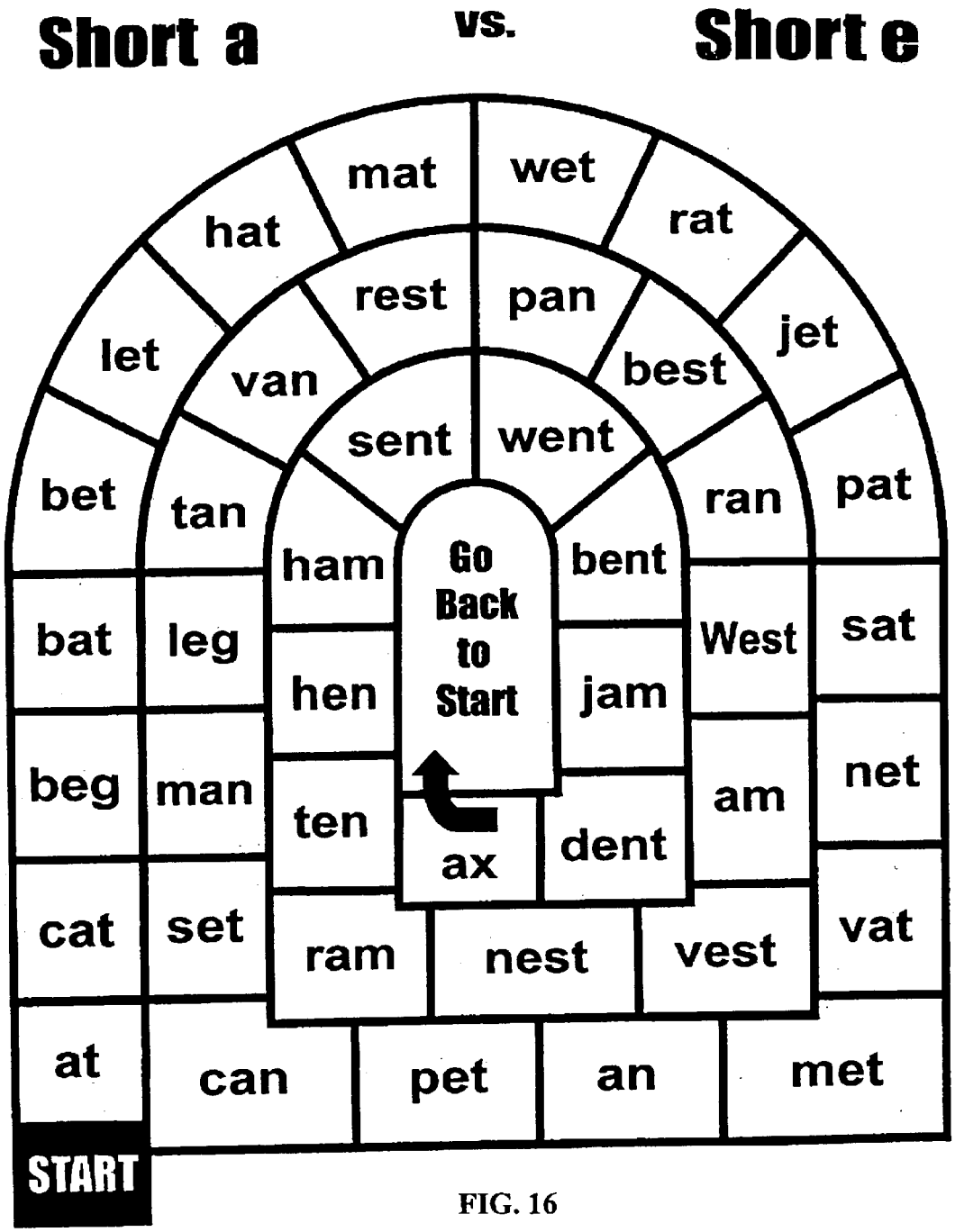
FIG. 16 is an illustrative embodiment of a concept versus concept game as disclosed herein entitled "Short a vs. Short e", which is an example of a forward-backward-forward game.
Figure 17:
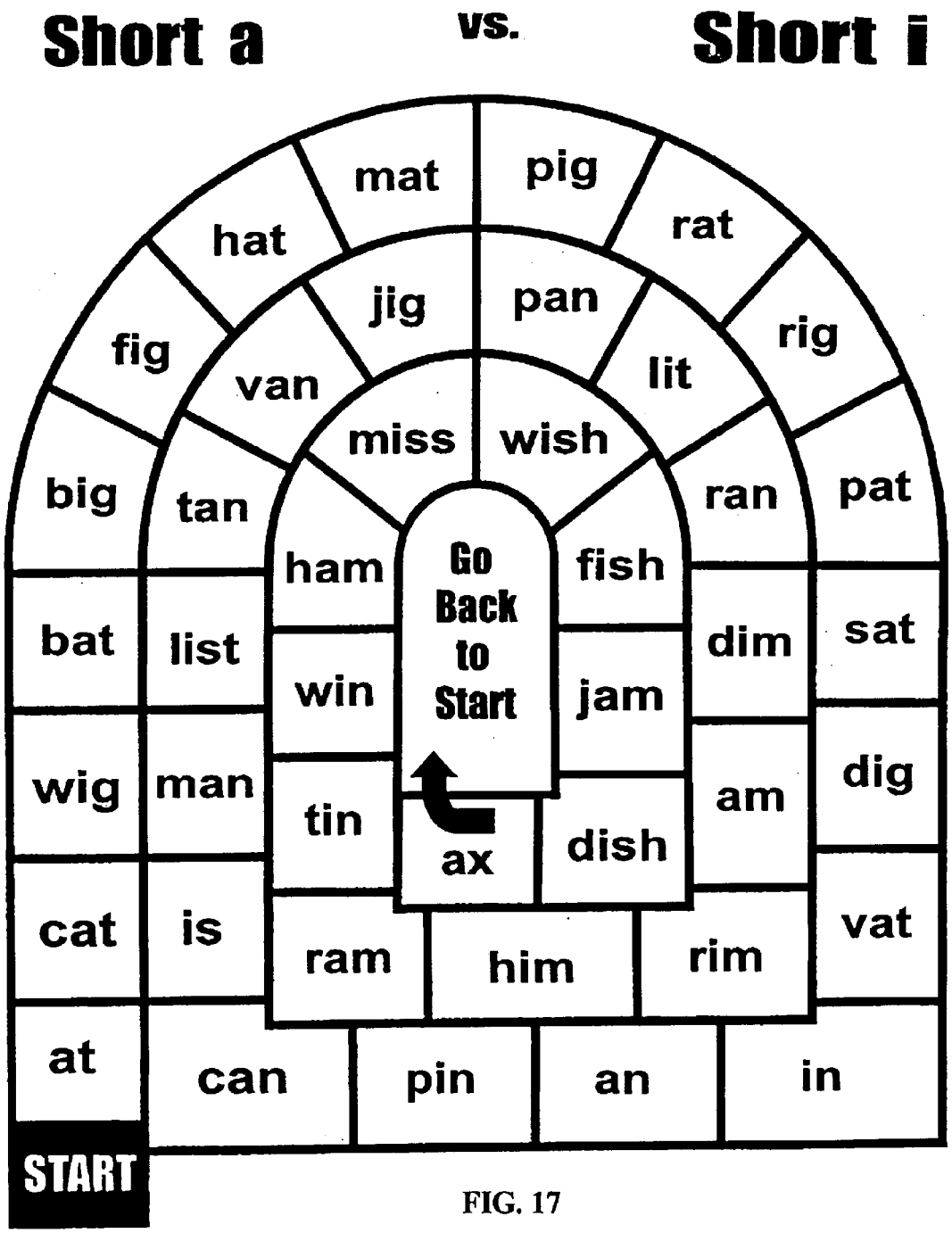
FIG. 17 is an illustrative embodiment of a concept versus concept game as disclosed herein entitled "Short a vs. Short i", which is an example of a forward-backward-forward game.
Figure 18:
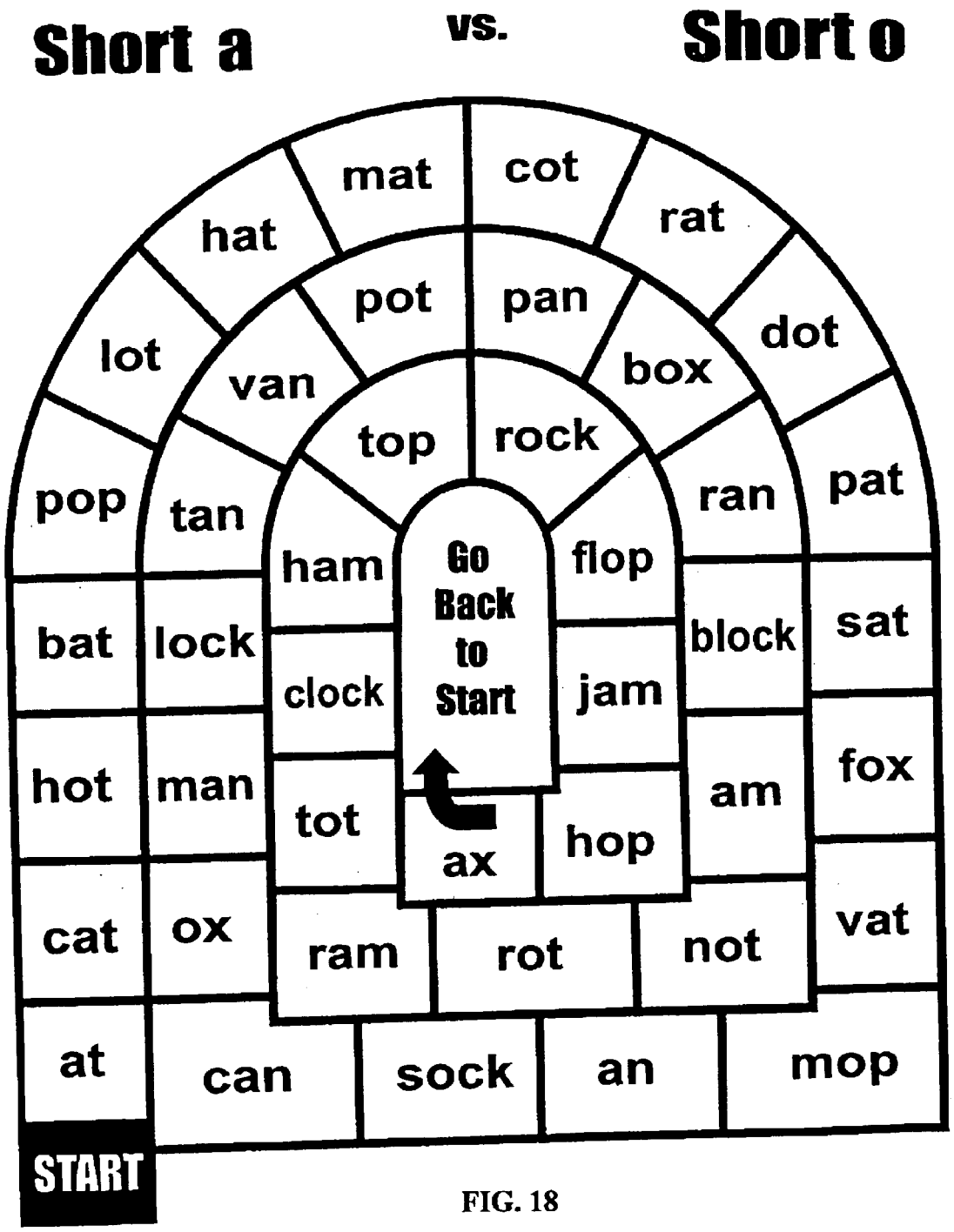
FIG. 18 is an illustrative embodiment of a concept versus concept game as disclosed herein entitled "Short a vs. Short o", which is an example of a forward-backward-forward game.
Figure 19:
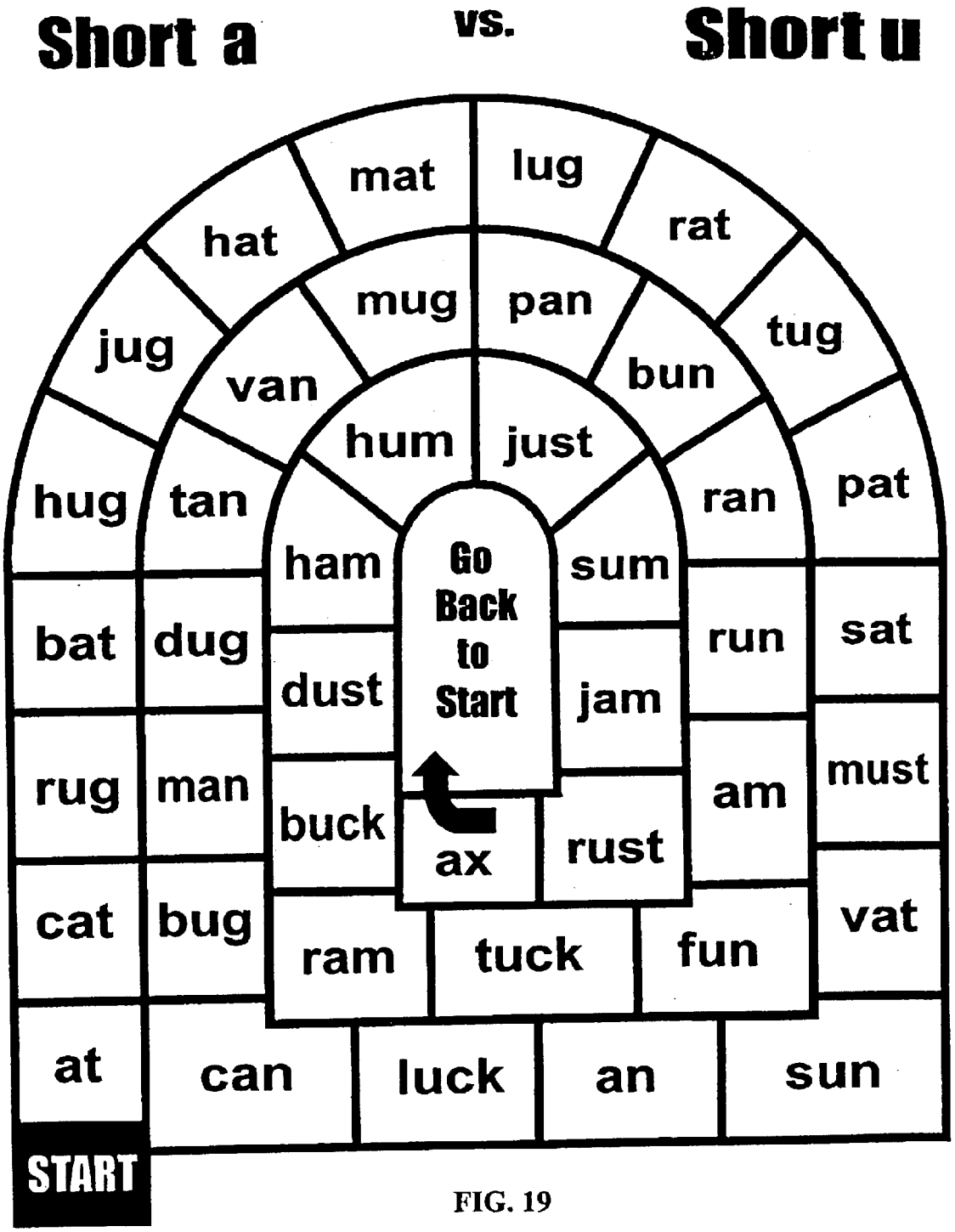
FIG. 19 is an illustrative embodiment of a concept versus concept game as disclosed herein entitled "Short a vs. Short u", which is an example of a forward-backward-forward game.
Figure 20:
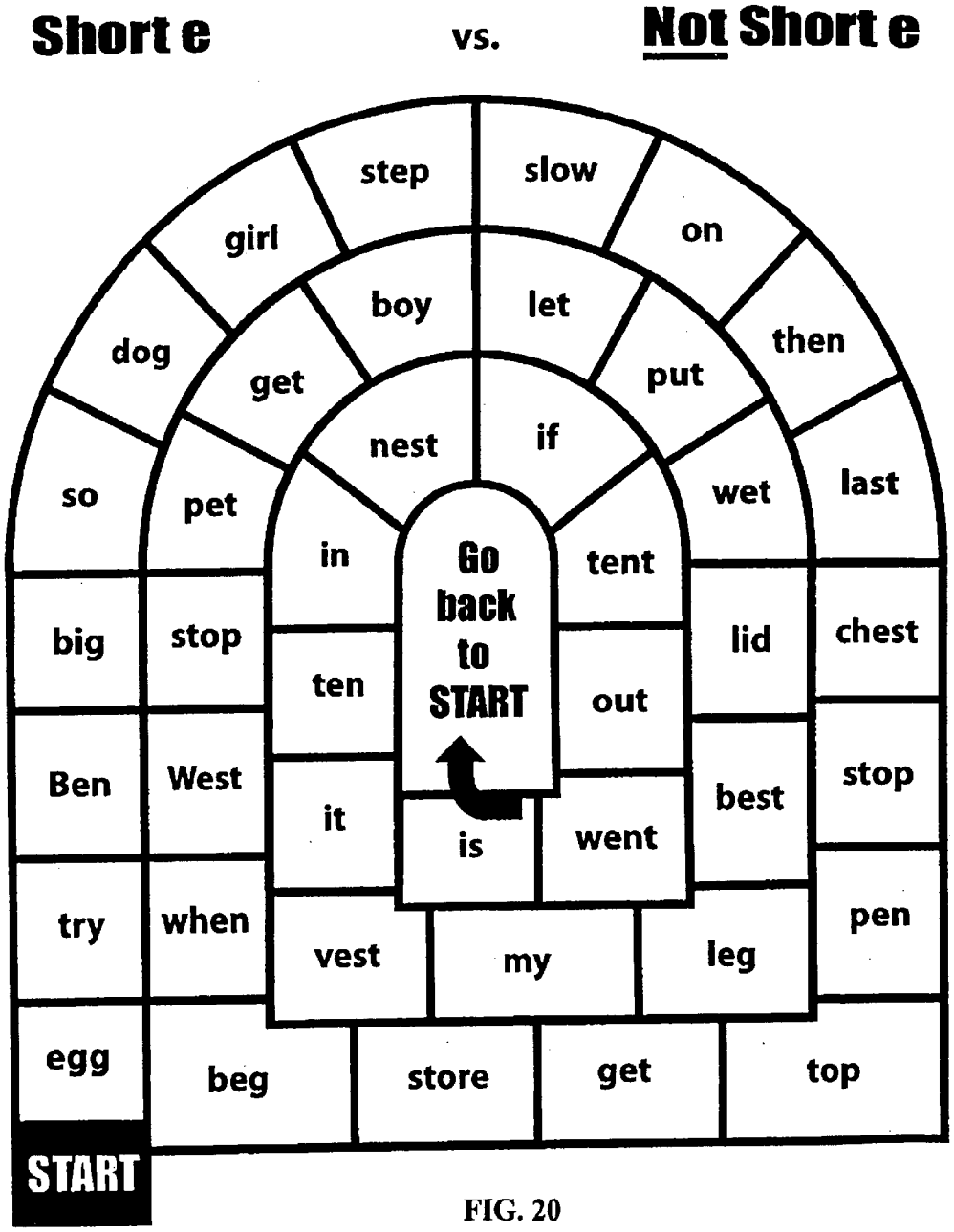
FIG. 20 is an illustrative embodiment of a concept versus concept game as disclosed herein entitled "Short e vs. Not Short e", which is an example of a forward-backward-forward game.
Figure 21:
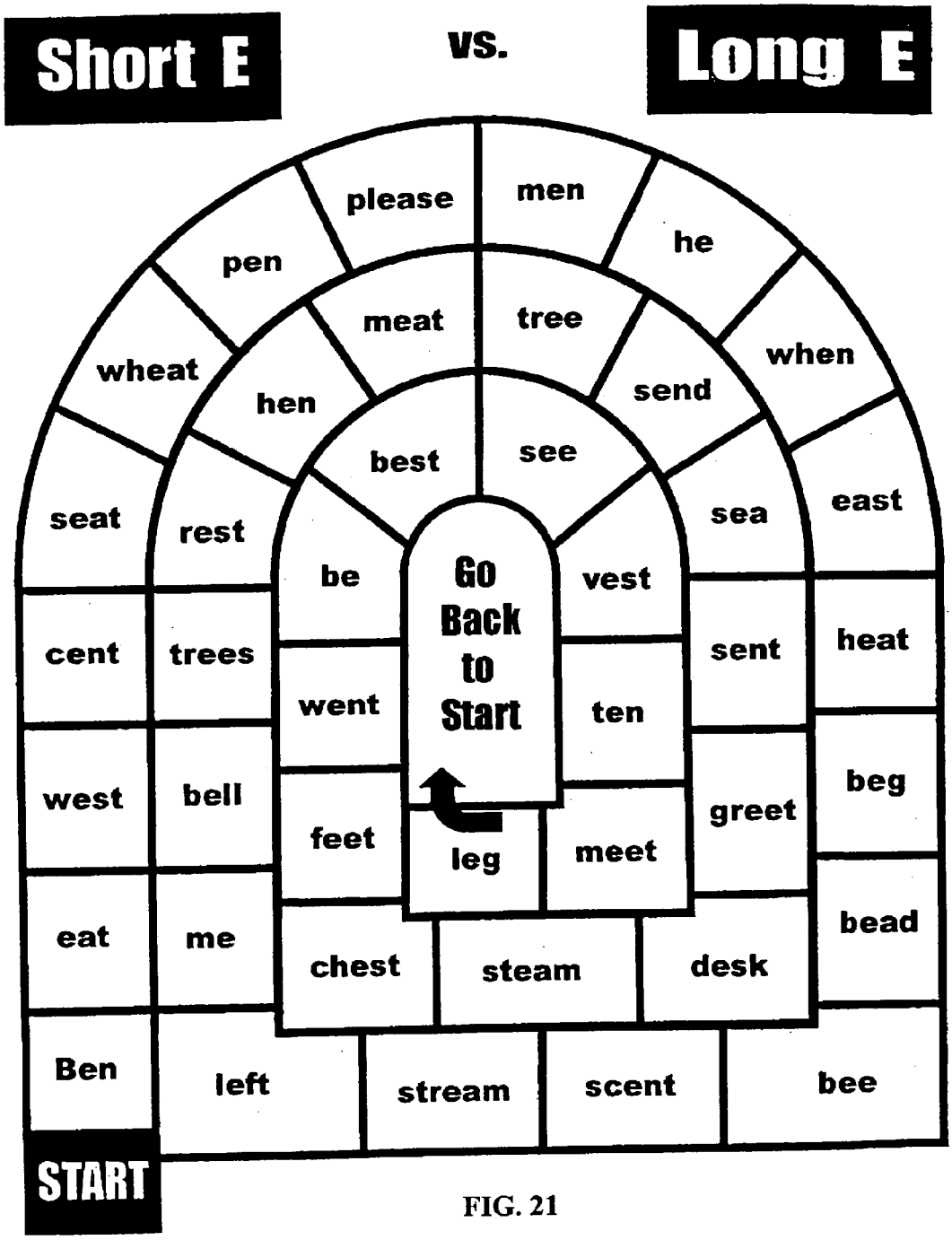
FIG. 21 is an illustrative embodiment of a concept versus concept game as disclosed herein entitled "Short E vs. Long E", which is an example of a forward-backward-forward game.
Figure 22:
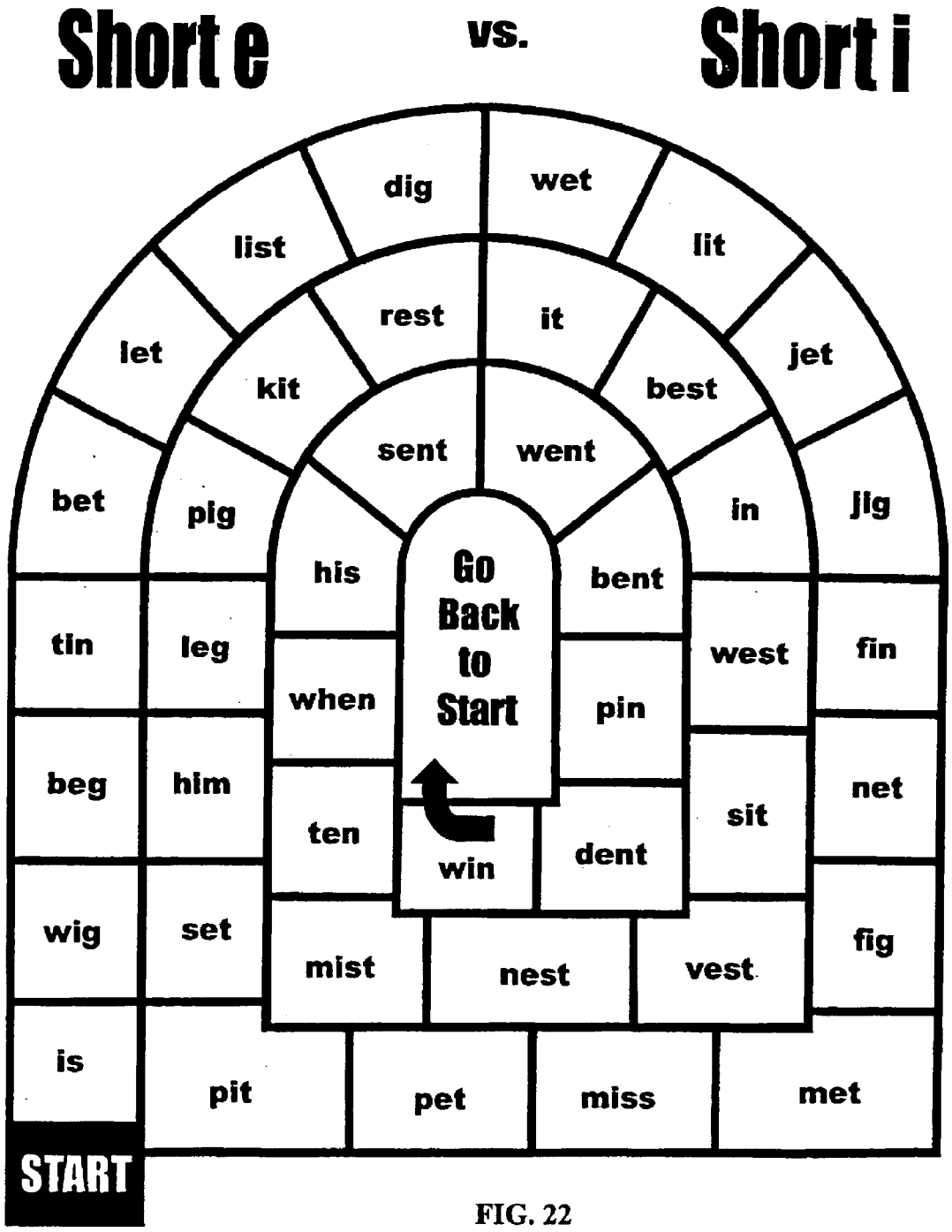
FIG. 22 is an illustrative embodiment of a concept versus concept game as disclosed herein entitled "Short e vs. Short i", which is an example of a forward-backward-forward game.
Figure 23:
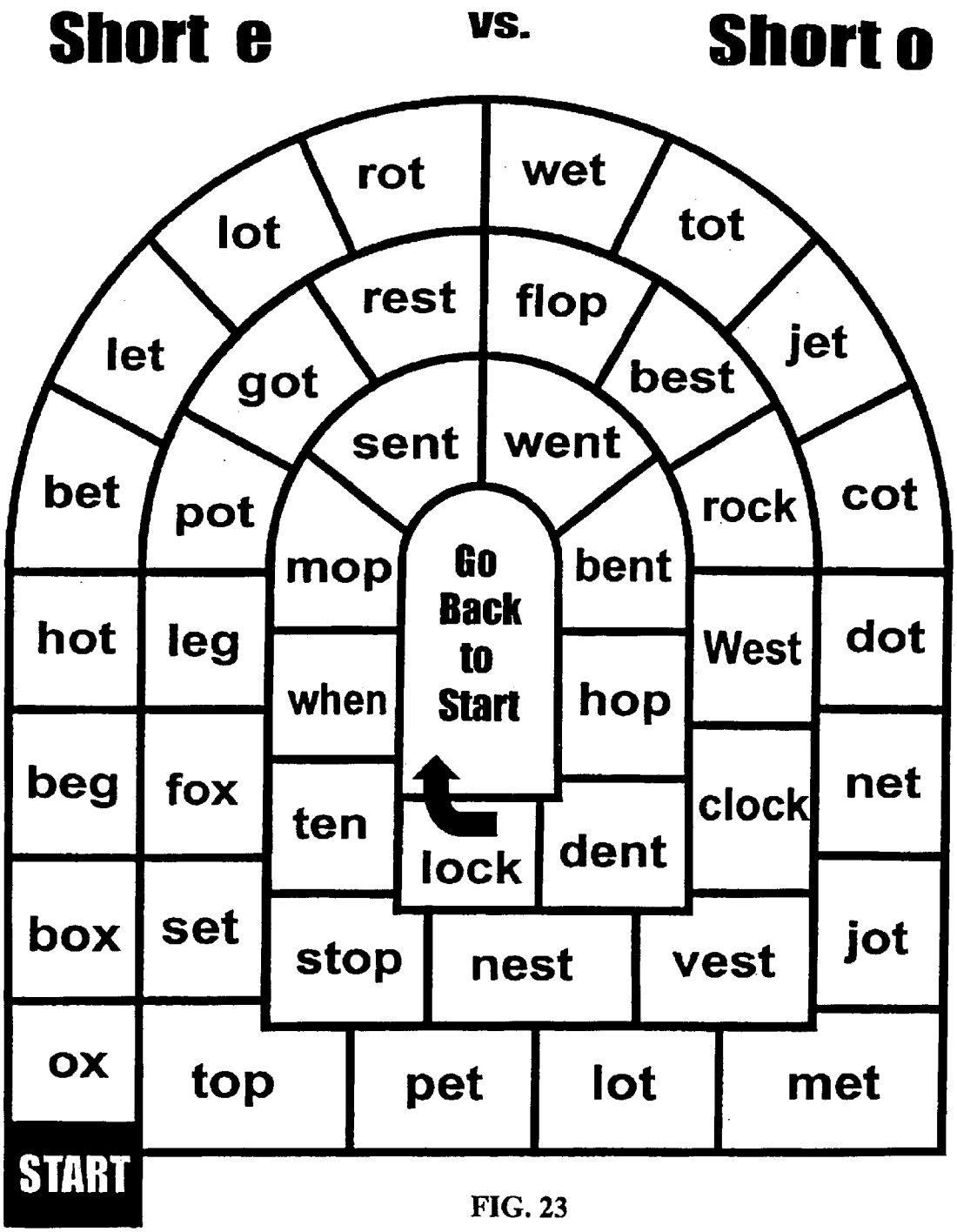
FIG. 23 is an illustrative embodiment of a concept versus concept game as disclosed herein entitled "Short e vs. Short o", which is an example of a forward-backward-forward game.
Figure 24:
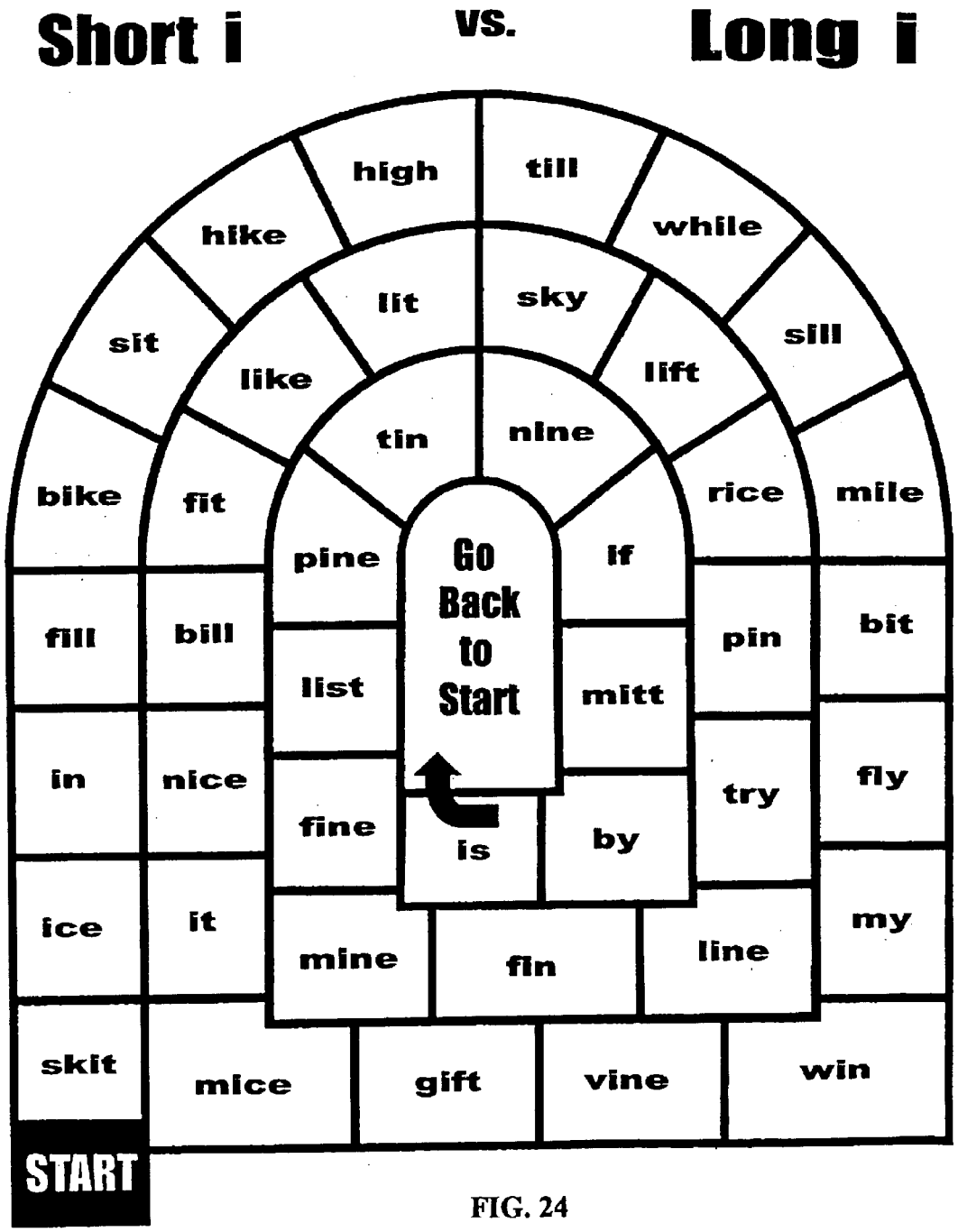
FIG. 24 is an illustrative embodiment of a concept versus concept game as disclosed herein entitled "Short i vs. Long i", which is an example of a forward-backward-forward game.
Figure 25:
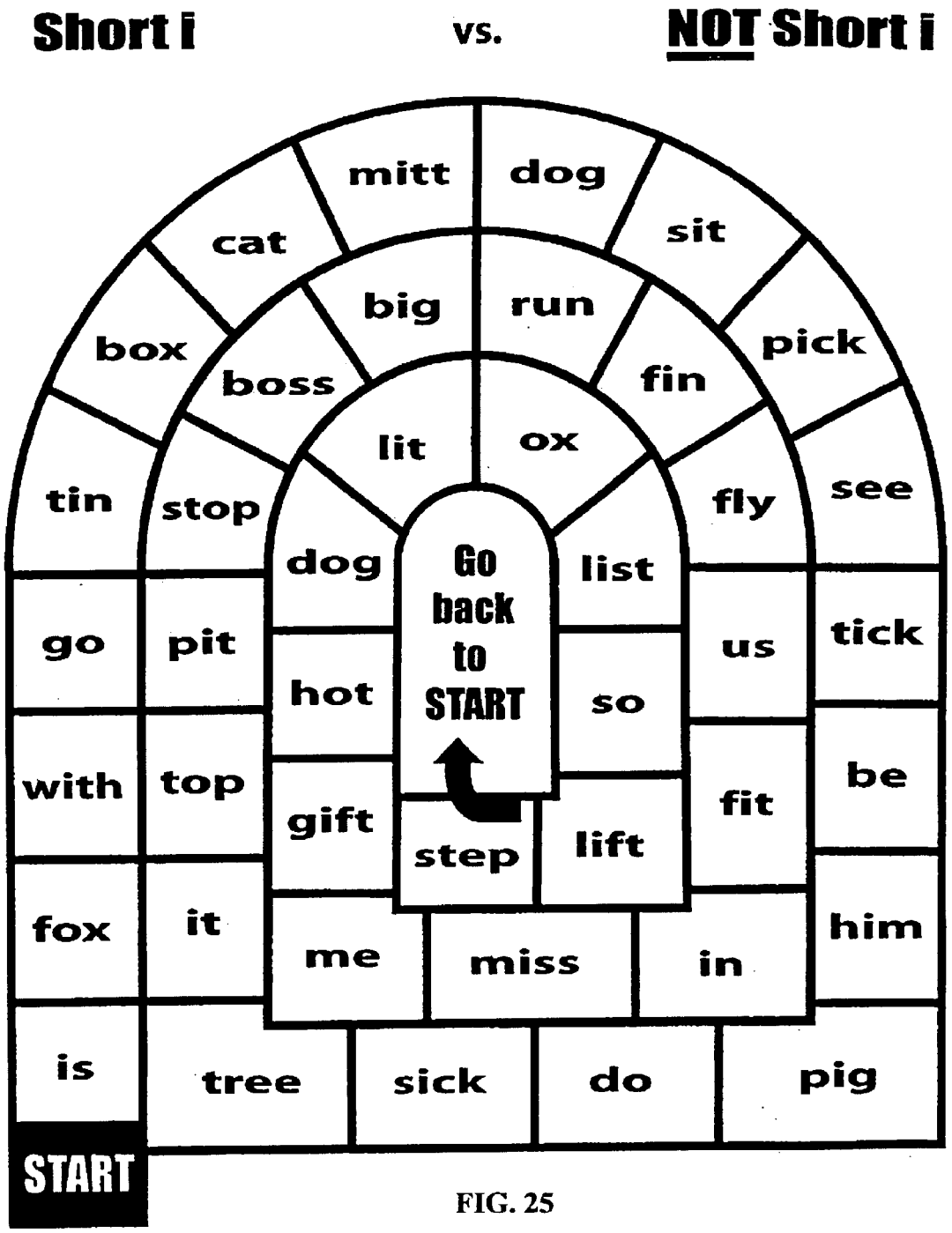
FIG. 25 is an illustrative embodiment of a concept versus concept game as disclosed herein entitled "Short i vs. Not Short i", which is an example of a forward-backward-forward game.
Figure 26:
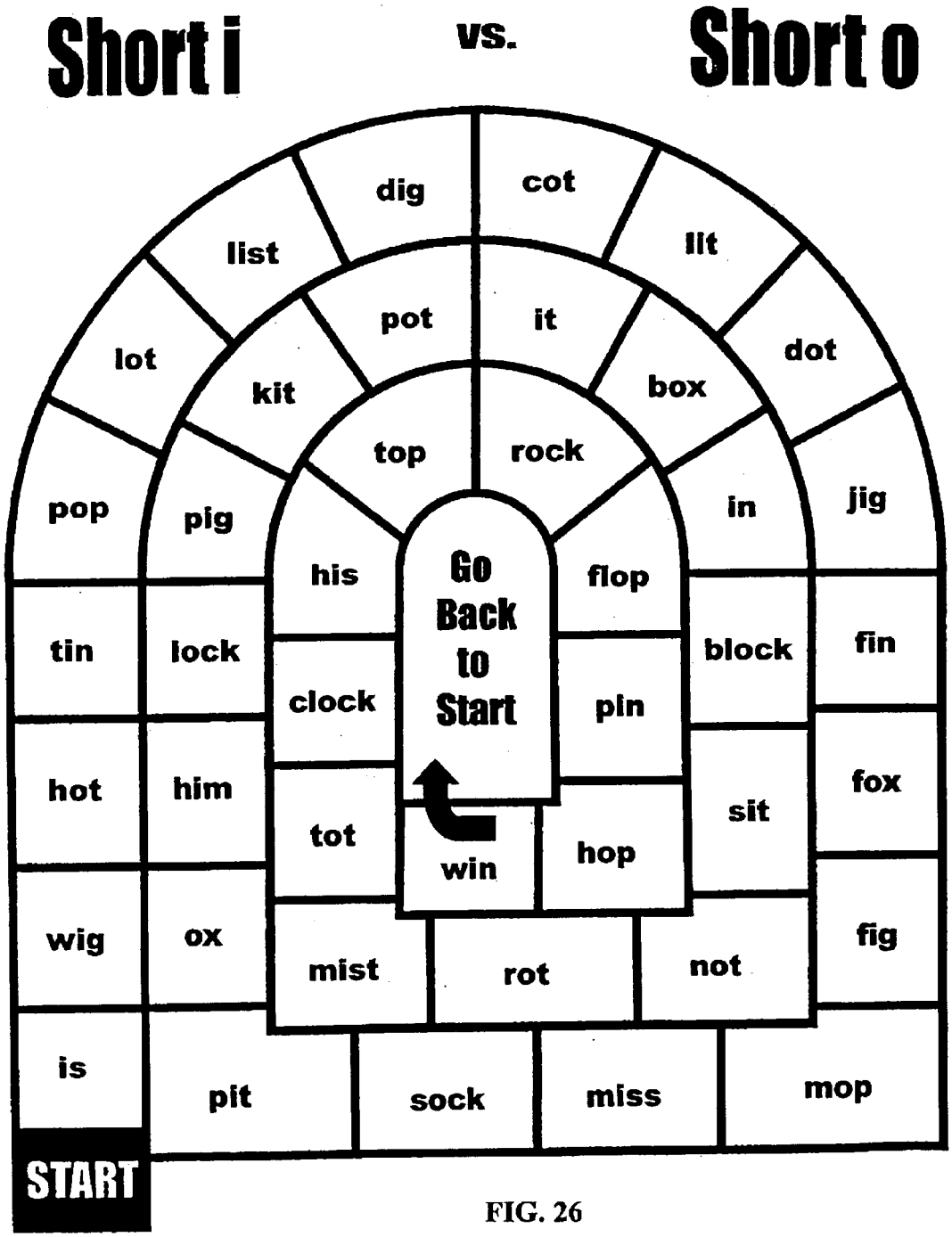
FIG. 26 is an illustrative embodiment of a concept versus concept game as disclosed herein entitled "Short i vs. Short o", which is an example of a forward-backward-forward game.
Figure 27:
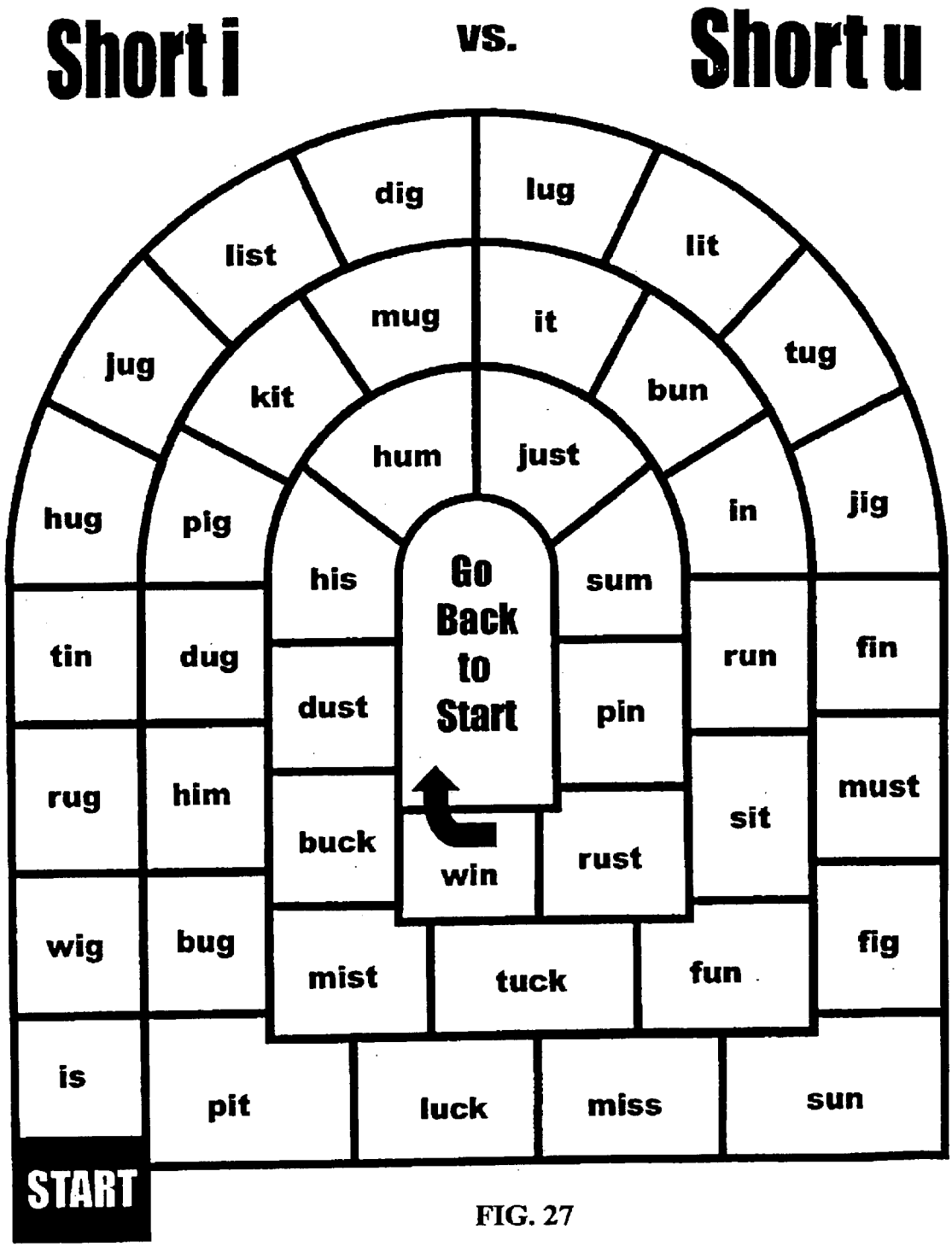
FIG. 27 is an illustrative embodiment of a concept versus concept game as disclosed herein entitled "Short i vs. Short u", which is an example of a forward-backward-forward game.
Figure 28:
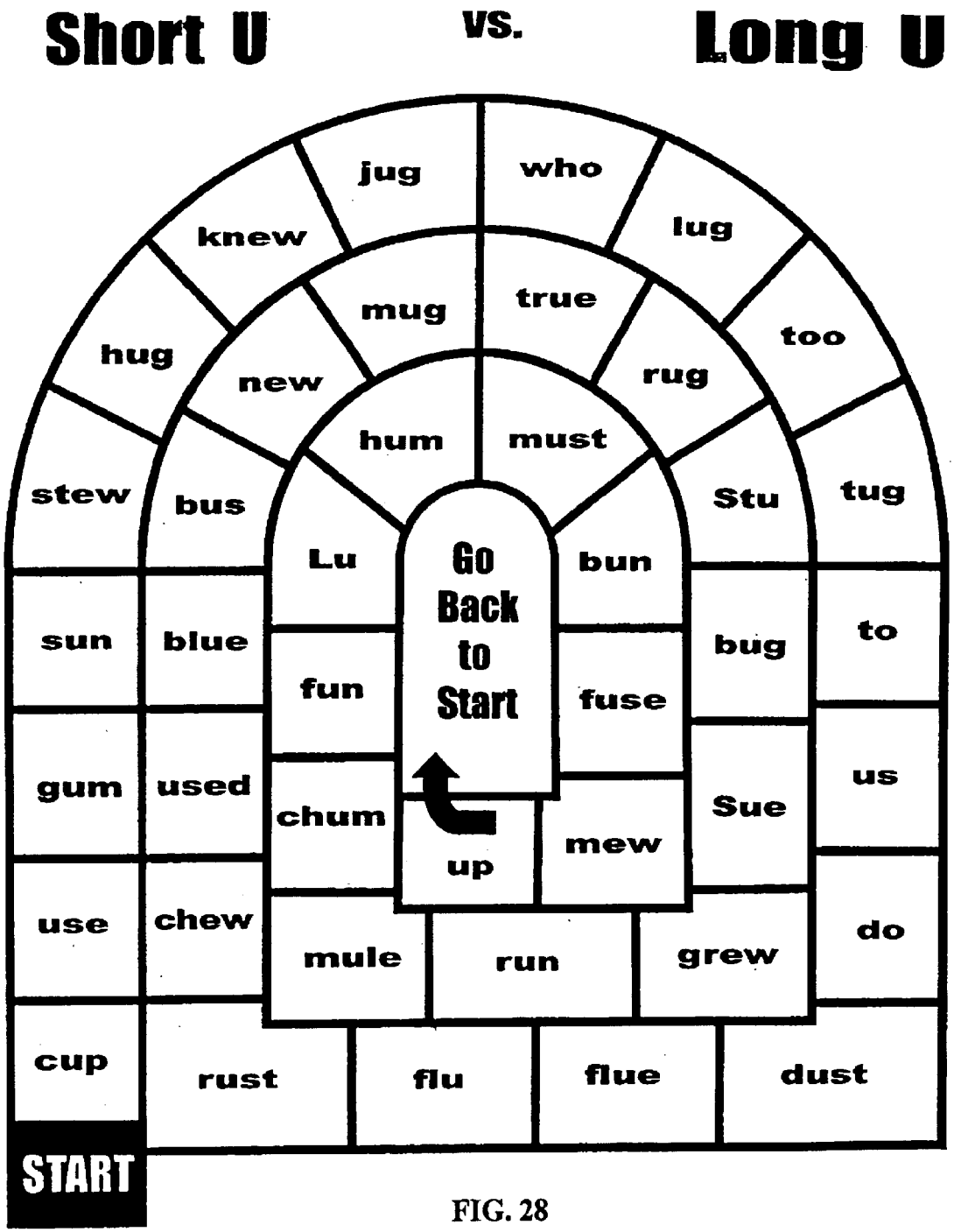
FIG. 28 is an illustrative embodiment of a concept versus concept game as disclosed herein entitled "Short U vs. Long U", which is an example of a forward-backward-forward game.
Figure 29:
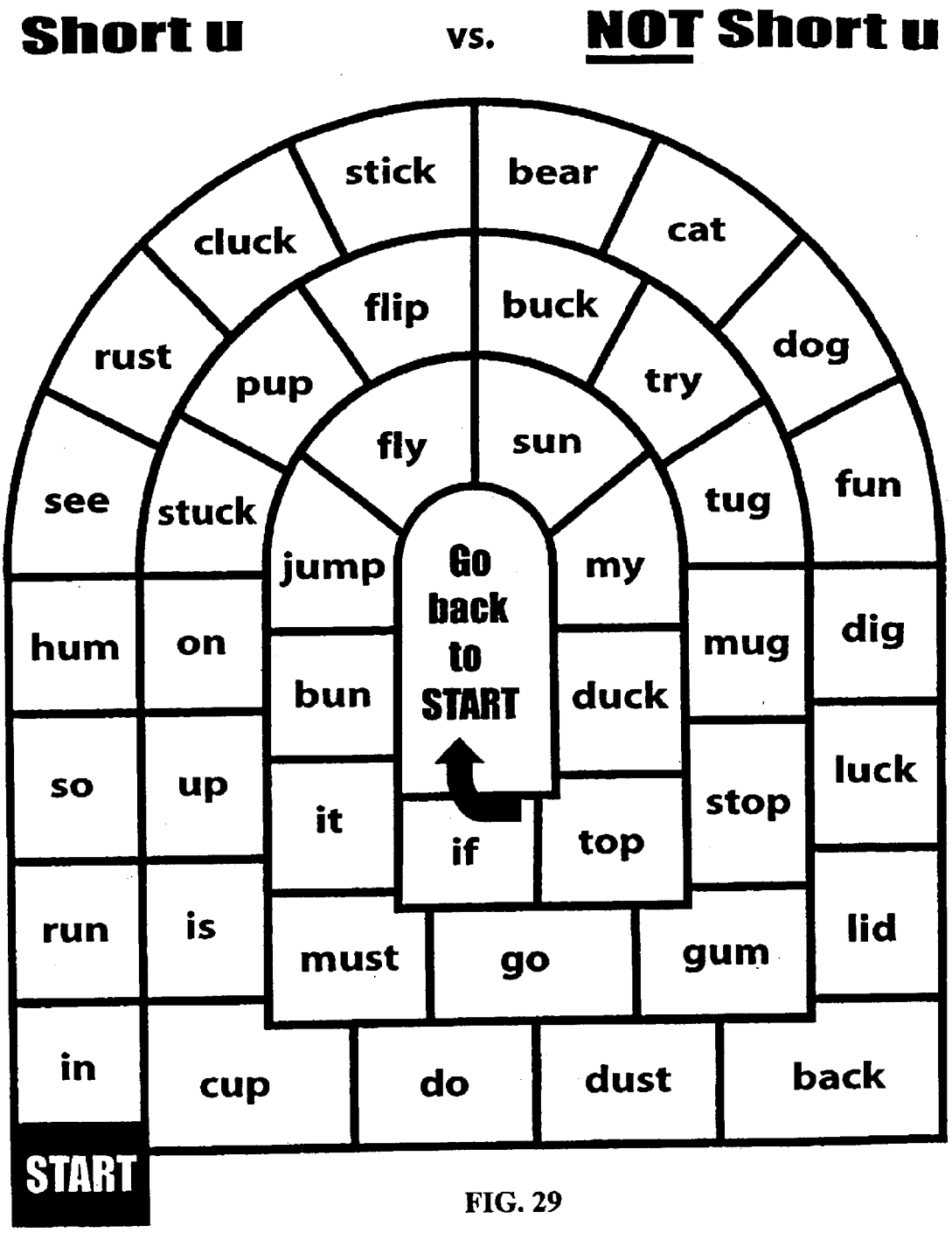
FIG. 29 is an illustrative embodiment of a concept versus concept game as disclosed herein entitled "Short u vs. NOT Short u", which is an example of a forward-backward-forward game.
Figure 30:
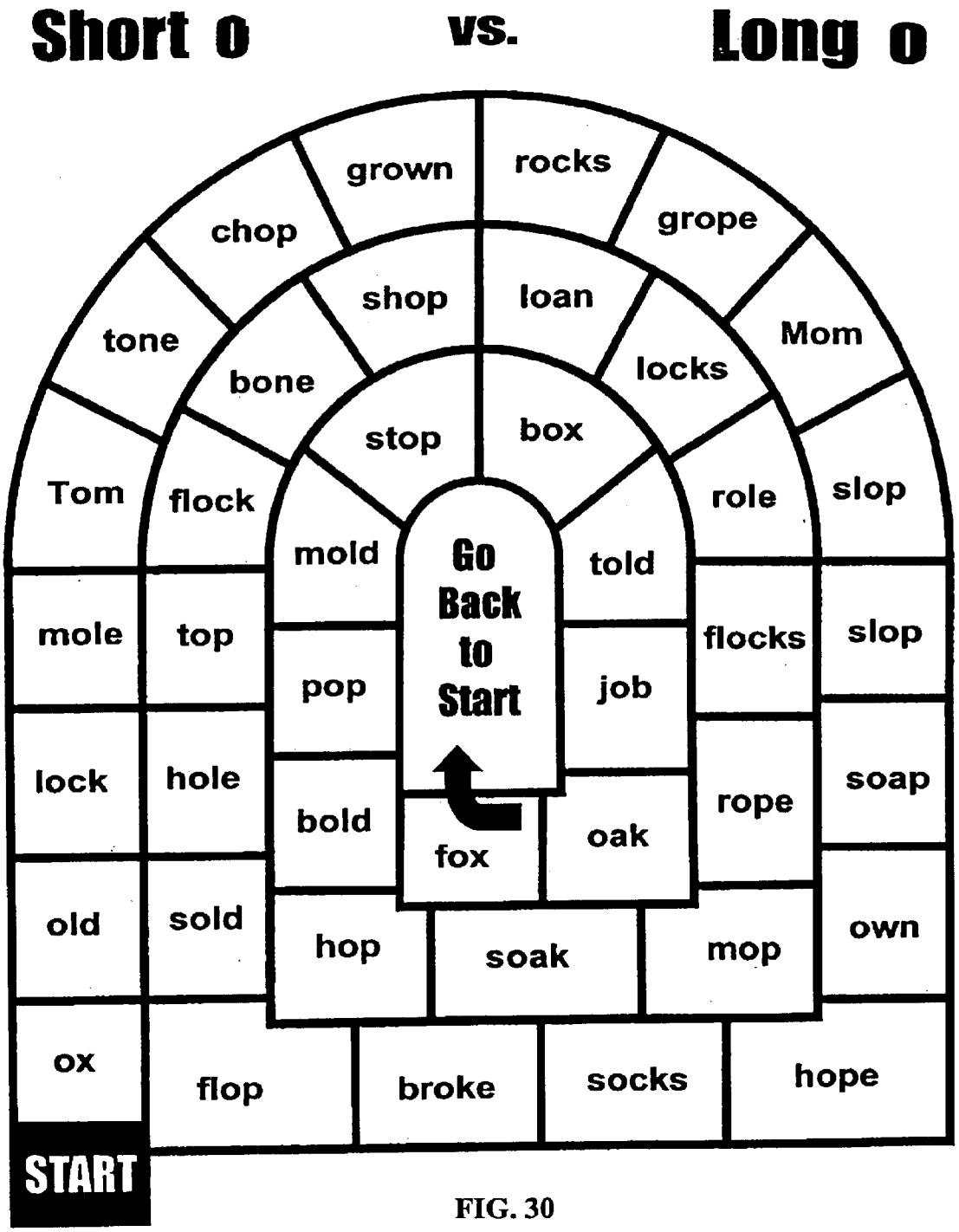
FIG. 30 is an illustrative embodiment of a concept versus concept game as disclosed herein entitled "Short o vs. Long o", which is an example of a forward-backward-forward game.
Figure 31:
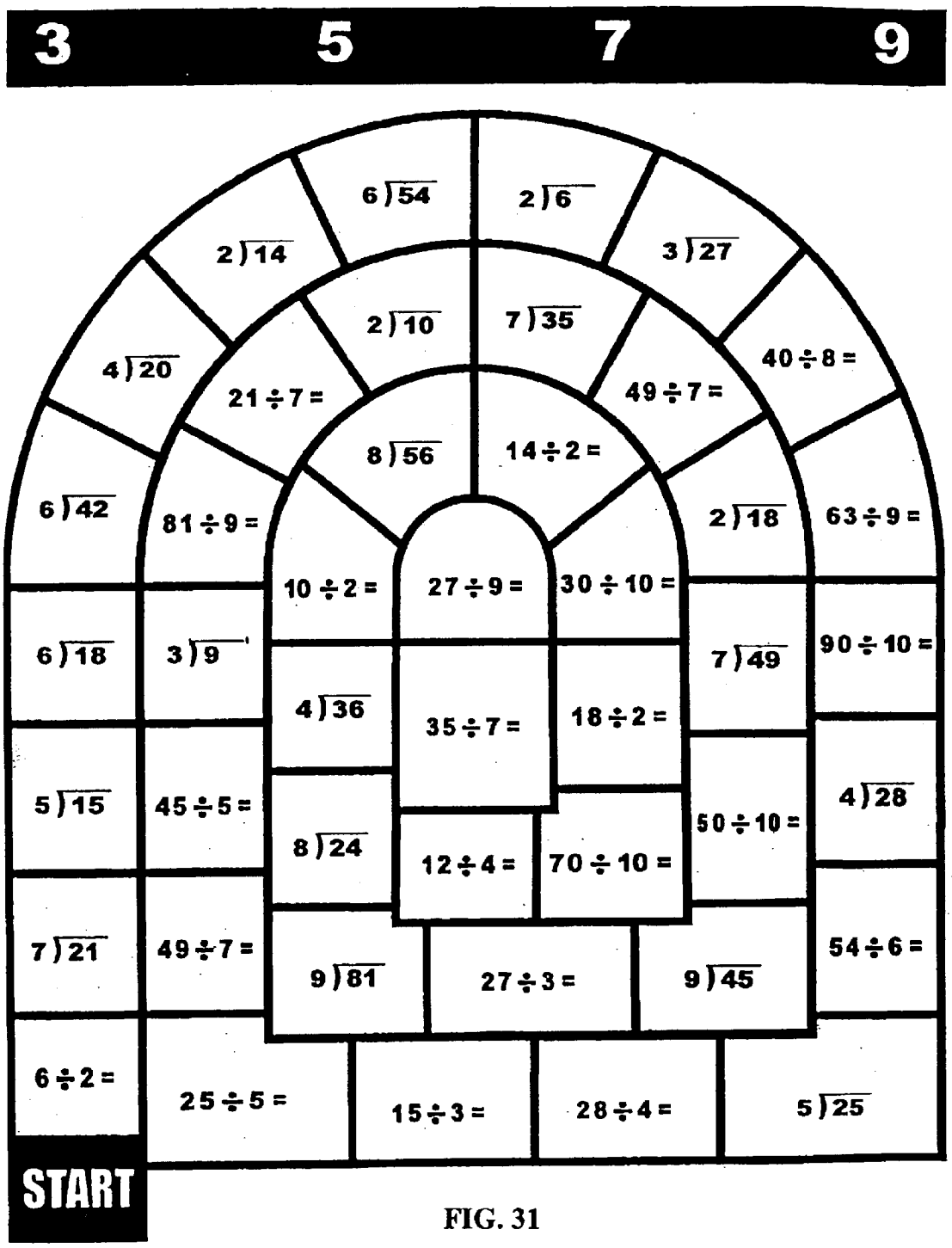
FIG. 31 is an illustrative embodiment of a concept versus concept game as disclosed herein entitled "(division) 3 5 7 9", which is an example of a forward-backward-forward game.
Figure 32:
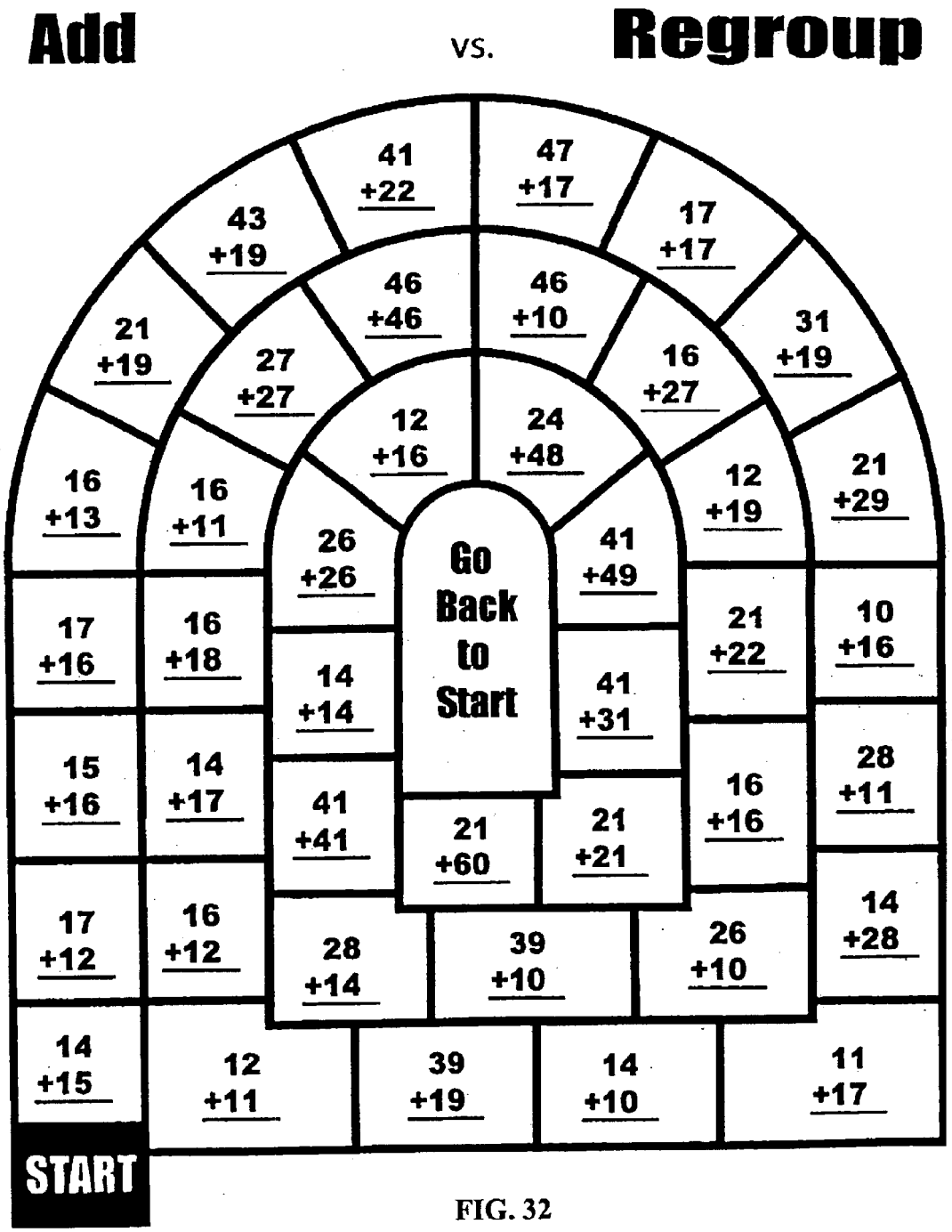
FIG. 32 is an illustrative embodiment of a concept versus concept game as disclosed herein entitled "Add vs. Regroup", which is an example of a forward-backward-forward game.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

Before the present apparatus and methods for playing a game are disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present disclosure will be limited only by the appended claims and equivalents thereof.

The publications and other reference materials referred to herein to describe the background of the disclosure, and to provide additional detail regarding its practice, are hereby incorporated by reference herein in their entireties, with the following exception: In the event that any portion of said reference materials is inconsistent with this application, this application supercedes said reference materials. The reference materials discussed herein are provided solely for their disclosure prior to the filing date of the present application. Nothing herein is to be construed as a suggestion or admission that the inventor is not entitled to antedate such disclosure by virtue of prior disclosure, or to distinguish the present disclosure from the subject matter disclosed in the reference materials.

It must be noted that, as used in this specification and the appended claims, the singular forms "a," "an," and "the" include plural referents unless the context clearly dictates otherwise.

In describing and claiming the present disclosure, the following terminology will be used in accordance with the definitions set out below. As used herein, the terms "comprising," "including," "containing," "characterized by," and grammatical equivalents thereof are inclusive or open-ended terms that do not exclude additional, unrecited elements or method steps.

Applicant has discovered that a participant's attention and ability to learn educational concepts may be greatly enhanced by utilizing the games and features of the present disclosure. Particularly, the participant's attention and ability to learn may be substantially increased by utilizing a concept versus concept game theme as disclosed herein, where one concept 102 competes directly against at least one other concept 102, and potentially against multiple concepts 102. The result is that no individual participant competes against another participant, and therefore no individual participant wins or loses. Rather, it is one of the competing concepts 102 that wins or loses. Applicant has thus conceived of multiple embodiments of an educational game, and methods for playing said games, wherein concepts 102 compete against each other and the participants of the game are asked to answer questions related to the competing concepts 102 of a given game.

For example, each game embodiment in a board game category (discussed more fully below) may race one teaching concept 102 against another teaching concept 102, such that the winner of the game is one of the respective teaching concepts 102, and not any one individual participant. It will be appreciated that the game may be played by one or more participants, but it should be noted that no participant wins or loses because the game is played between competing concepts 102, and is therefore concept driven. The premise underlying the concept versus concept theme of the present disclosure is to take away the competitive spirit from the game. Competition may have a tendency to distract certain participants or may take a participant's attention away from learning. Thus, the games and methods of playing said games of the present disclosure may promote and foster an atmosphere that may allow those who participate in the a given game to more readily learn the teaching concepts 162 of that game without the anxiety of winning or losing, which may deter and thwart the learning process.

Reference will now be made to the drawings, wherein the different embodiments of the various games depicted in said drawings have been grouped together into a category or sub-category of games for purposes of streamlining the disclosure. It will be appreciated that such grouping is not intended to limit the scope of the disclosure, but is provided for the reader's convenience. Further, only a single embodiment of each category or sub-category of games will be discussed in detail, once again for purposes of streamlining the disclosure only, since the teachings, workings and themes of each game embodiment within a given category or sub-category of games may be similar, and such teachings, workings and themes may be incorporated into the other game embodiments in the same category or sub-category. It will be appreciated that like structures will be provided with like reference numerals, where applicable.

The present disclosure is directed to a series of games, each of which may be classified into one of two major categories, namely: (i) board games (illustrated in FIGS. 1–90), and (ii) concept searching games (illustrated in FIGS. 91–97). The board games category referred to above may be further broken down into two sub-categories, namely: (a) "forward-backward-forward" board games (illustrated in FIGS. 1–85), and (b) "continuous play" board games (illustrated in FIGS. 86–90).

As illustrated in the figures, there are multiple embodiments for each category and sub-category of games disclosed herein. It will be appreciated that the basic concept of each game embodiment within a given category or sub-category of games may be similar. With respect to the board games category, the basic concept of each embodiment may be the same or essentially the same as the other embodiments of the board games. With respect to the concept searching games category, the basic concept of each embodiment may also be the same or essentially the same as the other embodiments of concept searching games.

Figure 86:
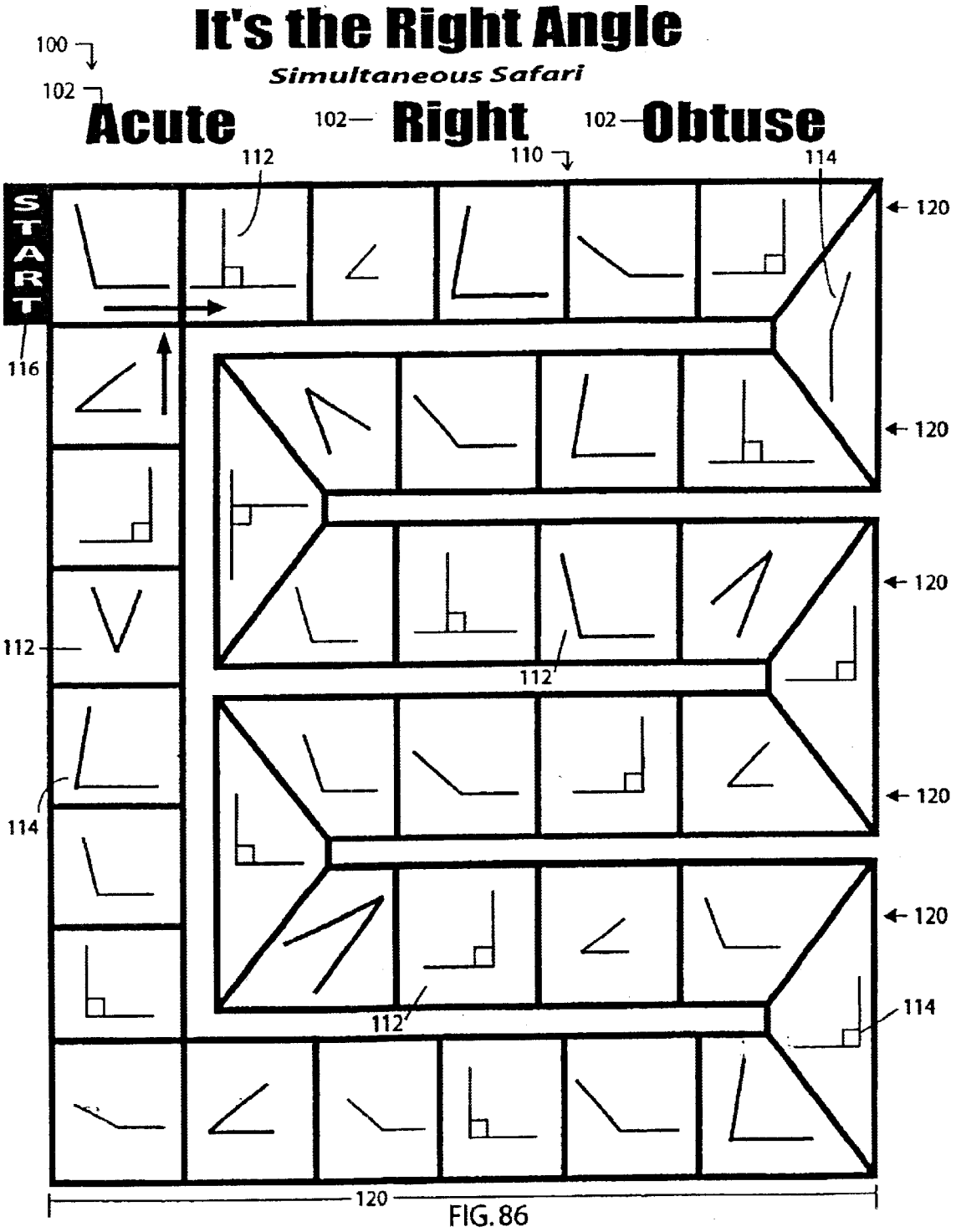
FIG. 86 is an illustrative embodiment of a concept versus concept game as disclosed herein entitled "It's the Right Angle Simultaneous Safari", which is an example of a continuous play game.
Figure 87:
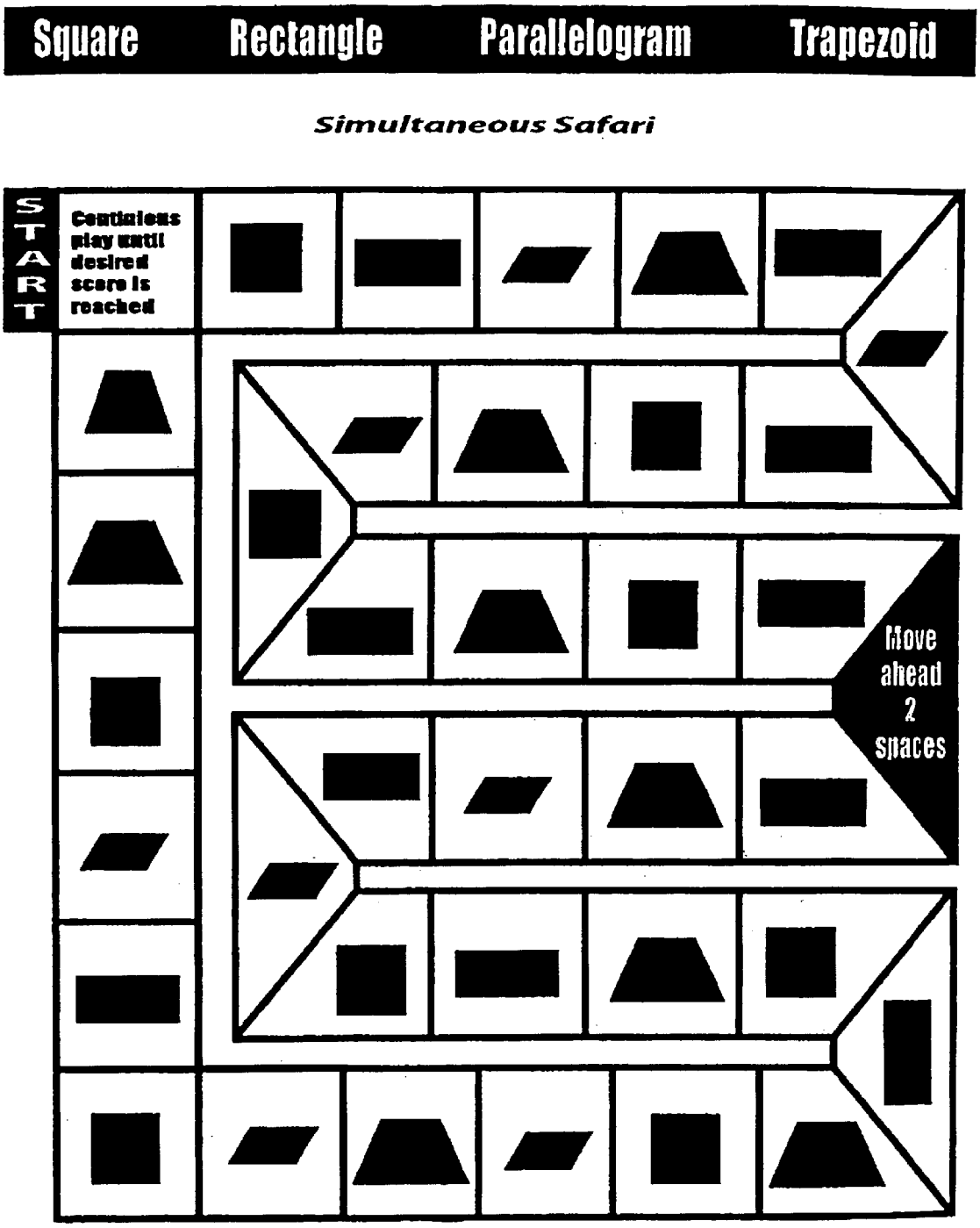
FIG. 87 is an illustrative embodiment of a concept versus concept game as disclosed herein entitled "Square Rectangle Parallelogram Trapezoid Simultaneous Safari", which is an example of a continuous play game.
Figure 88:
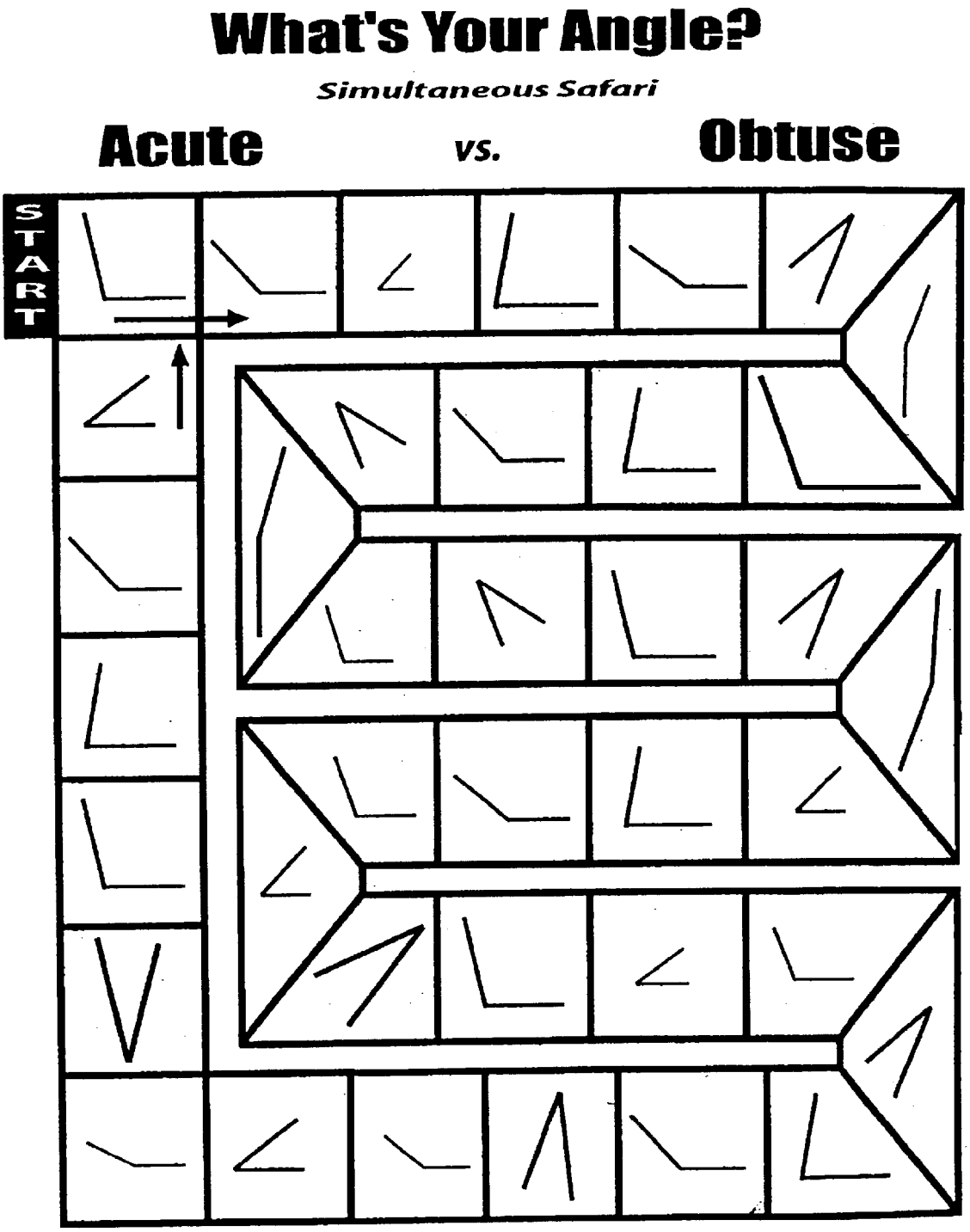
FIG. 88 is an illustrative embodiment of a concept versus concept game as disclosed herein entitled "What's Your Angle? Simultaneous Safari", which is an example of a continuous play game.
Figure 89:
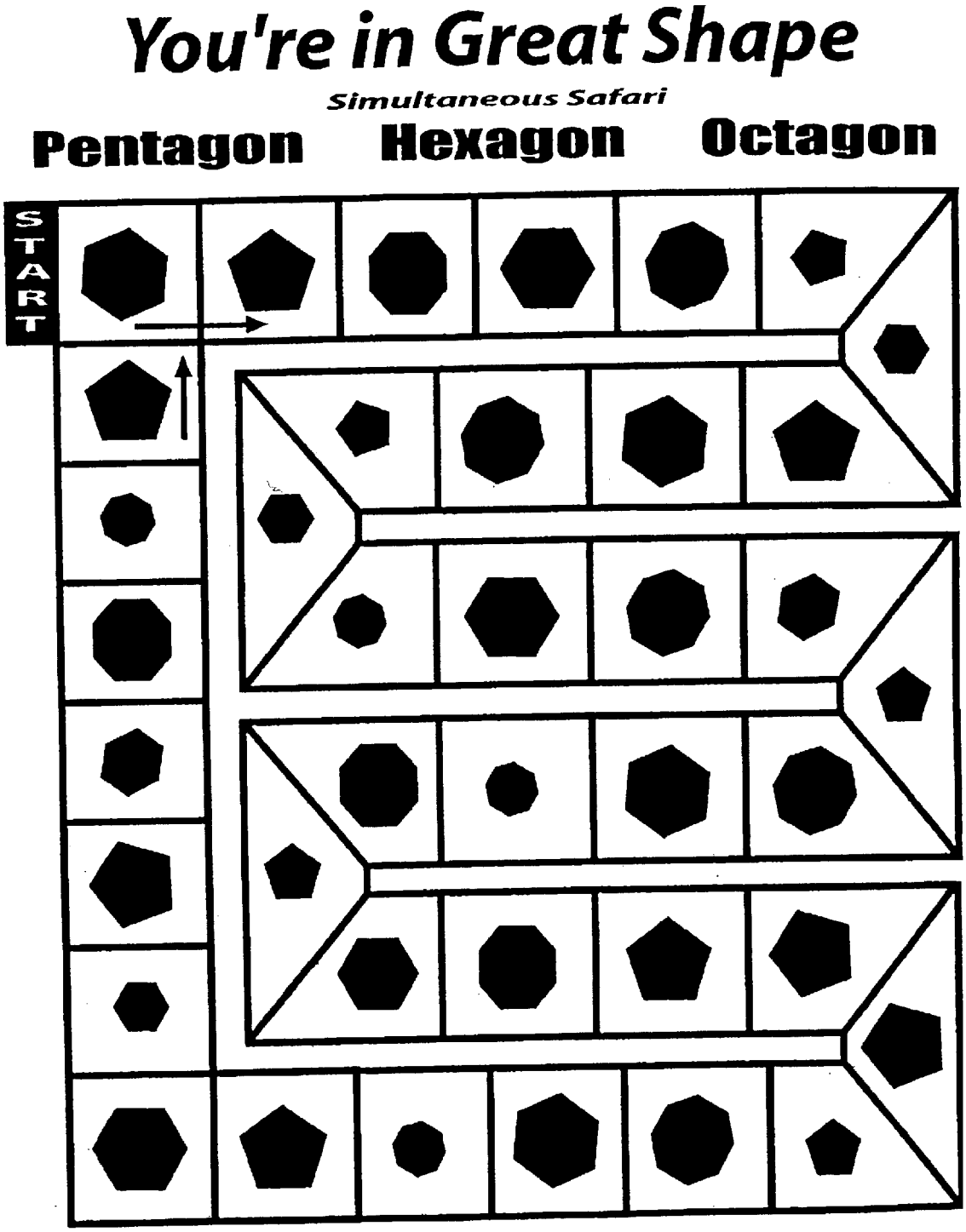
FIG. 89 is an illustrative embodiment of a concept versus concept game as disclosed herein entitled "You're in Great Shape Simultaneous Safari", which is an example of a continuous play game.

As stated above, the overarching goal of each embodiment of the games of the present disclosure is to teach participants of the game, i.e., children, the educational concepts involved in that particular embodiment. The teachings, workings and themes of the board games category referred to above may be illustrated by reference to two embodiments of the games illustrated in FIGS. 1 and 86. FIG. 1 illustrates the "forward-backward-forward" sub-category of the board games, while FIG. 86 illustrates the "continuous play" sub-category of the board games.

Board Games

Figure 90:
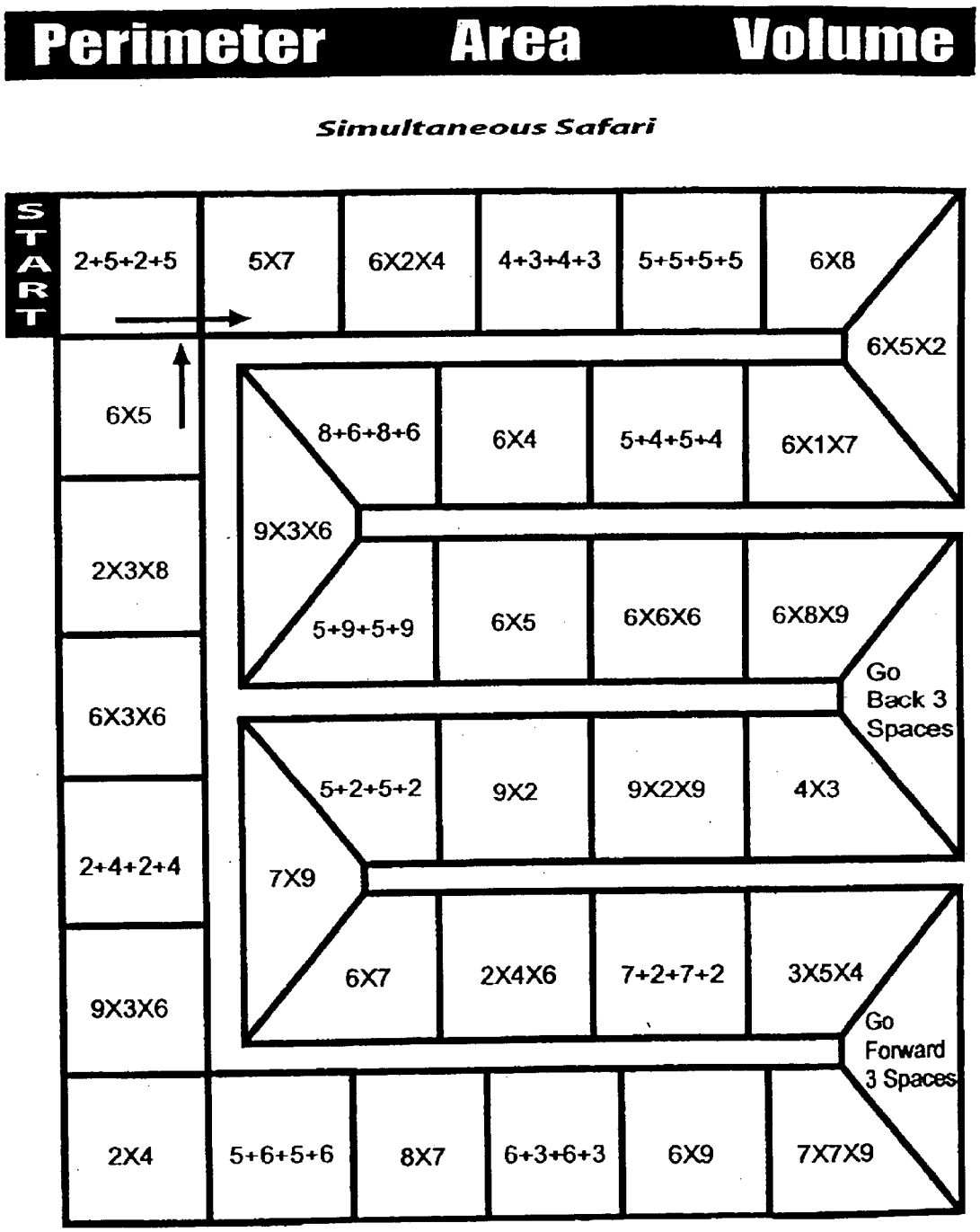
FIG. 90 is an illustrative embodiment of a concept versus concept game as disclosed herein entitled "Perimeter Area Volume Simultaneous Safari", which is an example of a continuous play game.

Each figure in FIGS. 1–90 illustrates a separate game embodiment of the board games category of the present disclosure. However, it will be appreciated that the teachings, workings and themes of each embodiment of each sub-category of the board games depicted and disclosed herein may be illustrated by reference to one game in each sub-category. Such a method of disclosing the games herein is for purposes of streamlining the disclosure, and is not meant to limit the scope of the present disclosure.

Each board game 100, whether a forward-backward-forward game or a continuous play game, may comprise a game board 110, at least one playing piece 150, and at least one chance device 160. It will be appreciated that the playing piece 150 may be used in the board games for advancing around spaces of the board 110, and may also serve as a means for advancing around spaces of the board. The playing piece 150 may be any size, shape or design. It should be noted that the playing piece 150 has been illustrated schematically in FIG. 1 as a blank box, and any playing piece 150 may be used by the present disclosure that is known, or that may become known in the future, in the art without departing from the scope of the present disclosure. Accordingly, one of ordinary skill in the art may choose from a variety of game playing pieces 150, and no one playing piece is advantageous over another.

It will likewise be appreciated that in order to move the playing piece 150 around the spaces of the board 110, a chance device 160 may be used to randomly select the number of spaces the playing piece 150 is to advance. The chance device 160 may have a representational attribute, wherein the representational attribute corresponds to a random space on the game board where the playing piece 150 may advance. It should be noted that the chance device 160 has been illustrated schematically in FIG. 1 as a blank box, and any chance device 160 may be utilized by the present disclosure without departing from the scope of the present disclosure. For example, the chance device 160 may include, but is not necessarily limited to, at least one die, a spinner or spinning wheel, a random number selection device, or random number selection by a participant, random selection of a card representing a space on the board 110, or any other mechanism for randomly selecting a space on the board 110 can be used.

It should also be noted that the game boards 110 of the present disclosure may be manufactured from various materials, including paper, cardboard, plastic, and other materials that are known, or that may become known in the future, in the art for use as game boards 110. One of ordinary skill in the art having possession of this disclosure may modify the game board 110 and may use different materials for the game board 110 without departing from the scope of the present disclosure.

Figure 85:
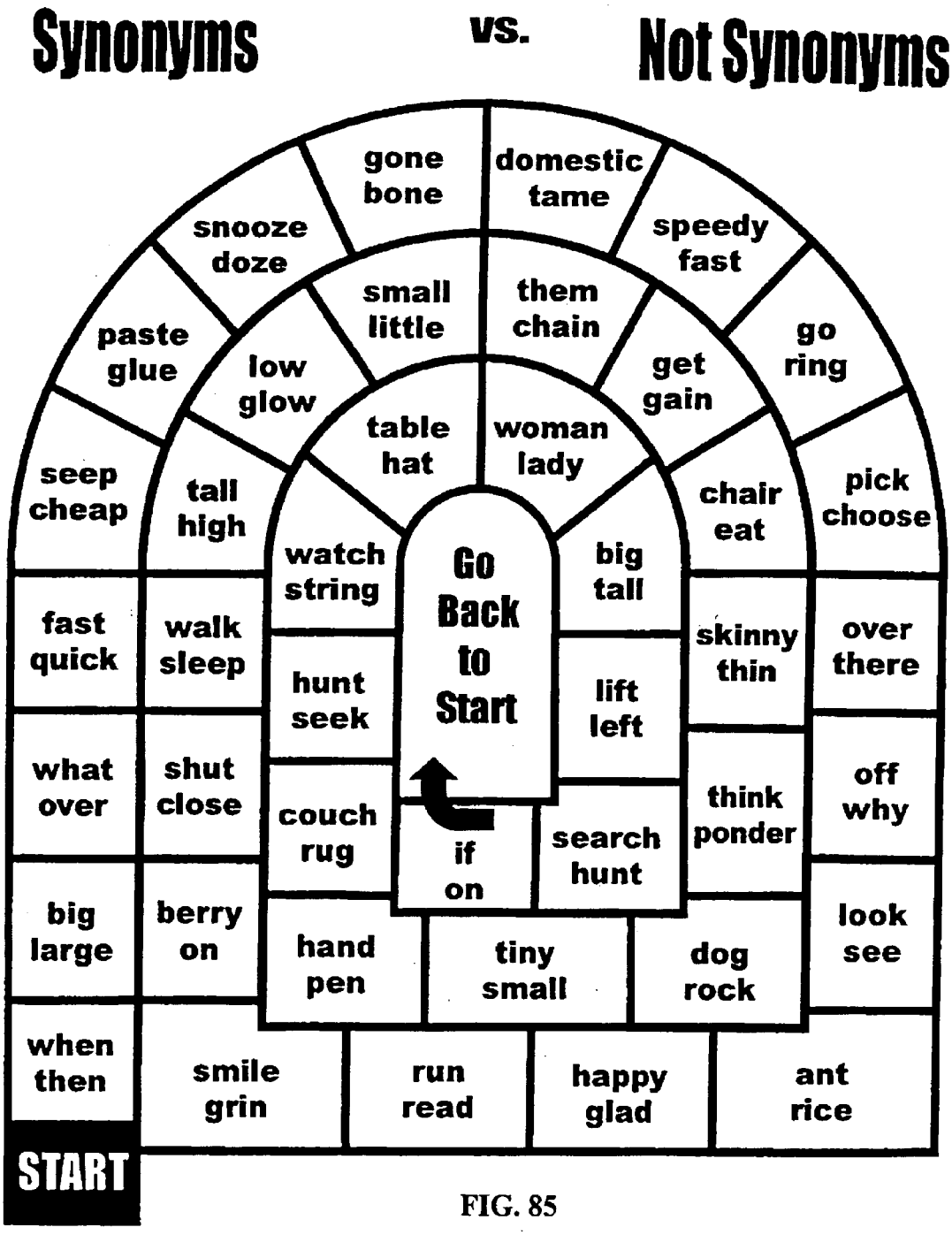
FIG. 85 is an illustrative embodiment of a concept versus concept game as disclosed herein entitled "Synonyms vs. Not Synonyms", which is an example of a forward-backward-forward game.

Referring now to FIG. 1, which is an exemplary embodiment of the many game embodiments disclosed herein of the forward-backward-forward sub-category of games of FIGS. 1–85, it will be appreciated that the game board 110 in the forward-backward-forward sub-category may comprise a plurality of spaces 112. Each of the plurality of spaces 112 may comprise at least one computation, calculation, inquiry, problem, question, query, or other type of probe (hereinafter referred to collectively as "computation") 114. It will be appreciated that the game board 110 may have various numbers of spaces 112, and various number of corresponding computations 114. It will be appreciated that the amount of computations 114 may directly correspond with the number of spaces 112 of the game board 110, however such a limitation is not required. For example, the game board 110 may comprise at least thirty-five (35) spaces 112 and at least thirty-five (35) computations 114. However, it will be appreciated that the board games 100 may contain more spaces 112 and computations 114, or the board games may contain less spaces 112 and computations 114 than thirty-five (35) without departing from the scope of the present disclosure. Further, the game board 110 may contain more spaces 112 than computations 114, or the game board 110 may contain less spaces 112 than computations 114, or the game board 110 may contain the same number of spaces 112 and computations 114 without departing from the scope of the present disclosure.

Further, it will be appreciated that the forward-backward-forward embodiments of the board games 100 may also be characterized as a spiral-in and spiral-out game. Using this approach, a playing piece 150 may be moved forward from an original, start position 116 around the plurality of spaces 112 on the game board 110 to some target point 118. Once at the target point 118, the playing piece 150 may be moved in a reverse direction returning to the start position 116, in other words the playing piece 150 may be moved back the same way it came. Such a scenario may also be referred to herein as spiral-in, i.e., toward the target point 118, and spiral-out, i.e., back the way or direction the playing piece 150 came. It will be appreciated that such an arrangement will allow for more computations 114 to be performed by the participants of the game. Therefore, more participation in a single game may be allowed, thereby increasing the potential for learning the teaching concepts 102 involved in that particular game, since the game is effectively lengthened and hence more computations 114 are performed or answered.

It will also be appreciated that a participant, teacher, or other person may designate, prior to beginning play of the game, how many times the playing piece 150 will move from the start position 116 to the target position 118 and back to the start position 116 to signify the end of the game. There may also be other ways in which the end of the game may be signified, for example, the first of the competing teaching concepts 102 to reach a certain point total may signify the end of the game. It will be appreciated that there are various other ways to signify the end of the game that may be determined by one of ordinary skill in the art without departing from the scope of the present disclosure.

Referring now to FIG. 86 as an example of the continuous play sub-category of board games 100, which may be similar to the forward-backward-forward games described above, the continuous play games (illustrated in FIGS. 86–90) may comprise a game board 110, playing piece 150 and a chance device 160. Where the two sub-categories of board games 100 differ is with respect to the game board 110 itself. As with the forward-backward-forward games, the game board 110 of the continuous play sub-category of board games 100 may include a plurality of spaces 112. However, instead of the spiral-in, spiral-out configuration of the spaces 112 on the game board 110, which may be a characteristic in the forward-backward-forward games, the spaces 112 of the continuous play games may be ordered in a series of rows 120. Each row 120 may be comprised of at least one space 112 and connected to another row 120 by at least one space 112, such that there may be multiple rows 120 of spaces 112 that zig-zag back and forth. Each row 120 may comprise a sequence of individual spaces 112, and the rows 120 may be positioned row by row in a consecutive sequence. It will be appreciated that such a configuration of a series of rows may form a non-rectangular game path. Additionally, all of the spaces 112 may be in a consecutive sequence, such that each successive space 112 may be directly connected to its preceding space 112. It will be appreciated that FIG. 86 illustrates such a continuous play game board 110. However, it should be noted that one of ordinary skill in the art may modify the continuous play game board 110 such that each space 112 is not necessarily connected to the preceding space.

In a continuous play game, the end of the game may be signaled in the same or similar manner as the forward-backward-forward games. In other words, the playing piece 150 may pass a start position 116 a predetermined number of times, which may signal the end of the game, or the first concept 102 to reach a certain point total may also signal the end of the game. It will be appreciated that there are various other ways to signal the end of the game that may be determined by one of ordinary skill in the art without departing from the scope of the present disclosure.

Playing the game. In each embodiment of the board games 100 advancement of the playing piece 150 around the board 110 may occur by utilizing the chance device 160. For example, rolling a die, spinning a wheel, or having participants randomly select numbers, i.e., 1–4 may serve to advance the playing piece 150 around the board 110. As stated above, such advancement may be accomplished in various ways known in the art. No matter what chance device 160 is utilized for advancing the playing piece 150 around the board 110, the playing piece 150 may move a number of spaces, or to a particular space 112, on the board 110 that corresponds to the number or space directed by the chance device 160.

It will be appreciated that each board 110 has a number of spaces 112, and each space 112 has a different computation 114 that must be determined or solved by the participants. After a participant rolls, spins, or otherwise determines a value of the chance device 160, the playing piece 150 is moved a corresponding number of spaces 112, or to a particular space 112, on the board 110. The particular space 112 the playing piece lands on may decide which computation 114 is to be determined or solved by the participant, or team of participants. The participant, individually, or with a team, may determine the correct answer for that particular computation 114 provided on that particular space 112. The concept 102 that the answer corresponds with is then given a point. The concept 102 with the most points at the end of the game wins. It should be noted that the concepts 102 of any educational subject matter, such as math, science, English, music or any other educational subject, may be utilized during play. Two or more concepts 102 within a particular subject matter, which may be related in some manner, may compete against each other without departing from the scope of the present disclosure.

An example of playing the forward-backward-forward games will now be described using FIG. 33. The subject of the game is math, and the competing concepts 102 are division of the numbers 7, 8 and 9. In this case, there are three concepts 102 that are competing in the game instead of just two. Accordingly, it will be appreciated that the games of the present disclosure may use two or more concepts 102 to compete against each other without departing from the scope of the present disclosure. Applicant has found that providing a game where more than two concepts 102 compete significantly increases the difficulty and learning potential involved or associated with the game, and may therefore be advantageous to challenge those who have developed or even mastered a knowledge for a particular concept.

Figure 33:
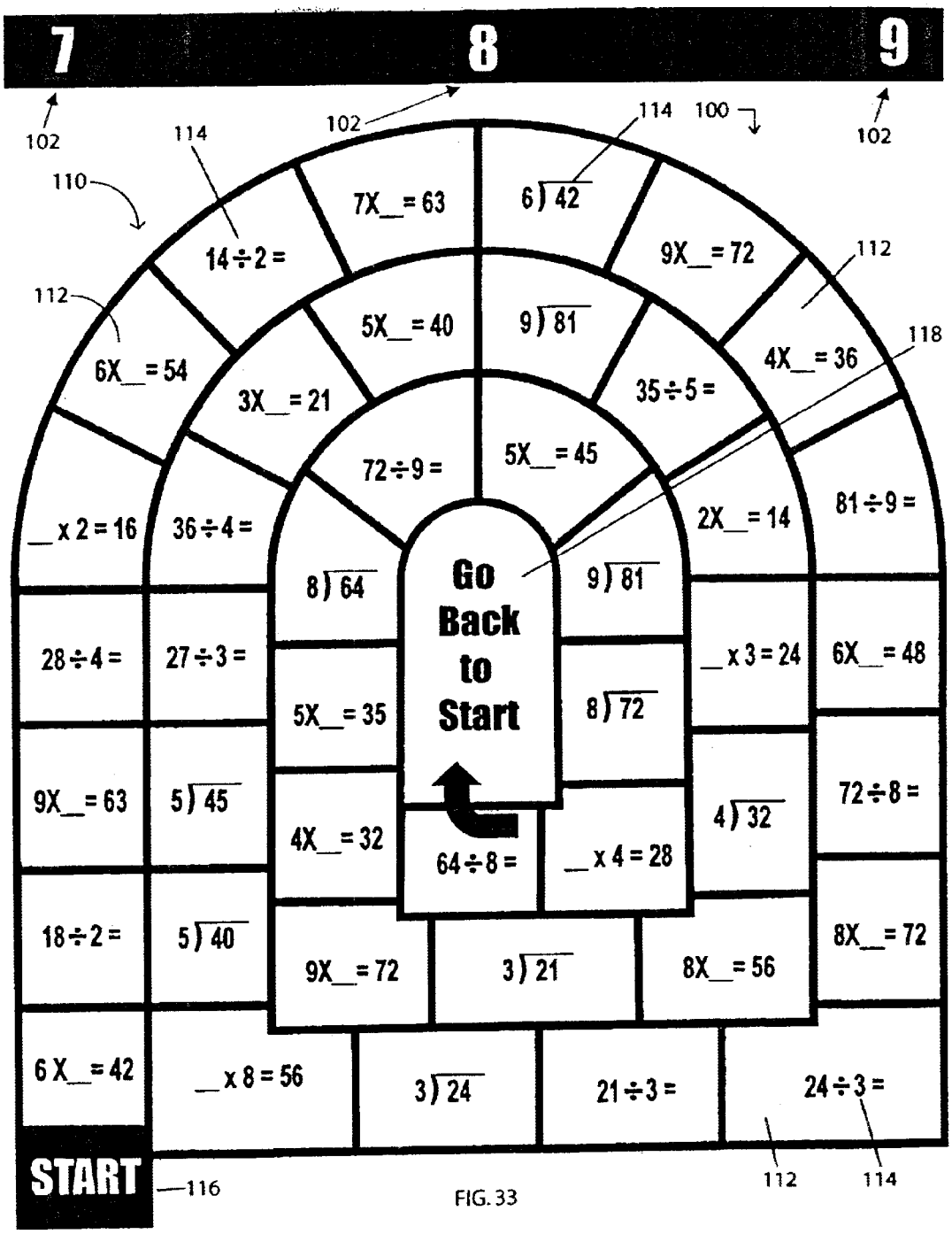
FIG. 33 is an illustrative embodiment of a concept versus concept game as disclosed herein entitled "(division)7 8 9", which is an example of a forward-backward-forward game.
Figure 34:
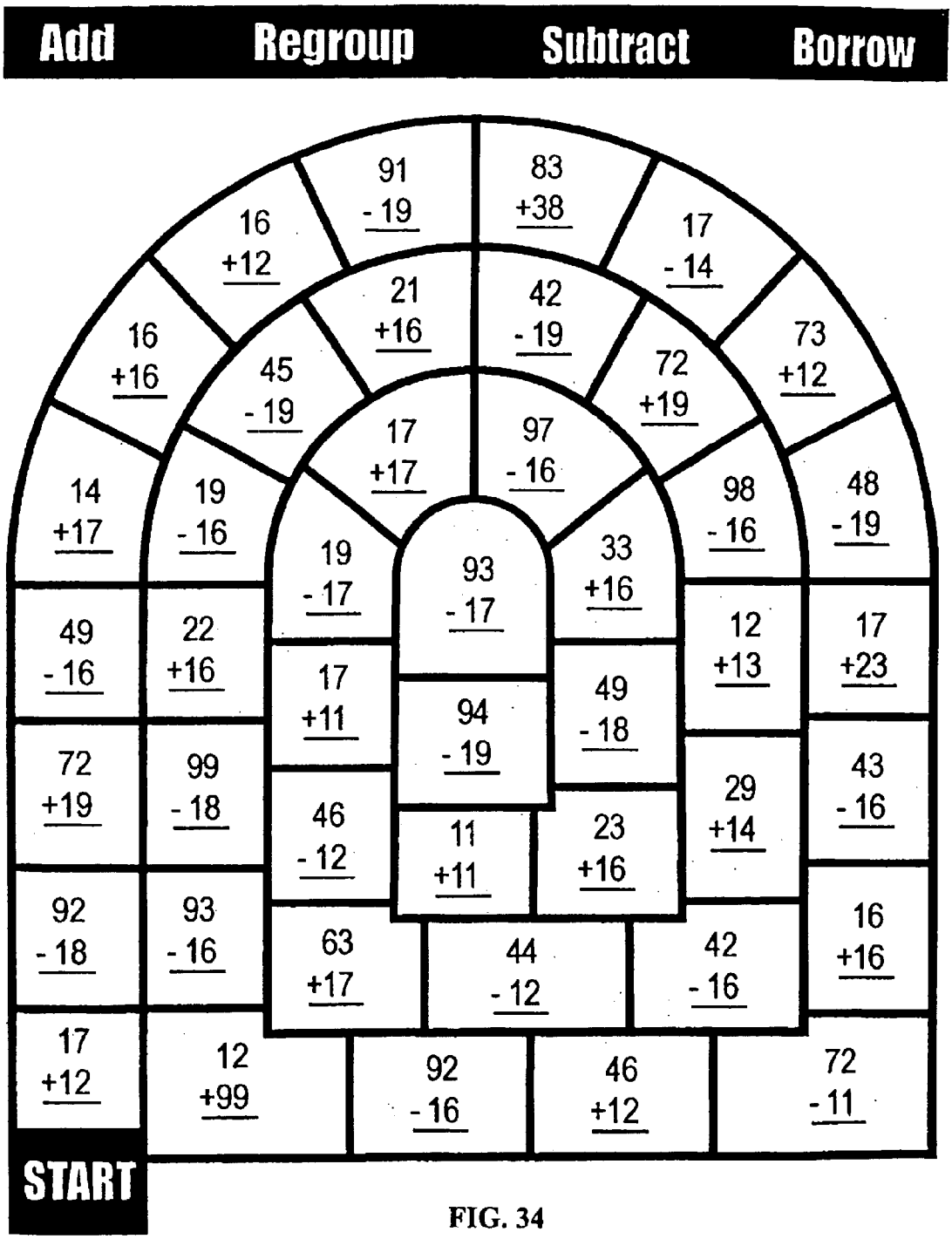
FIG. 34 is an illustrative embodiment of a concept versus concept game as disclosed herein entitled "Add Regroup Subtract Borrow", which is an example of a forward-backward-forward game.
Figure 35:
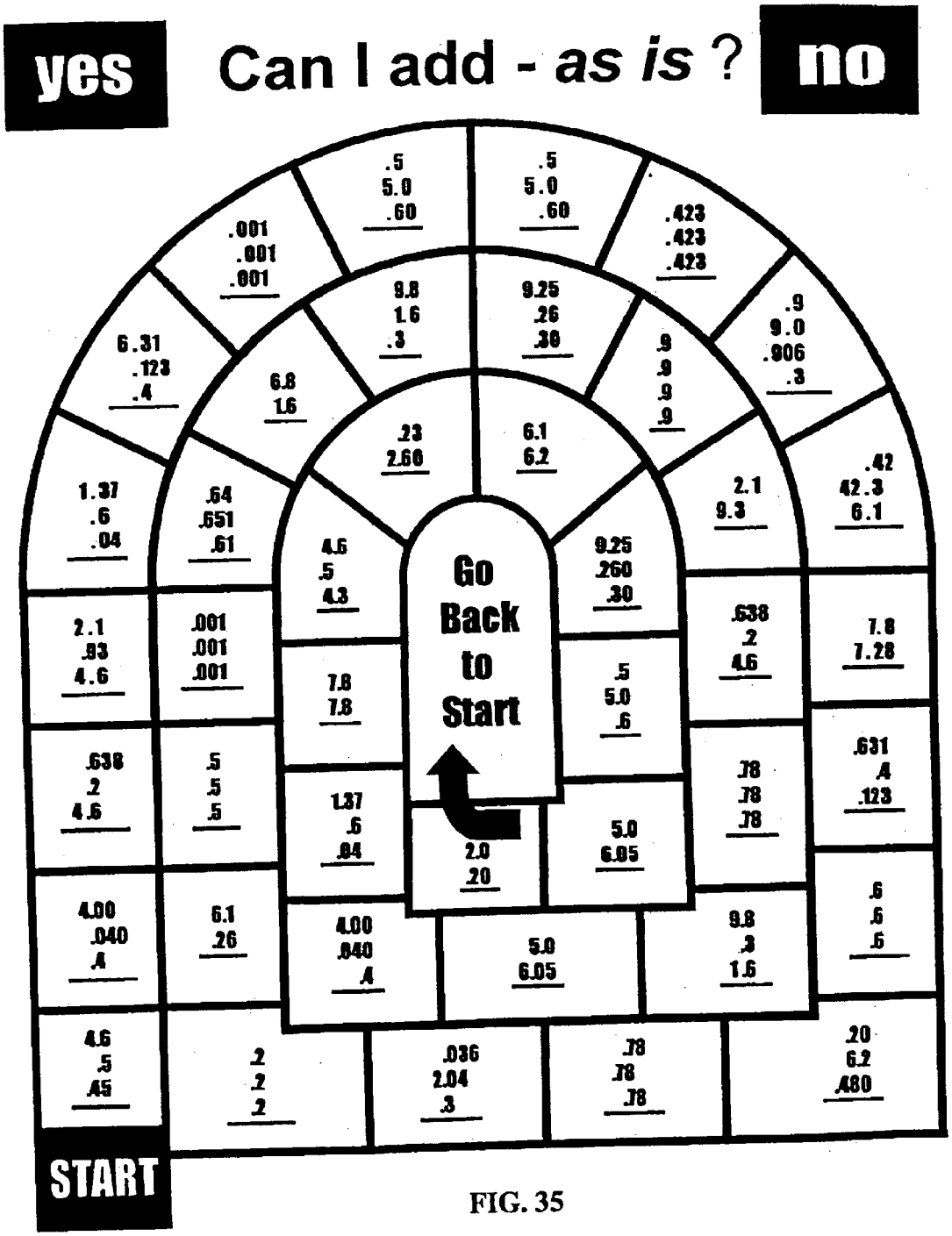
FIG. 35 is an illustrative embodiment of a concept versus concept game as disclosed herein entitled "yes Can I add—as is? no", which is an example of a forward-backward-forward game.
Figure 36:
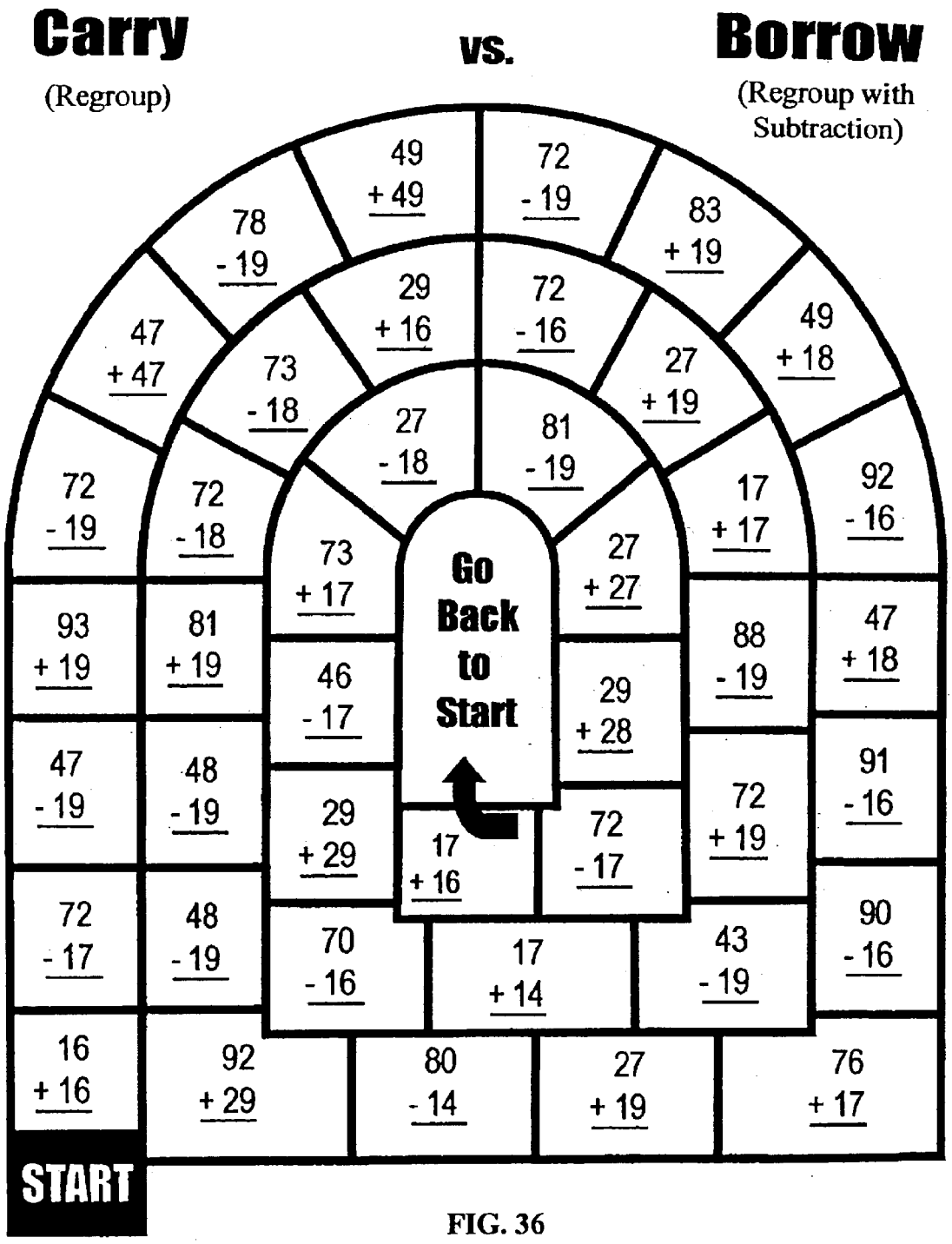
FIG. 36 is an illustrative embodiment of a concept versus concept game as disclosed herein entitled "Carry (Regroup) vs. Borrow (Regroup with Subtraction)", which is an example of a forward-backward-forward game.
Figure 37:
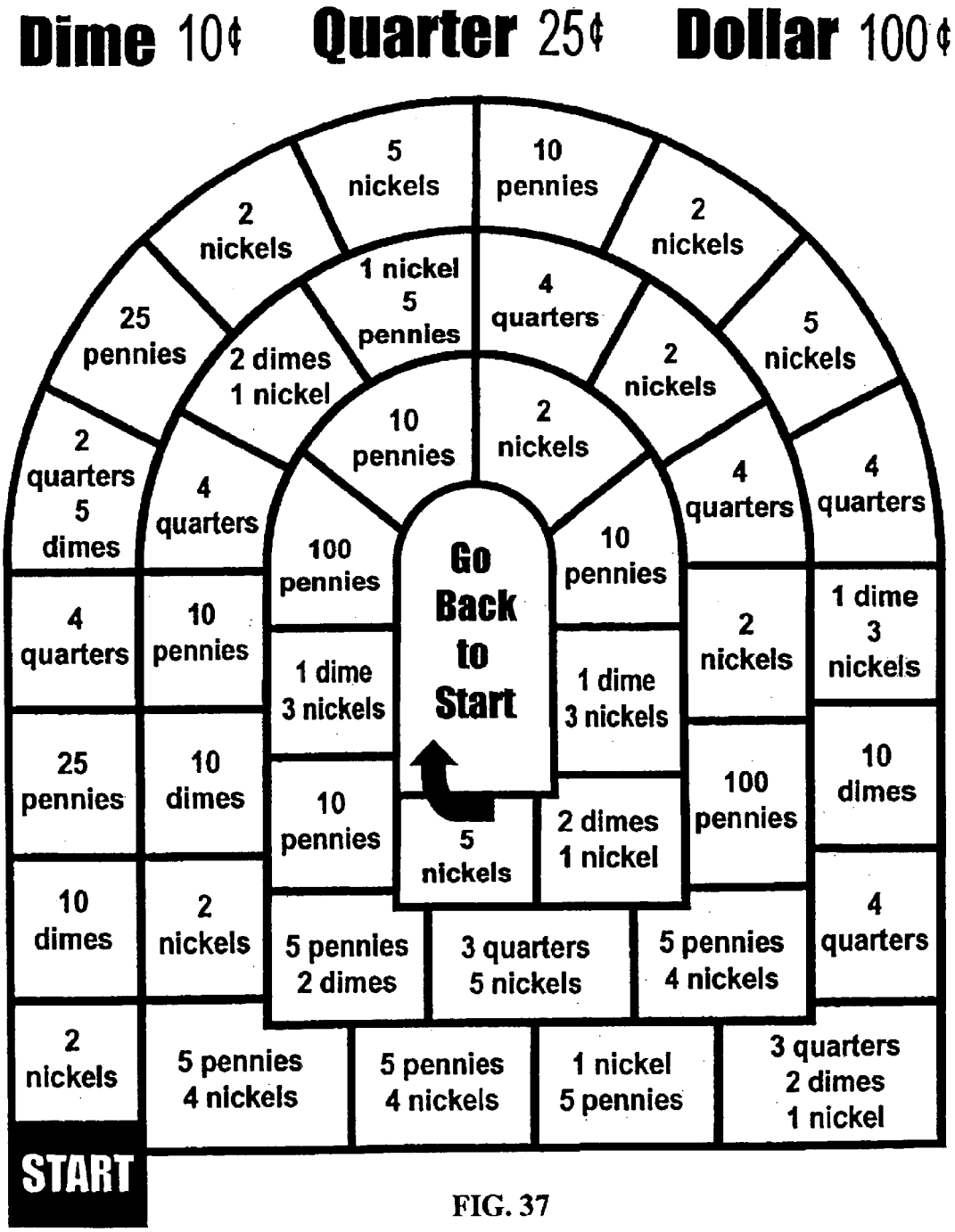
FIG. 37 is an illustrative embodiment of a concept versus concept game as disclosed herein entitled "Dime 10¢ Quarter 25¢ Dollar 100¢", which is an example of a forward-backward-forward game.
Figure 38:
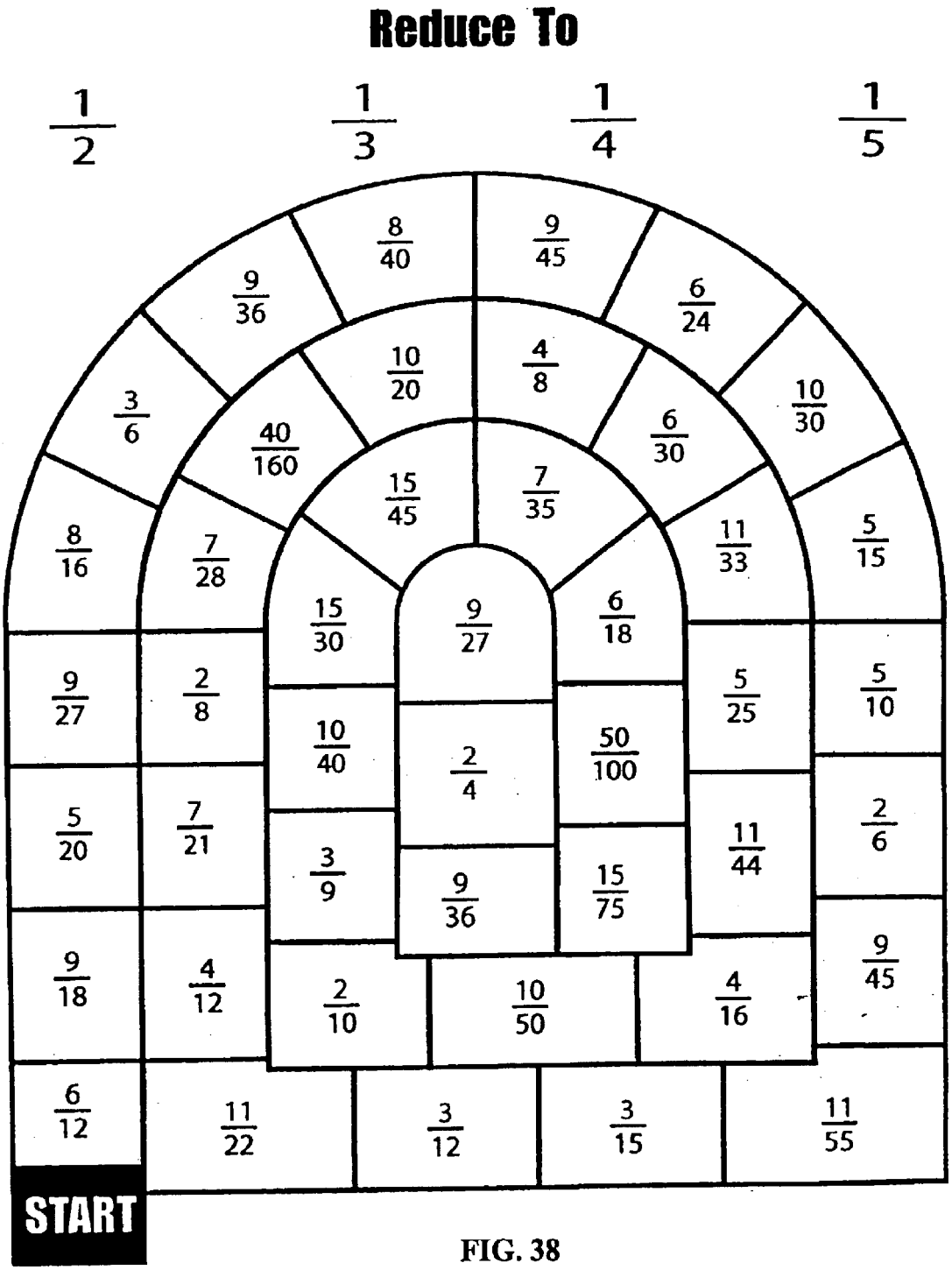
FIG. 38 is an illustrative embodiment of a concept versus concept game as disclosed herein entitled "Reduce to ½ ⅓ ¼ ⅕", which is an example of a forward-backward-forward game.
Figure 39:
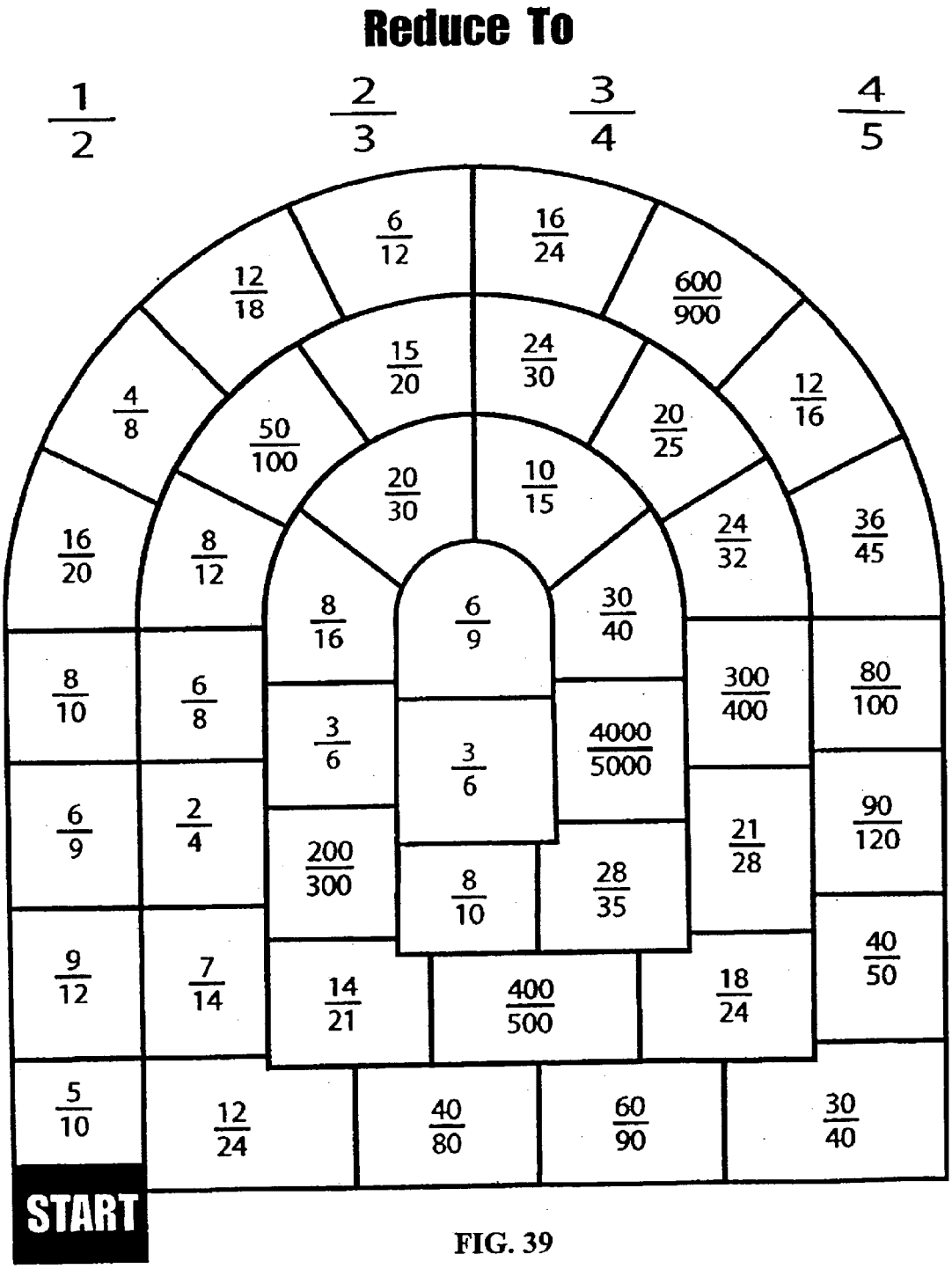
FIG. 39 is an illustrative embodiment of a concept versus concept game as disclosed herein entitled "Reduce to ½ ⅔ ¾ ⅘", which is an example of a forward-backward-forward game.
Figure 40:
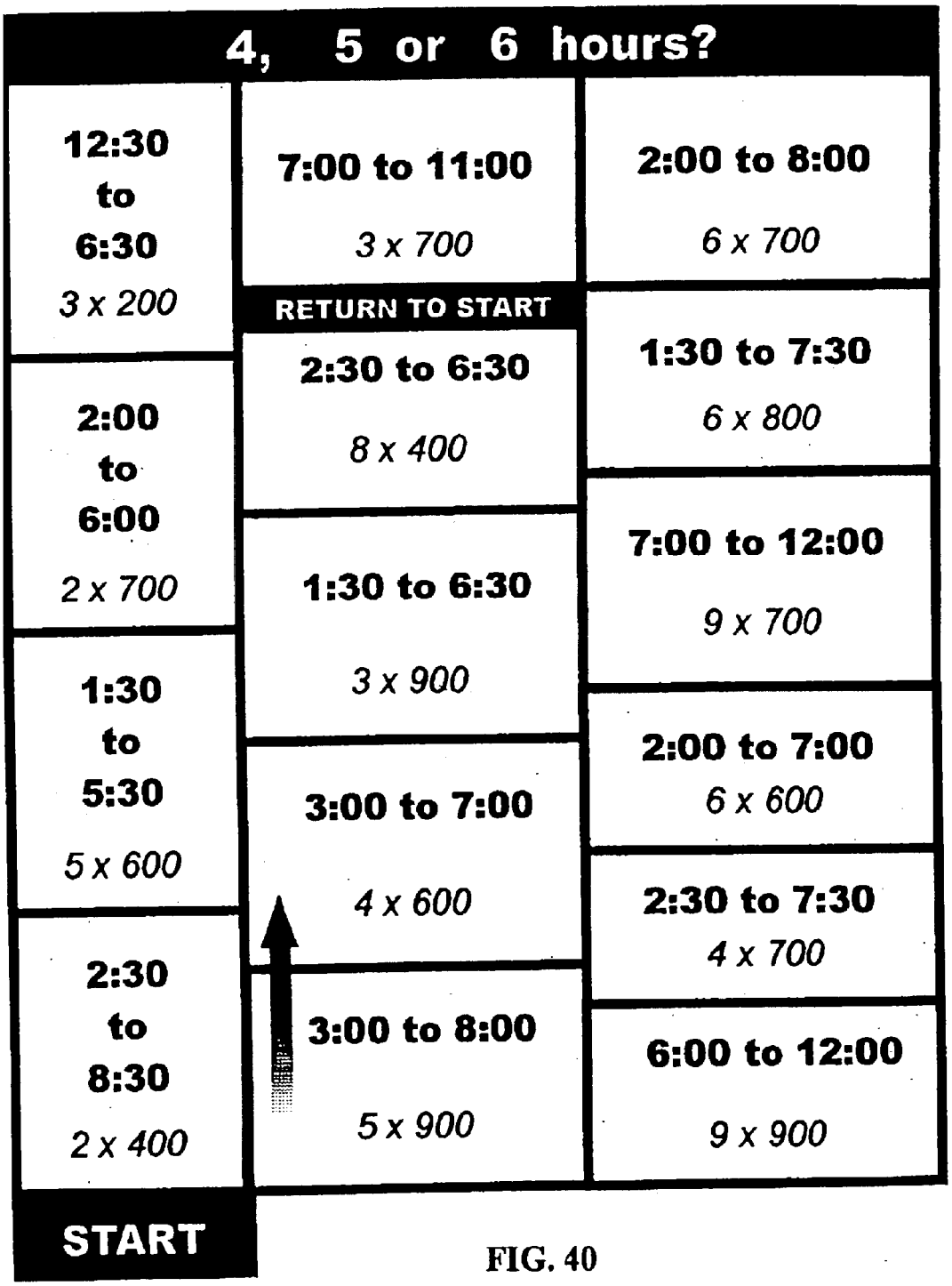
FIG. 40 is an illustrative embodiment of a concept versus concept game as disclosed herein entitled "Elapsed (Lapsed) Time", which is an example of a forward-backward-forward game.
Figure 41:
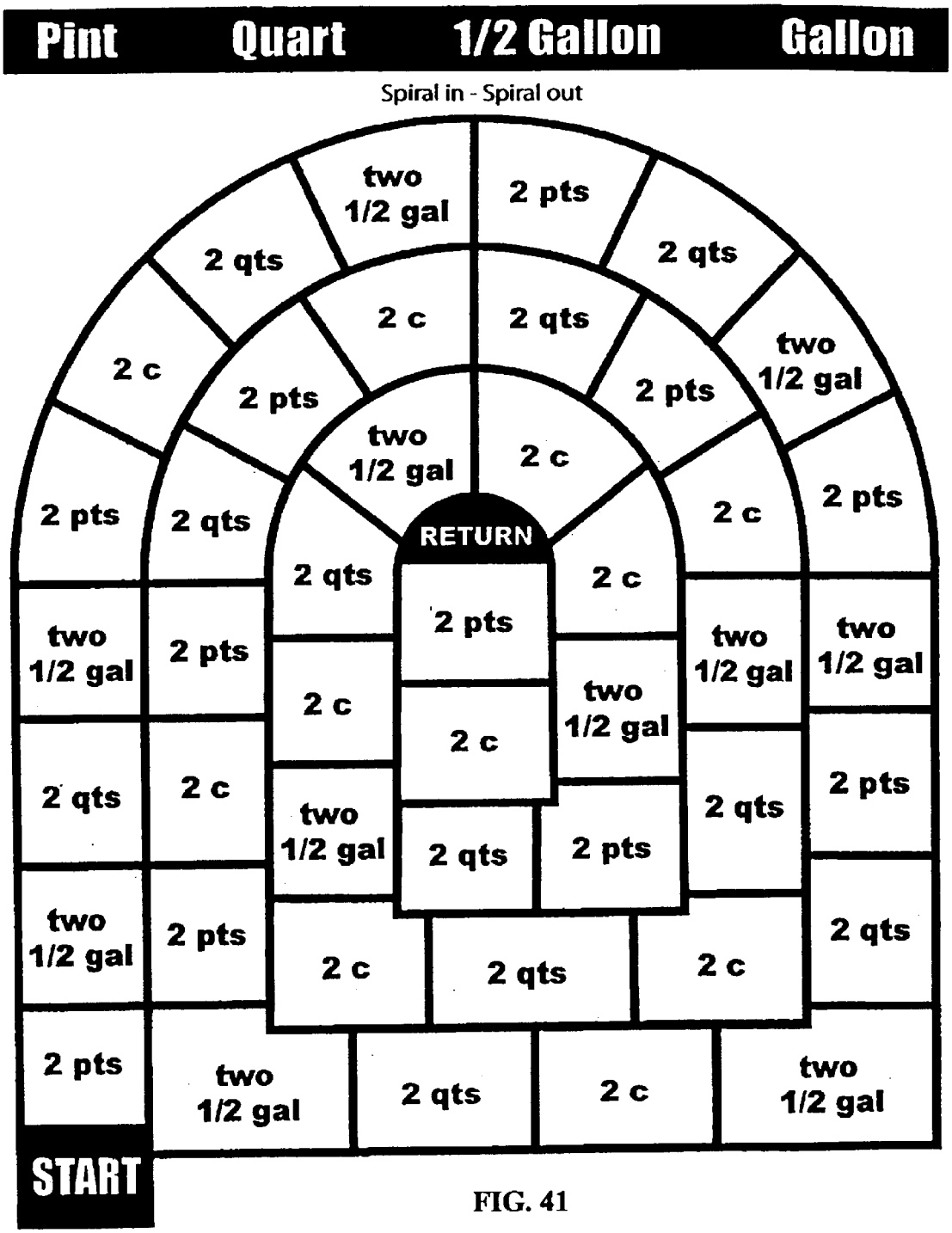
FIG. 41 is an illustrative embodiment of a concept versus concept game as disclosed herein entitled "Pint Quart ½ Gallon Gallon Spiral in—Spiral out", which is an example of a forward-backward-forward game.
Figure 42:
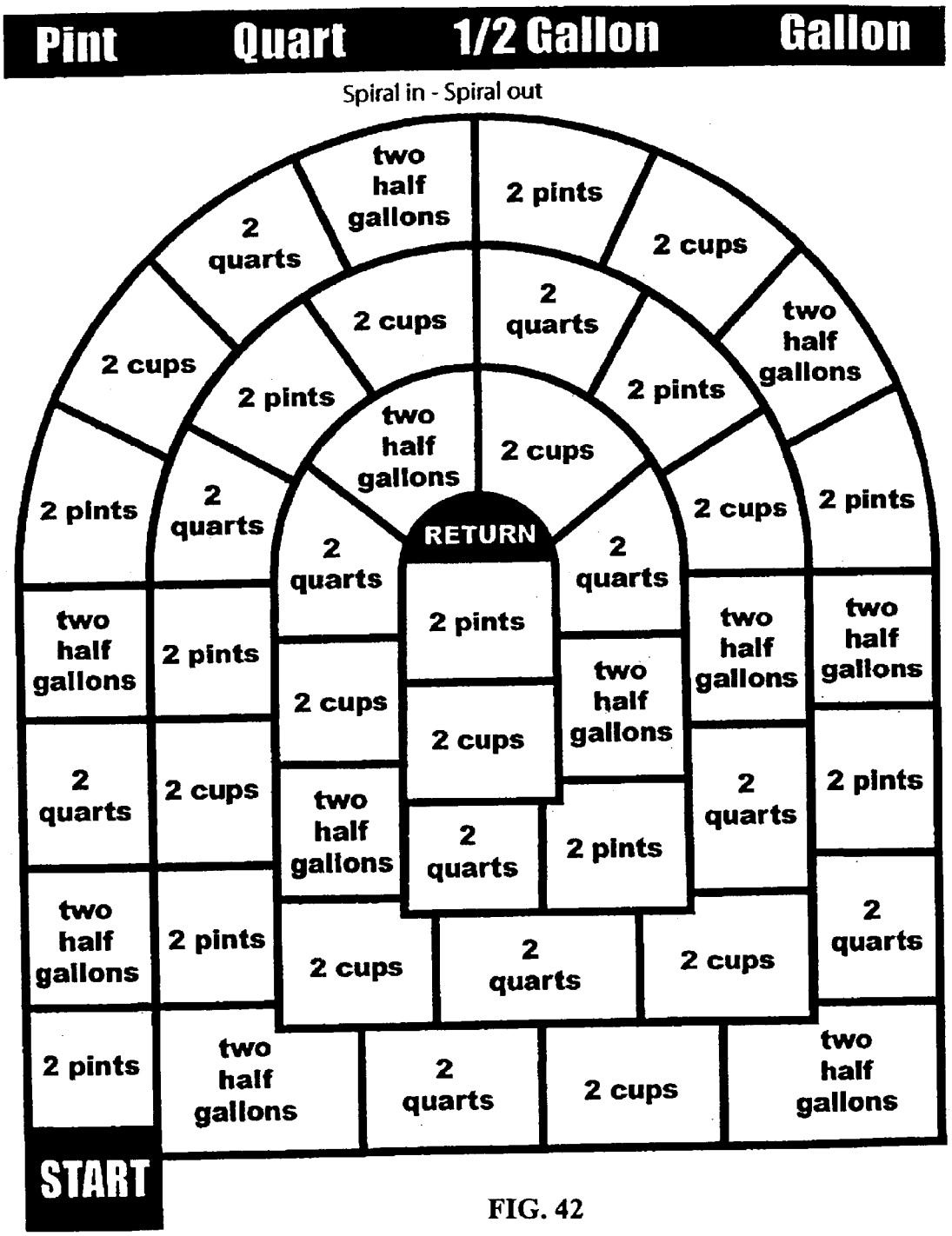
FIG. 42 is an illustrative embodiment of a concept versus concept game as disclosed herein entitled "Pint Quart ½ Gallon Gallon Spiral in—Spiral out", which is an example of a forward-backward-forward game.
Figure 43:
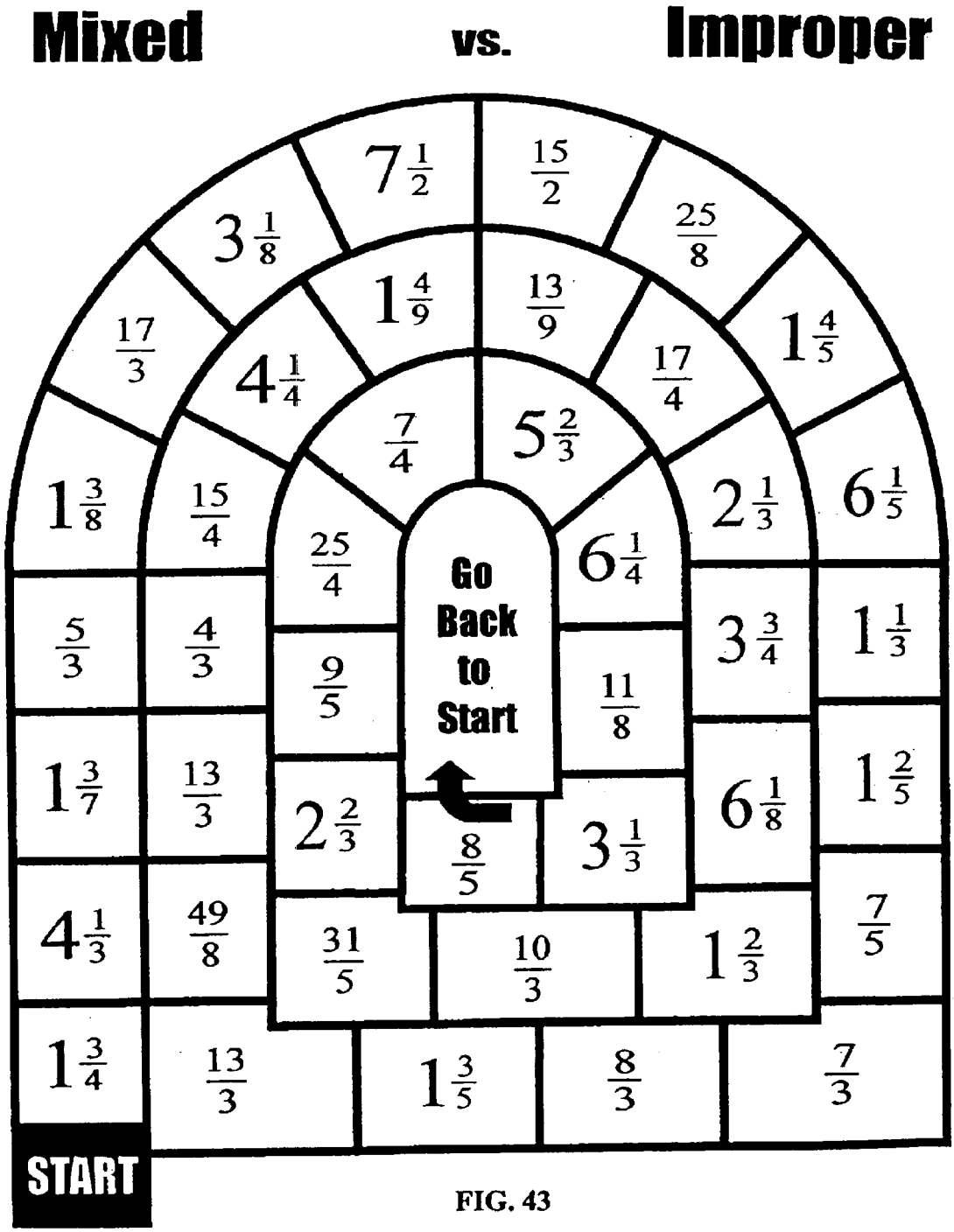
FIG. 43 is an illustrative embodiment of a concept versus concept game as disclosed herein entitled "Mixed vs. Improper", which is an example of a forward-backward-forward game.
Figure 45:
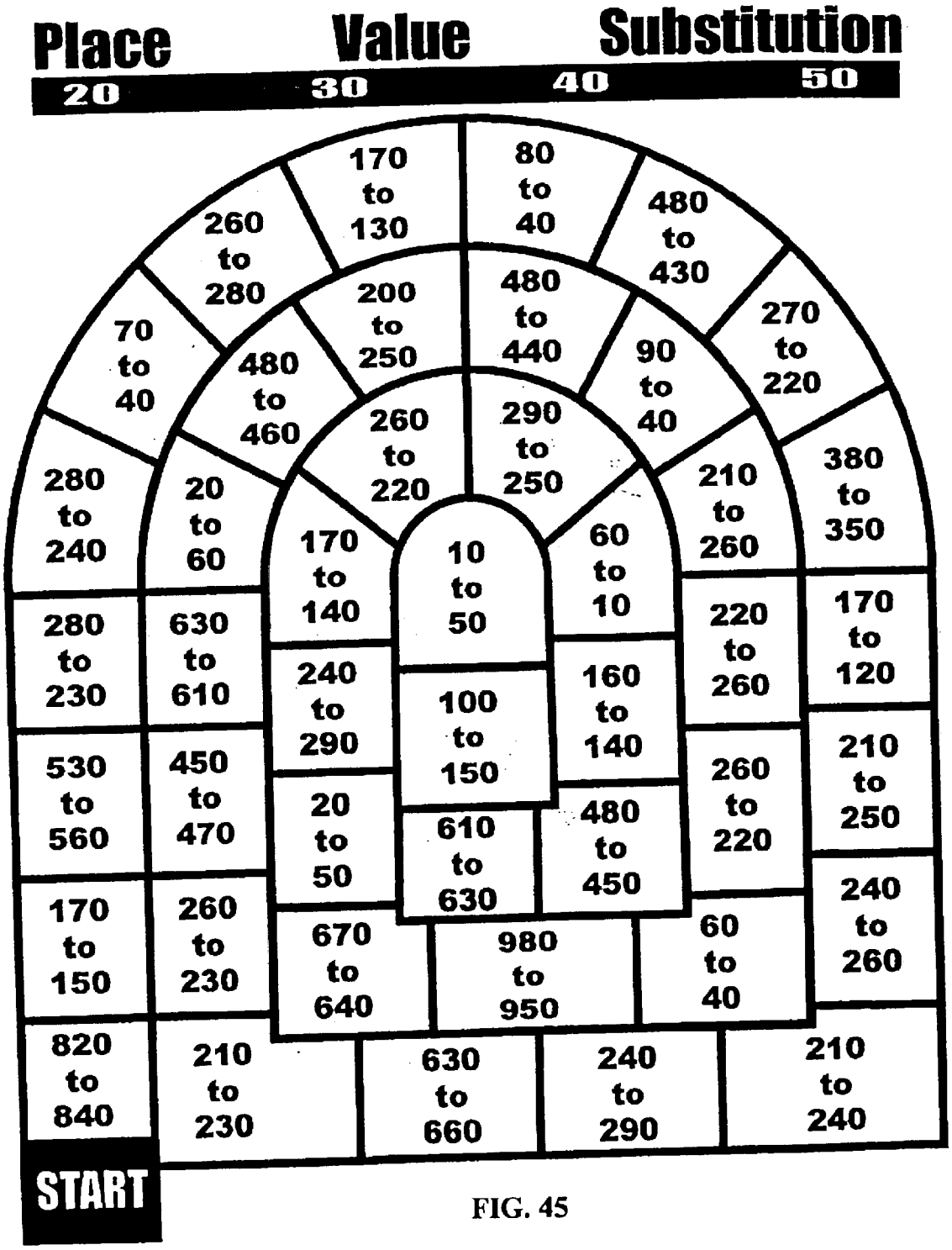
FIG. 45 is an illustrative embodiment of a concept versus concept game as disclosed herein entitled "Place Value Substitution 20 30 40 50", which is an example of a forward-backward-forward game.
Figure 46:
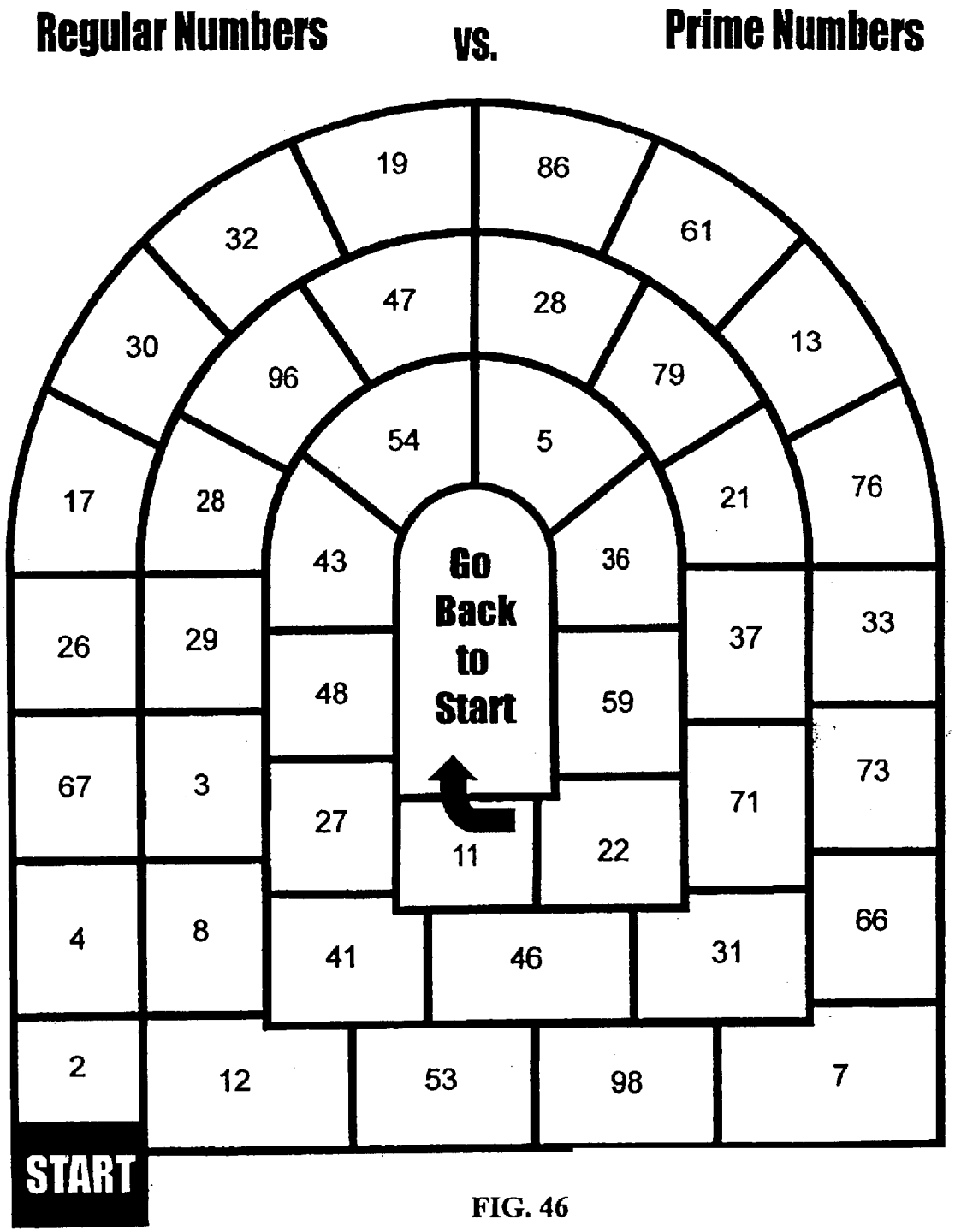
FIG. 46 is an illustrative embodiment of a concept versus concept game as disclosed herein entitled "Regular Numbers VS. Prime Numbers", which is an example of a forward-backward-forward game.
Figure 47:
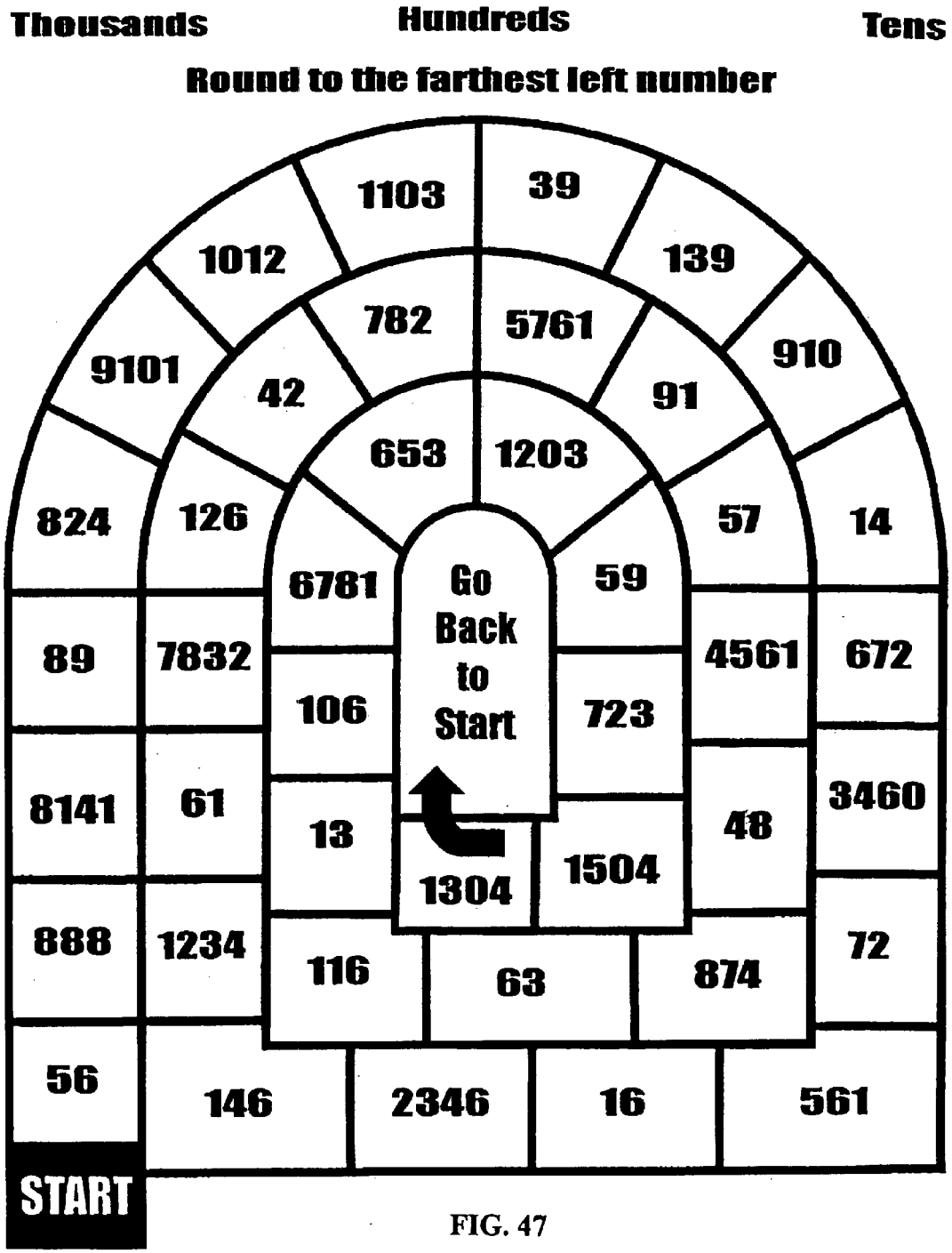
FIG. 47 is an illustrative embodiment of a concept versus concept game as disclosed herein entitled "Thousands Hundred Tens Round to the farthest left number", which is an example of a forward-backward-forward game.
Figure 48:
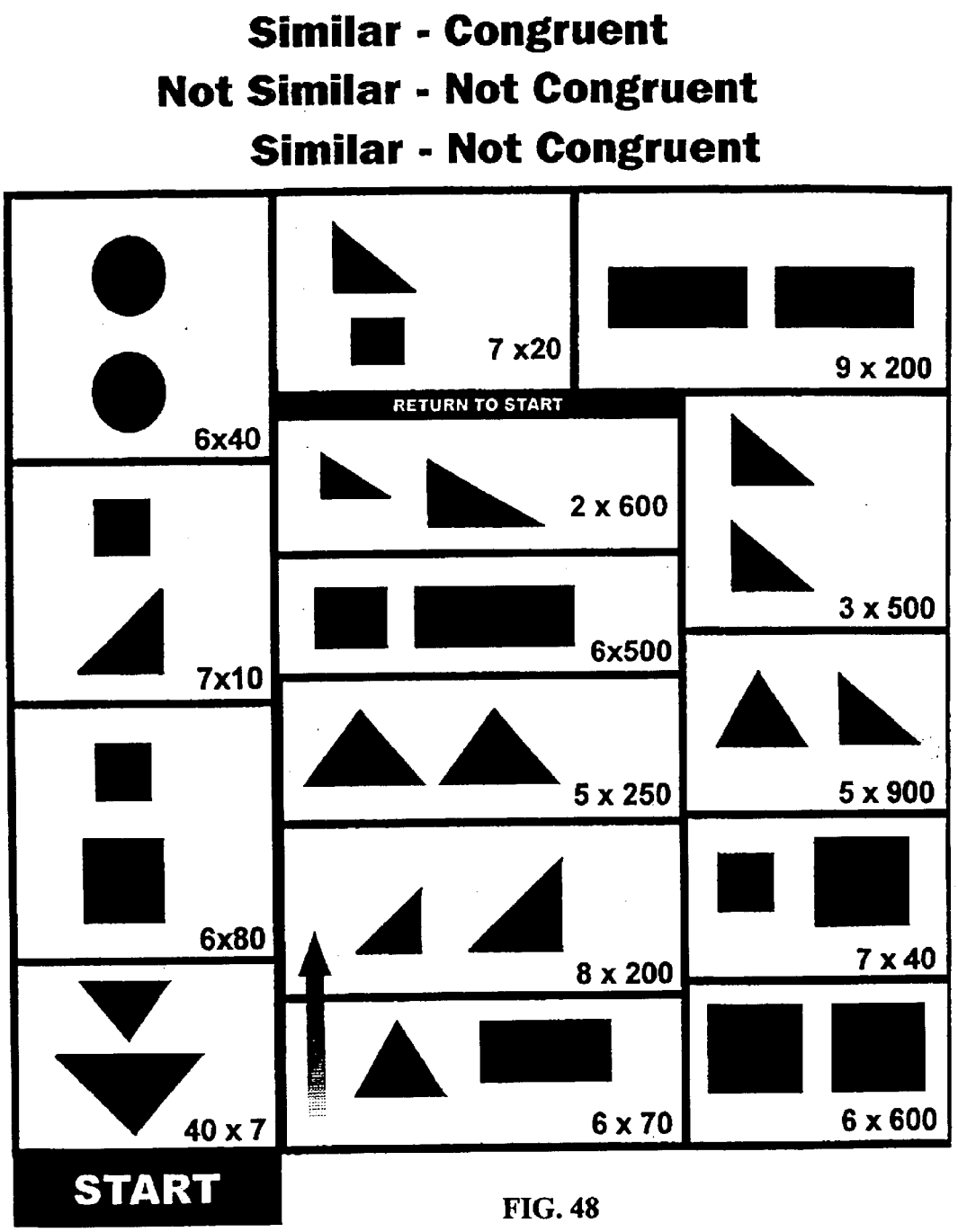
FIG. 48 is an illustrative embodiment of a concept versus concept game as disclosed herein entitled "Similar—Congruent, Not Similar—Not Congruent, Similar—Not Congruent", which is an example of a forward-backward-forward game.
Figure 49:
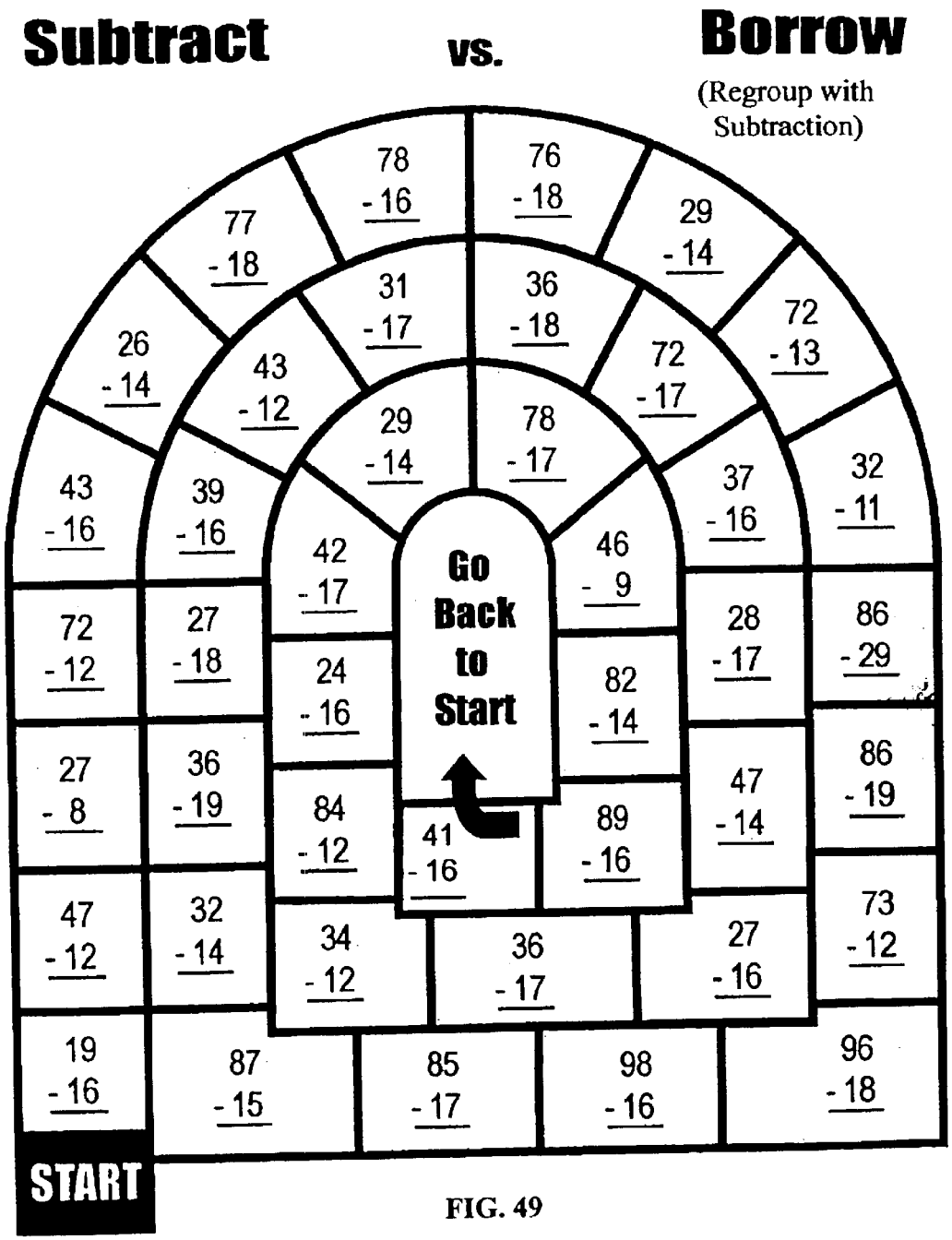
FIG. 49 is an illustrative embodiment of a concept versus concept game as disclosed herein entitled "Subtract vs. Borrow (Regroup with Subtraction)", which is an example of a forward-backward-forward game.
Figure 50:
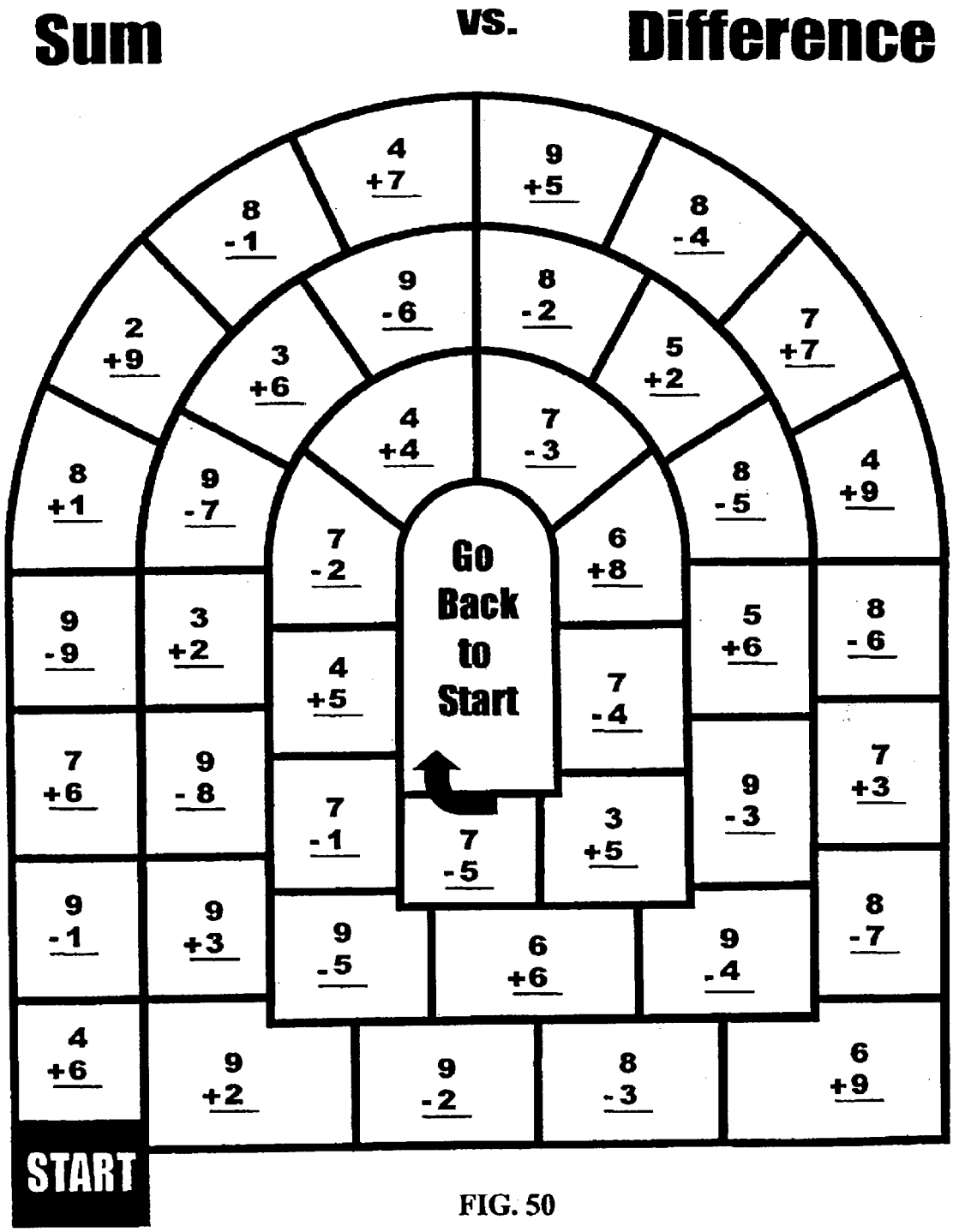
FIG. 50 is an illustrative embodiment of a concept versus concept game as disclosed herein entitled "Sum vs. Difference", which is an example of a forward-backward-forward game.
Figure 51:
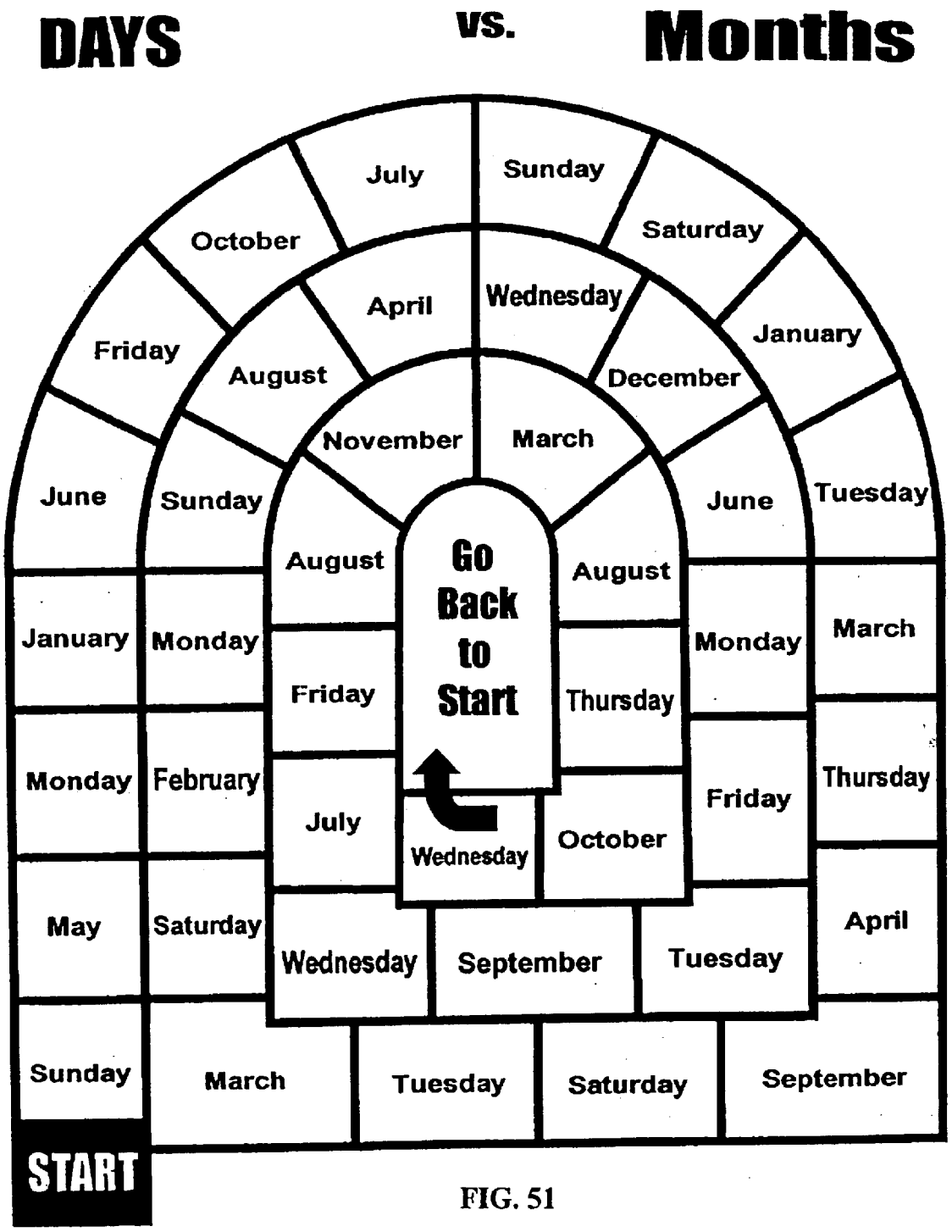
FIG. 51 is an illustrative embodiment of a concept versus concept game as disclosed herein entitled "Days vs. Months", which is an example of a forward-backward-forward game.
Figure 52:
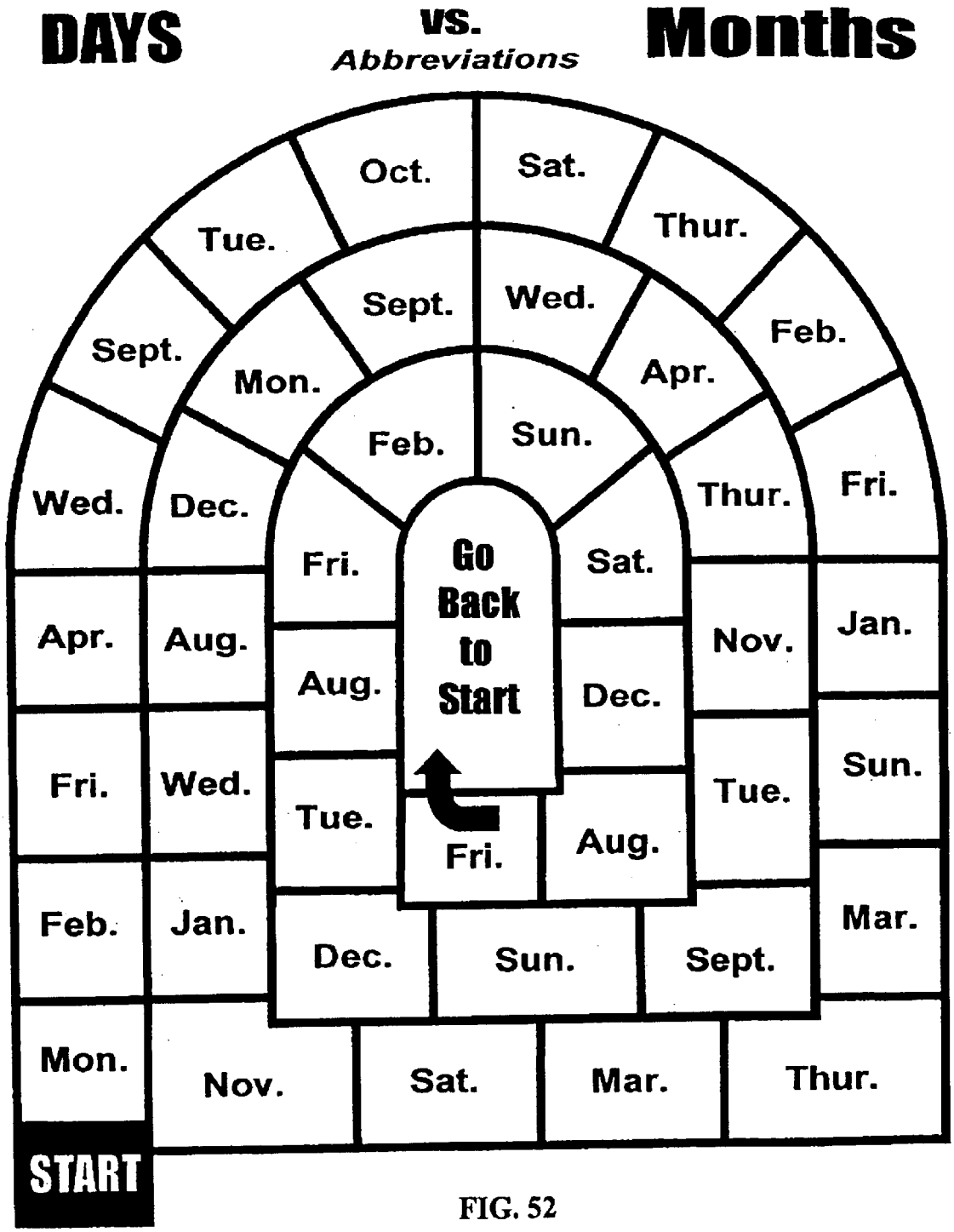
FIG. 52 is an illustrative embodiment of a concept versus concept game as disclosed herein entitled "Days vs. Months Abbreviations", which is an example of a forward-backward-forward game.
Figure 53:
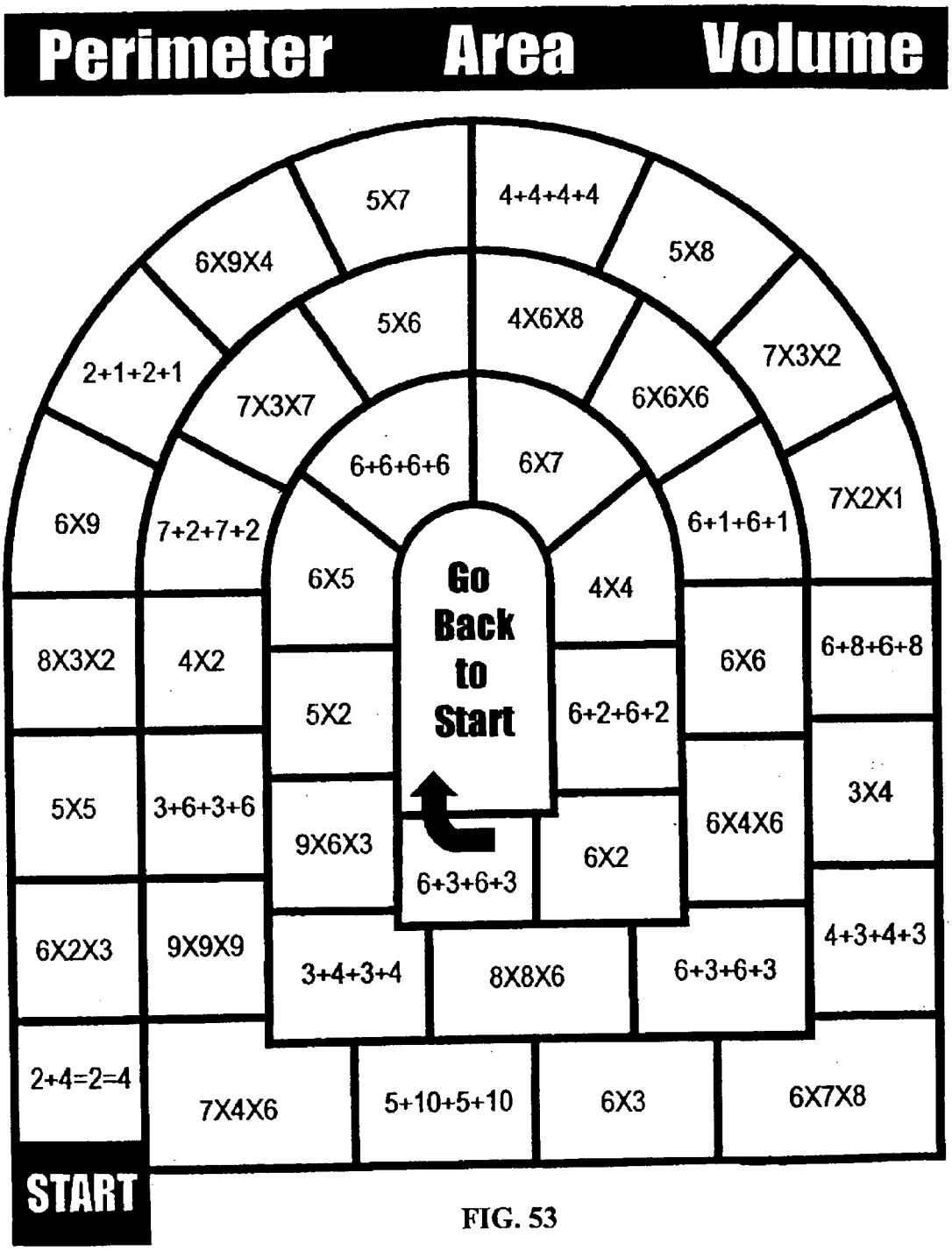
FIG. 53 is an illustrative embodiment of a concept versus concept game as disclosed herein entitled "Perimeter Area Volume", which is an example of a forward-backward-forward game.
Figure 54:
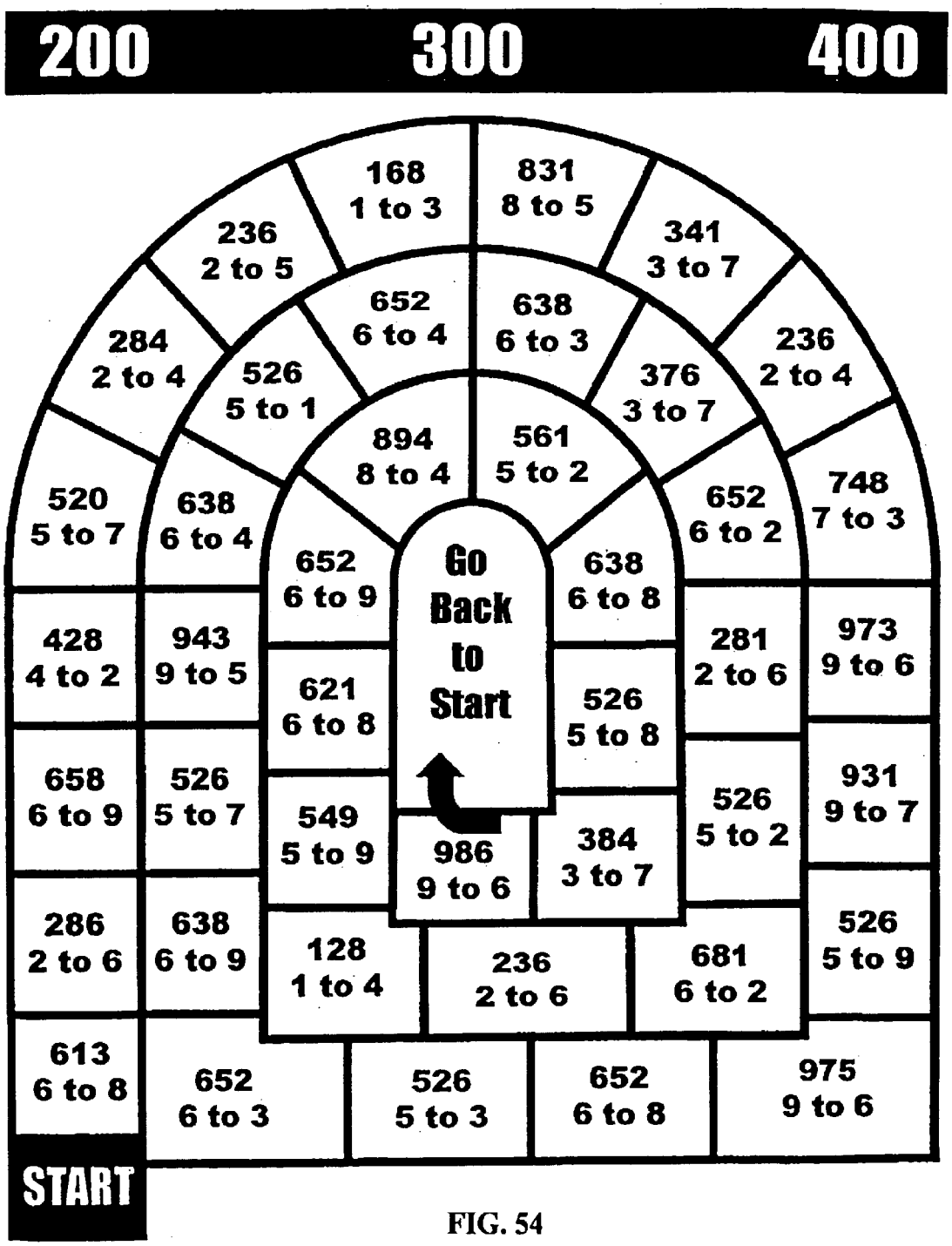
FIG. 54 is an illustrative embodiment of a concept versus concept game as disclosed herein entitled "200 300 400", which is an example of a forward-backward-forward game.
Figure 55:
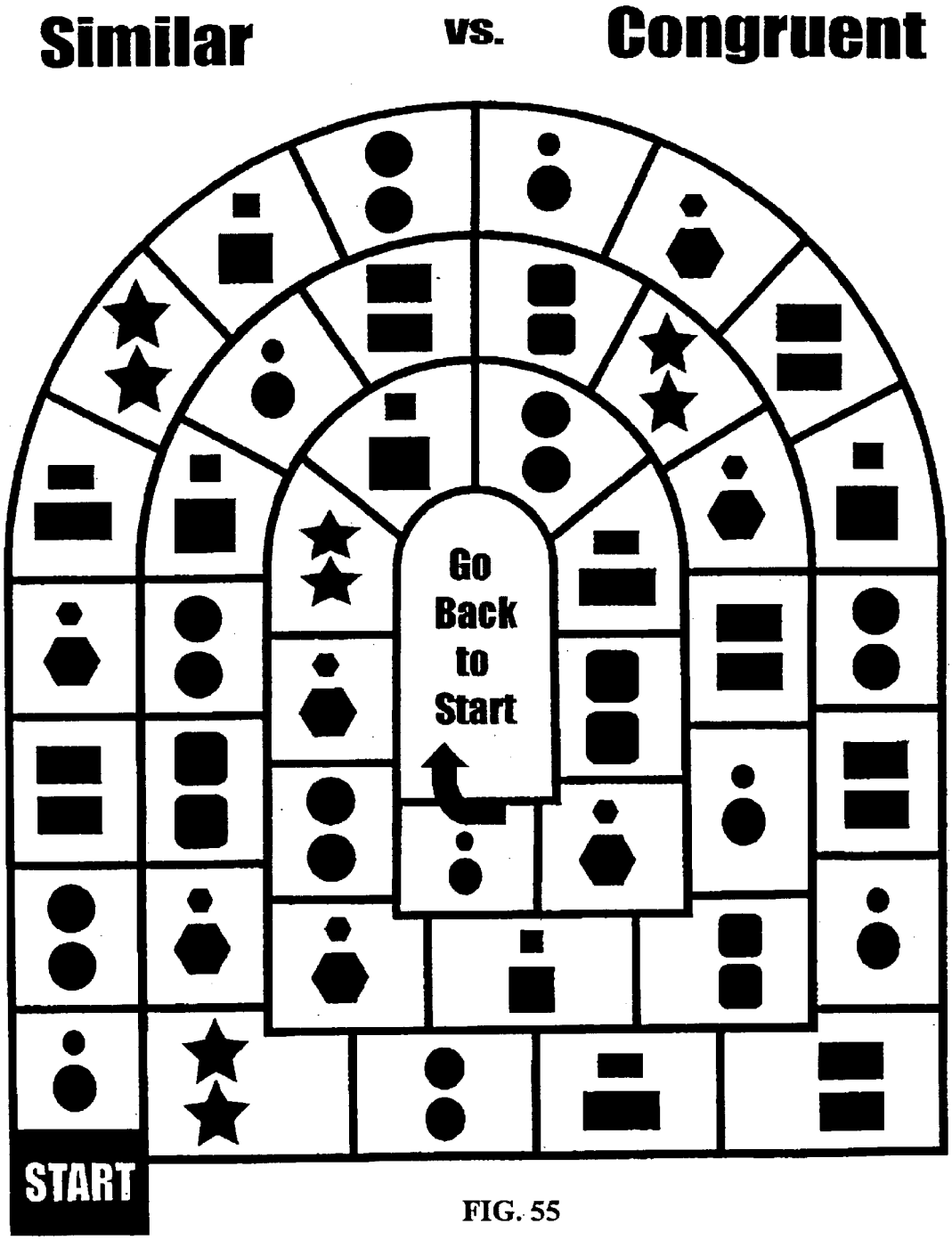
FIG. 55 is an illustrative embodiment of a concept versus concept game as disclosed herein entitled "Similar vs. Congruent", which is an example of a forward-backward-forward game.
Figure 56:
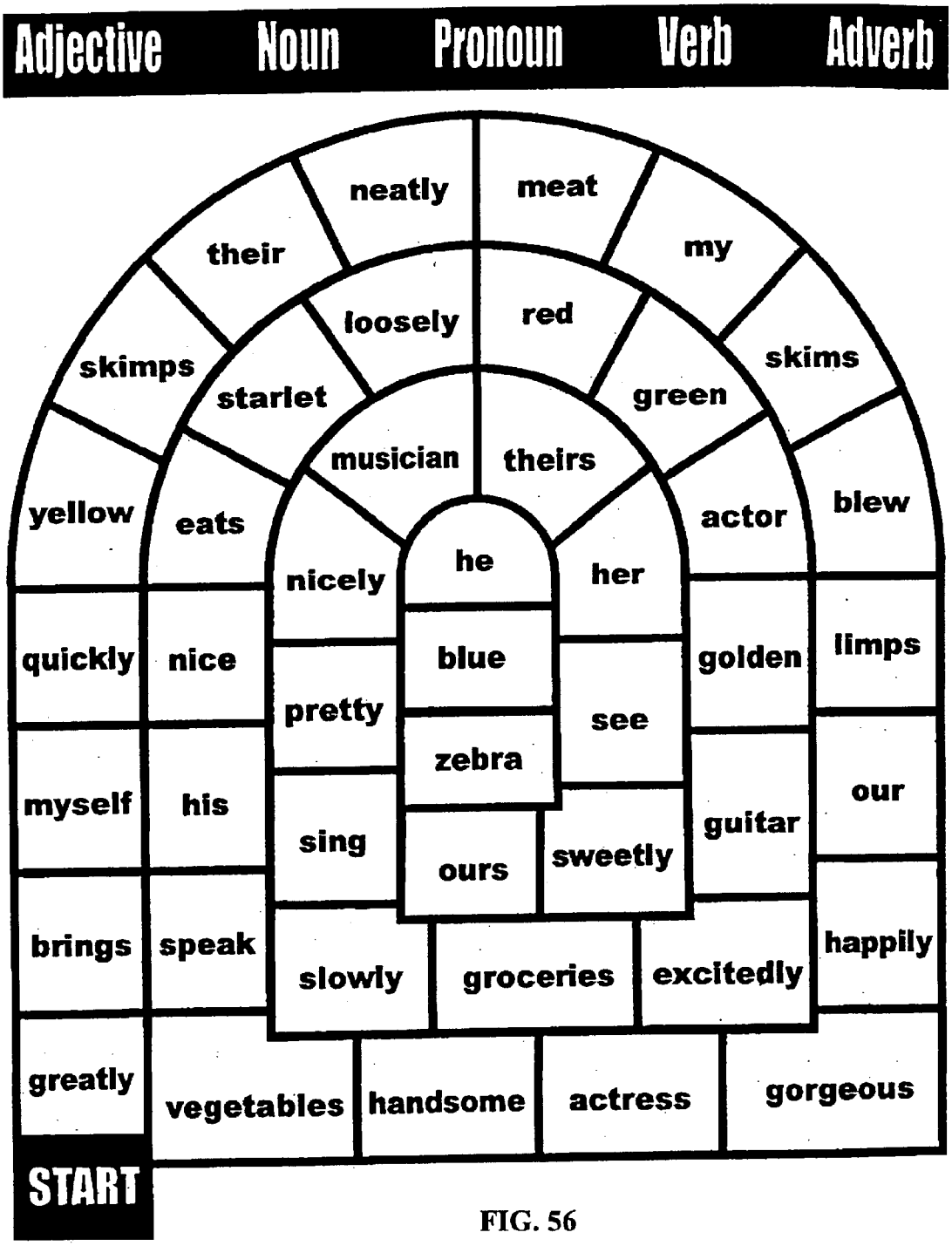
FIG. 56 is an illustrative embodiment of a concept versus concept game as disclosed herein entitled "Adjective Noun Pronoun Verb Adverb", which is an example of a forward-backward-forward game.
Figure 57:
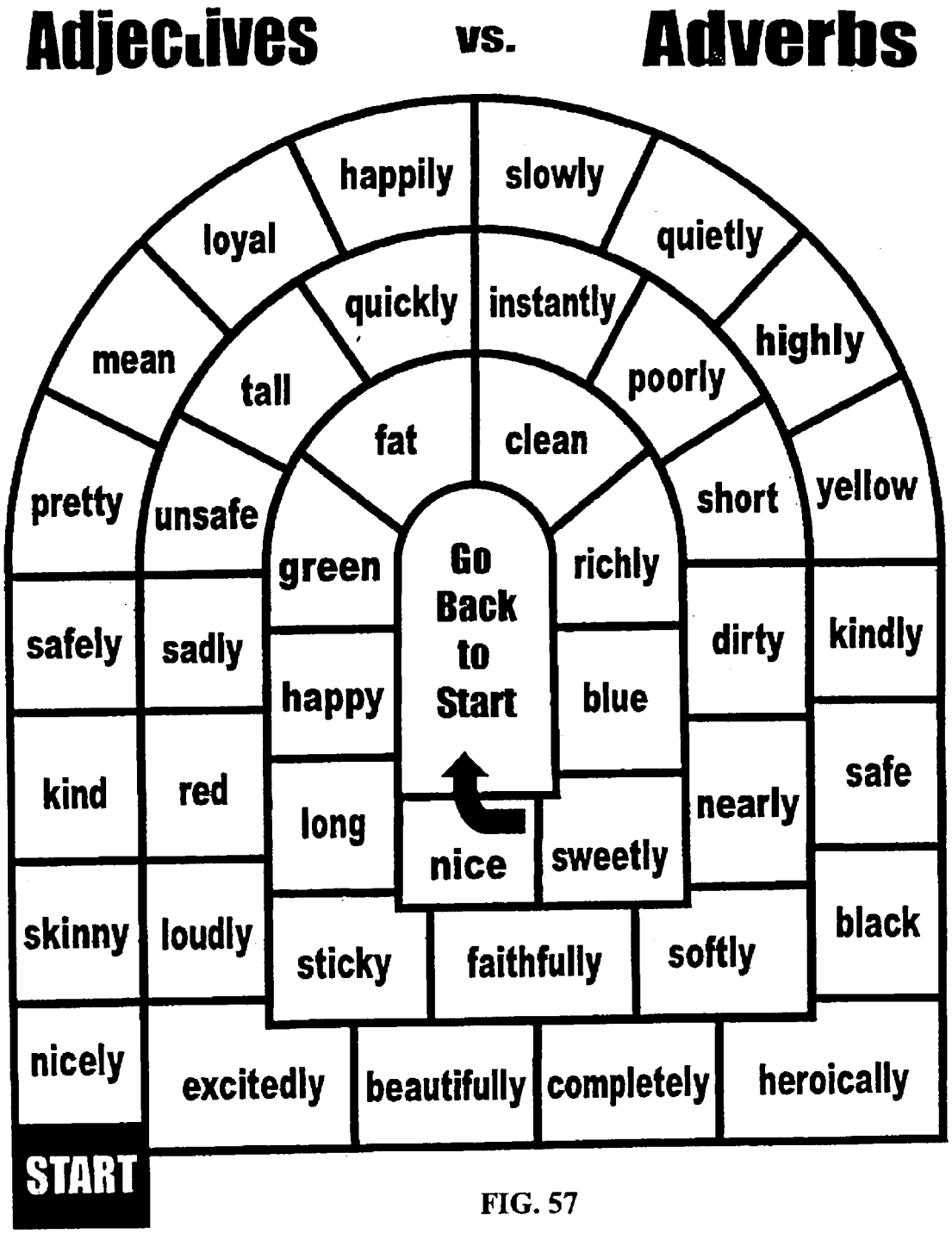
FIG. 57 is an illustrative embodiment of a concept versus concept game as disclosed herein entitled "Adjectives vs. Adverbs", which is an example of a forward-backward-forward game.
Figure 58:
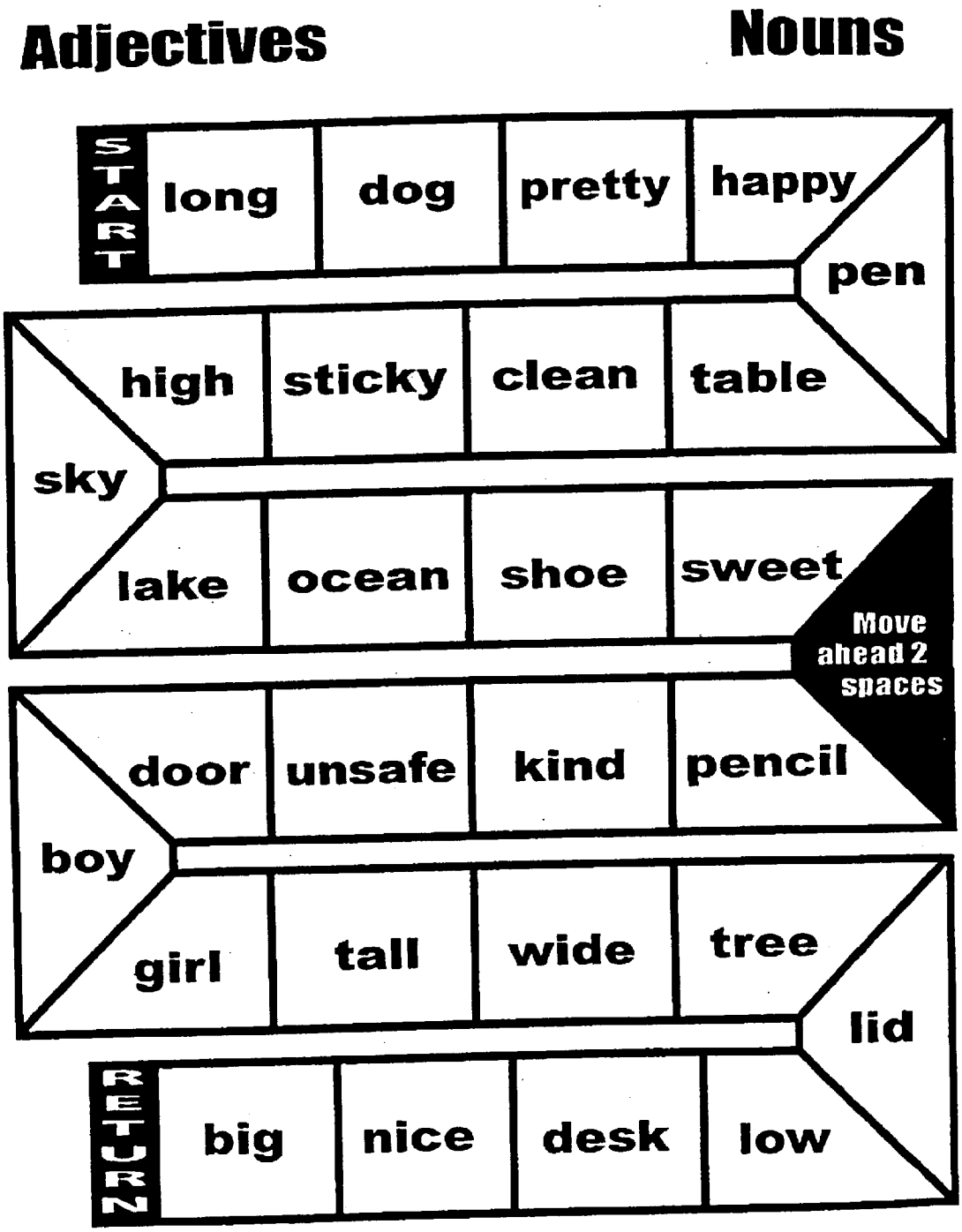
FIG. 58 is an illustrative embodiment of a concept versus concept game as disclosed herein entitled "Adjectives Nouns", which is an example of a forward-backward-forward game.
Figure 59:
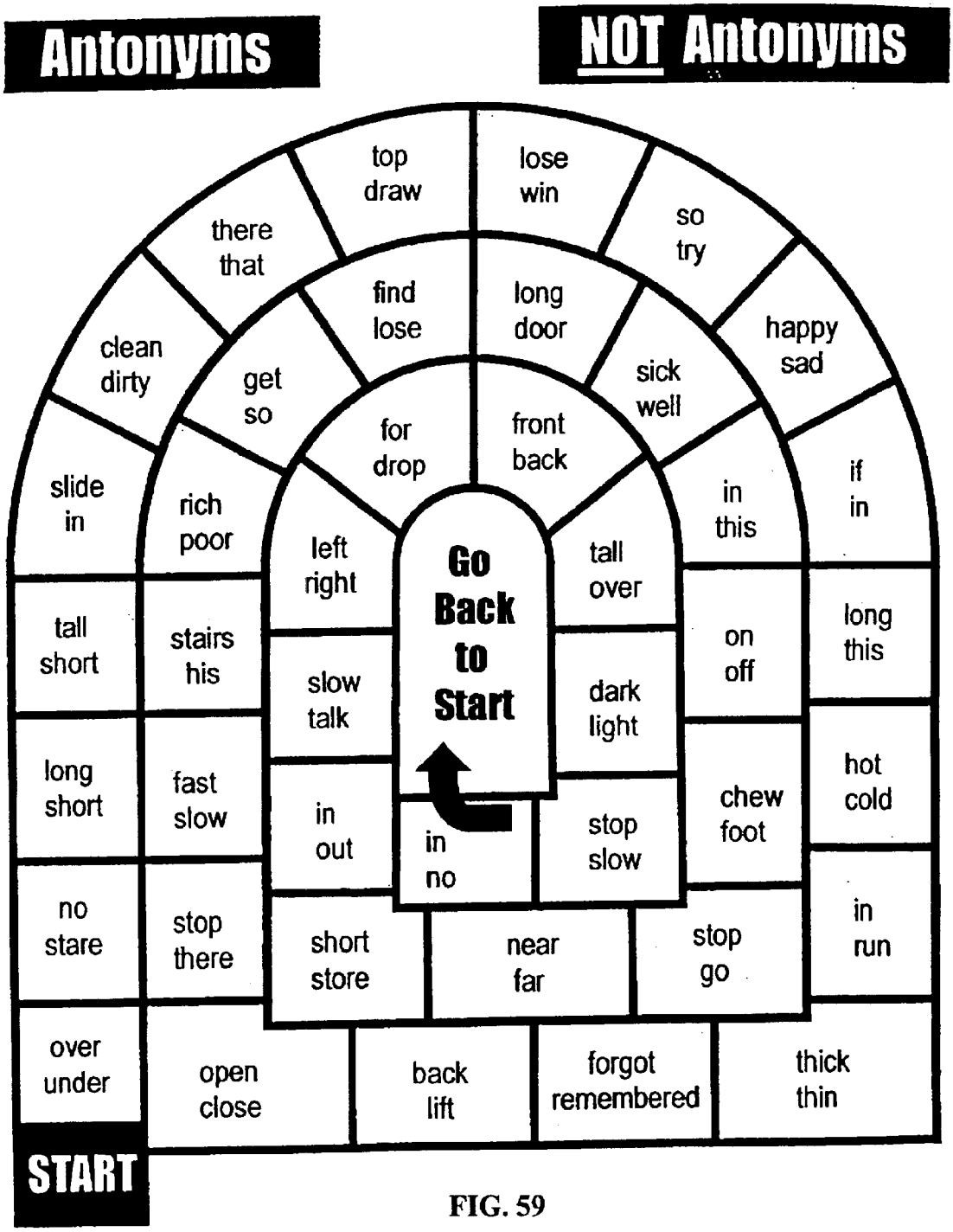
FIG. 59 is an illustrative embodiment of a concept versus concept game as disclosed herein entitled "Antonyms Not Antonyms", which is an example of a forward-backward-forward game.
Figure 60:
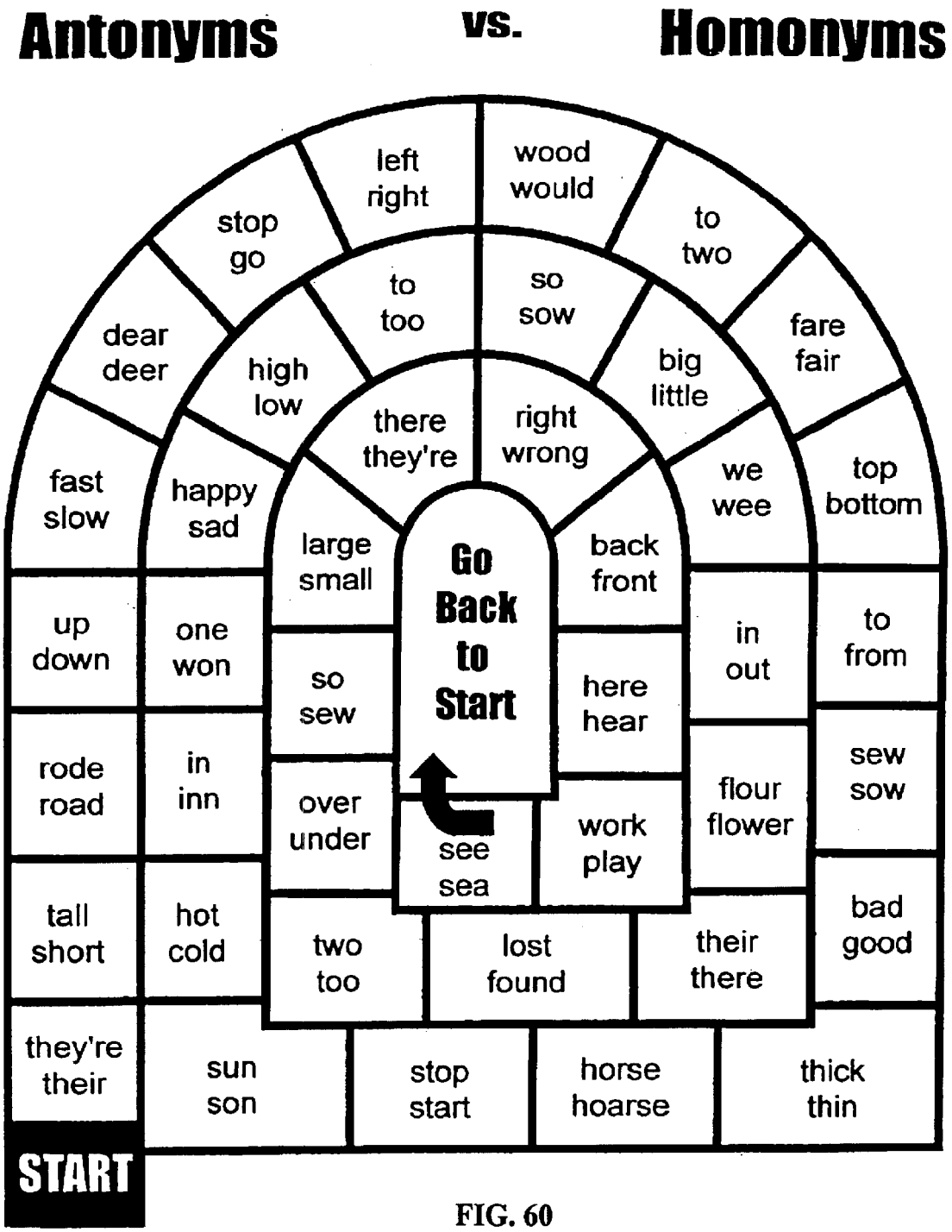
FIG. 60 is an illustrative embodiment of a concept versus concept game as disclosed herein entitled "Antonyms vs. Homonyms", which is an example of a forward-backward-forward game.
Figure 61:
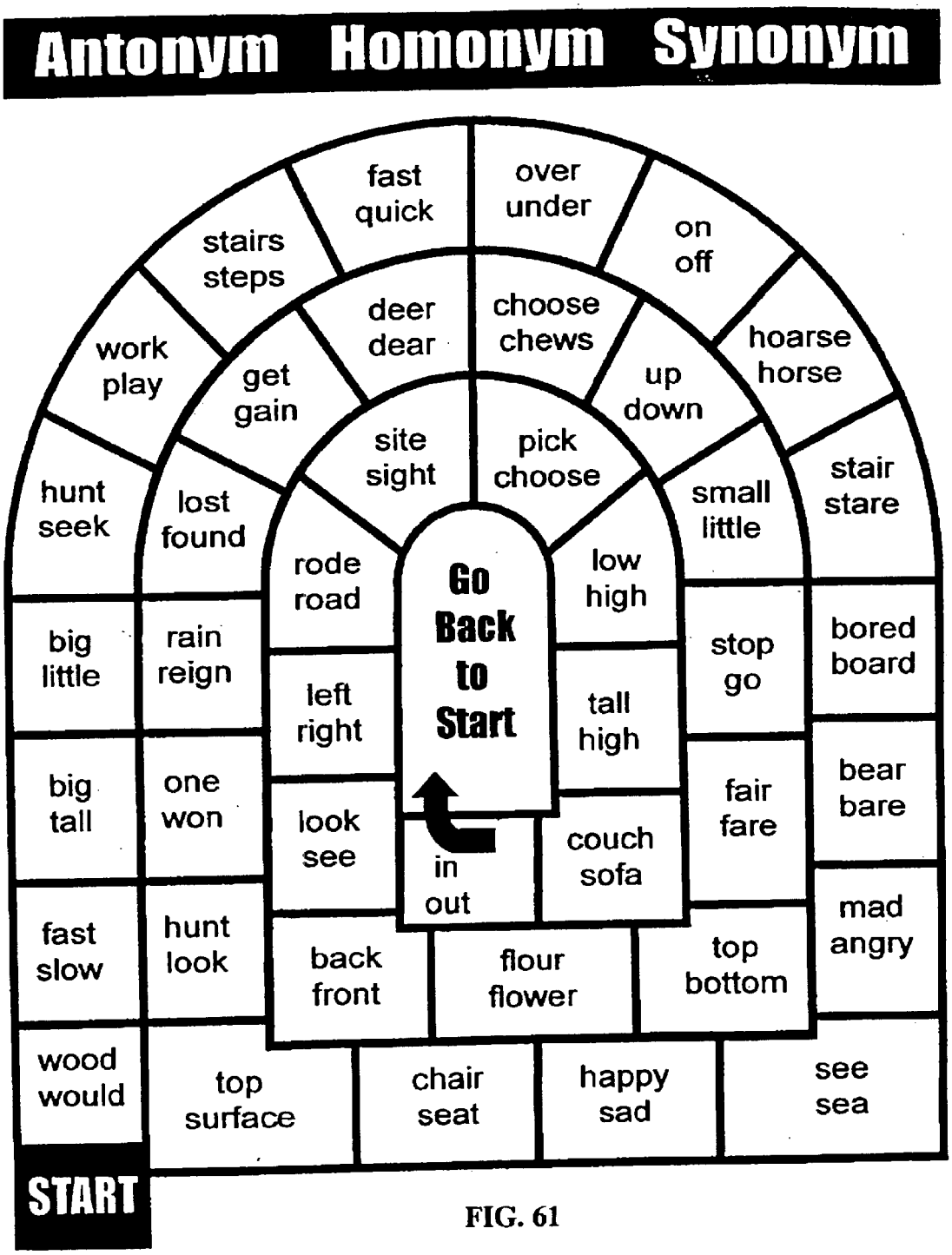
FIG. 61 is an illustrative embodiment of a concept versus concept game as disclosed herein entitled "Antonym Homonym Synonym", which is an example of a forward-backward-forward game.
Figure 62:
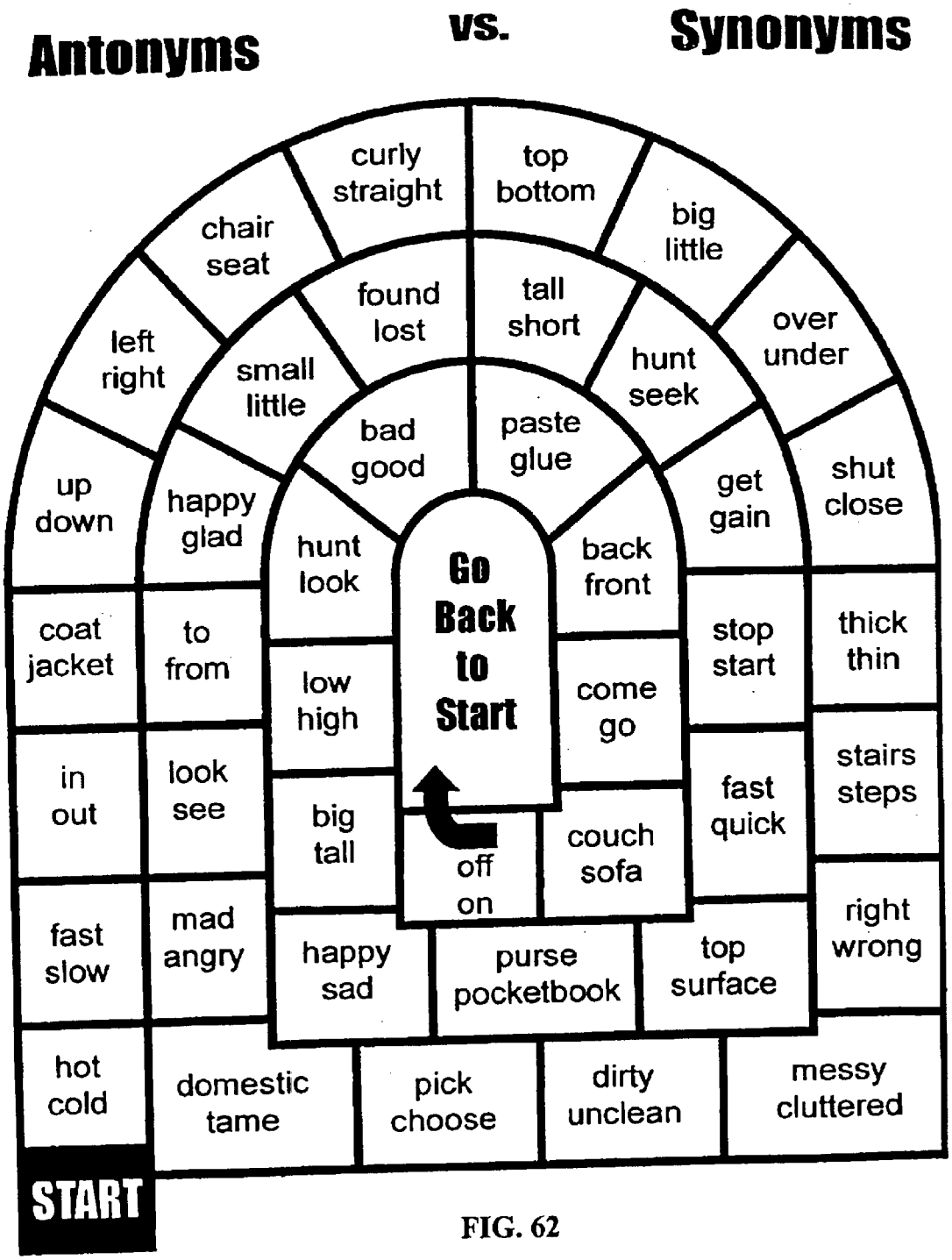
FIG. 62 is an illustrative embodiment of a concept versus concept game as disclosed herein entitled "Antonyms vs. Synonyms", which is an example of a forward-backward-forward game.
Figure 63:
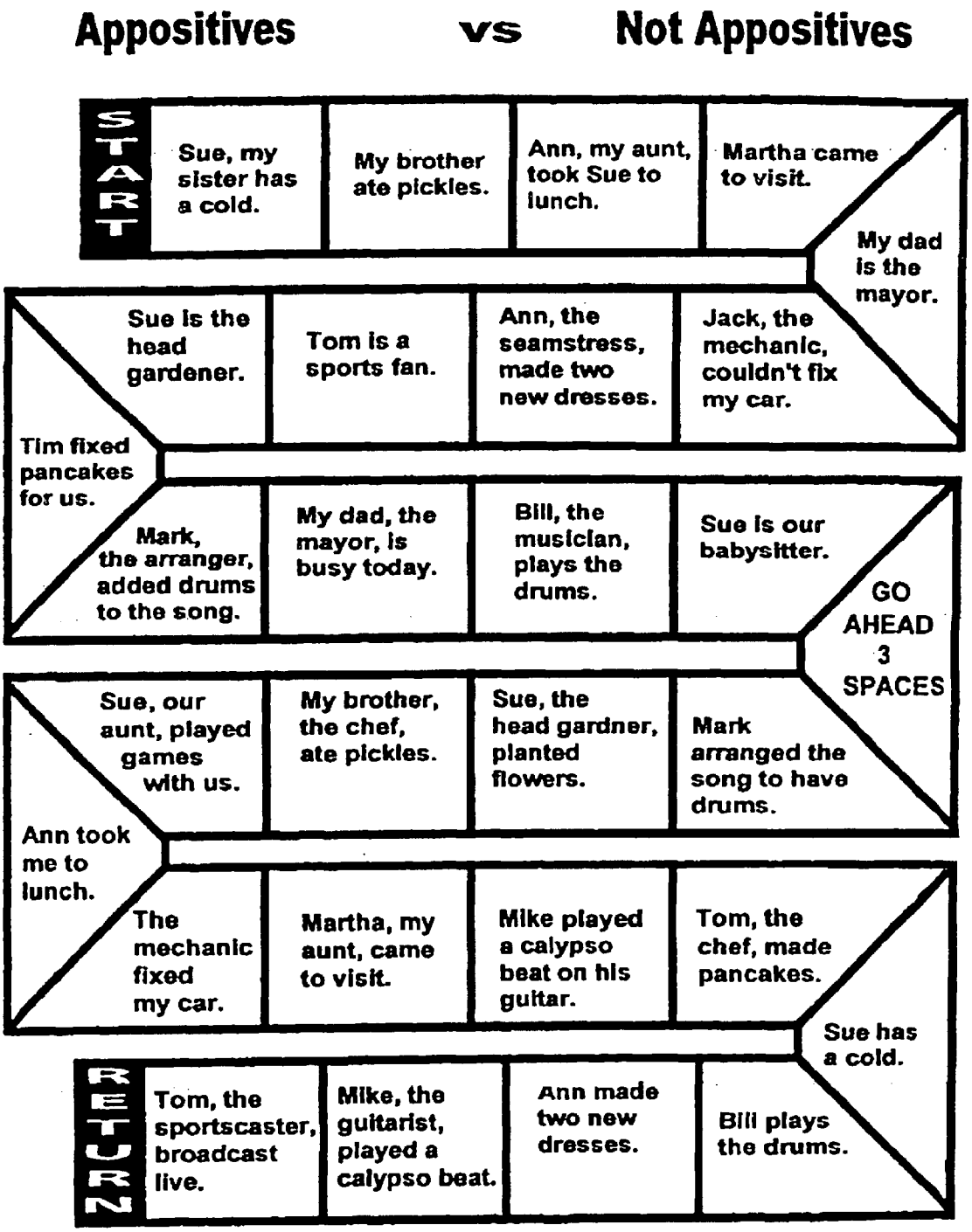
FIG. 63 is an illustrative embodiment of a concept versus concept game as disclosed herein entitled "Appositives vs. Not Appositives", which is an example of a forward-backward-forward game.
Figure 64:
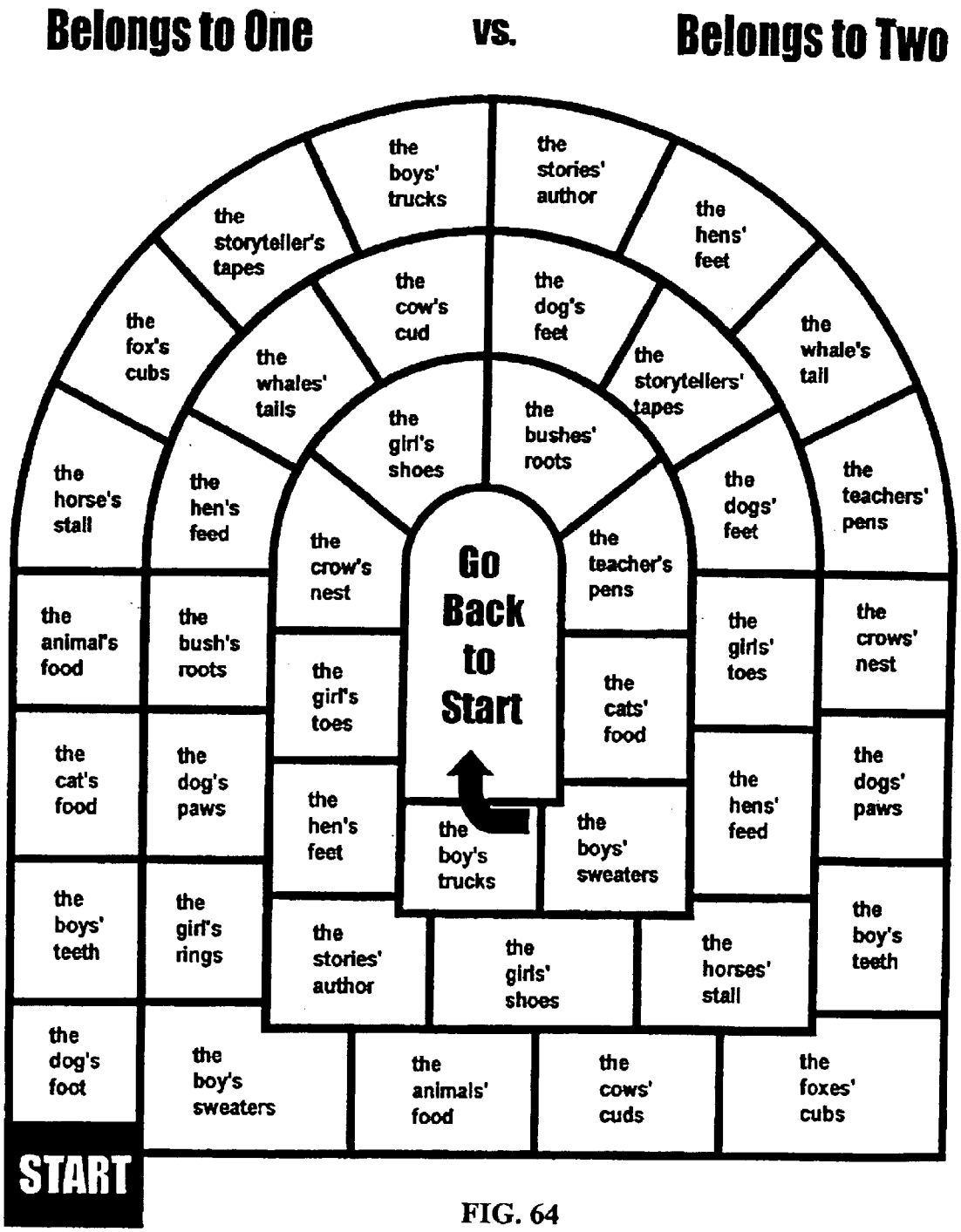
FIG. 64 is an illustrative embodiment of a concept versus concept game as disclosed herein entitled "Belongs to One vs. Belongs to Two", which is an example of a forward-backward-forward game.
Figure 65:
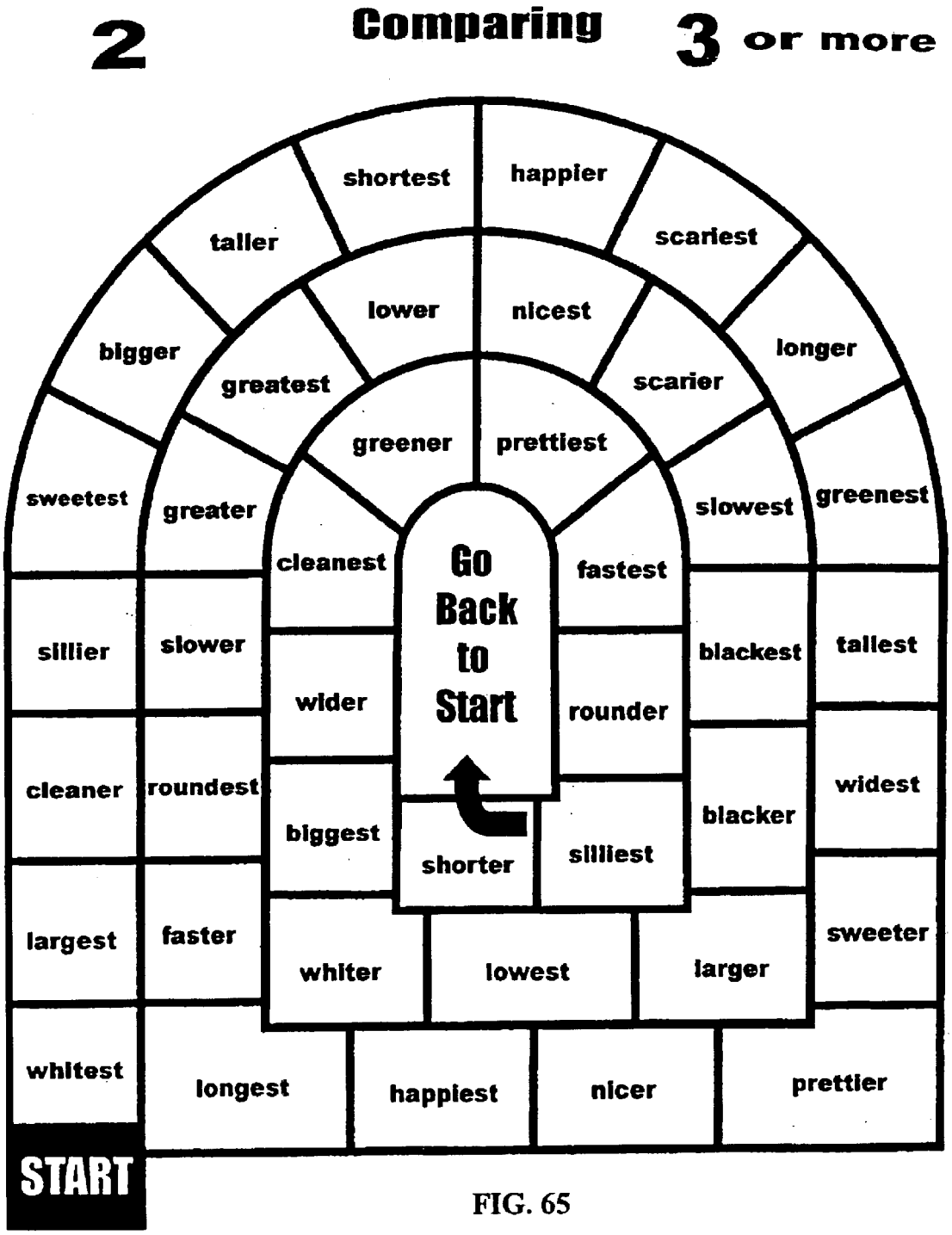
FIG. 65 is an illustrative embodiment of a concept versus concept game as disclosed herein entitled "Comparing 2 3 or more", which is an example of a forward-backward-forward game.
Figure 66:
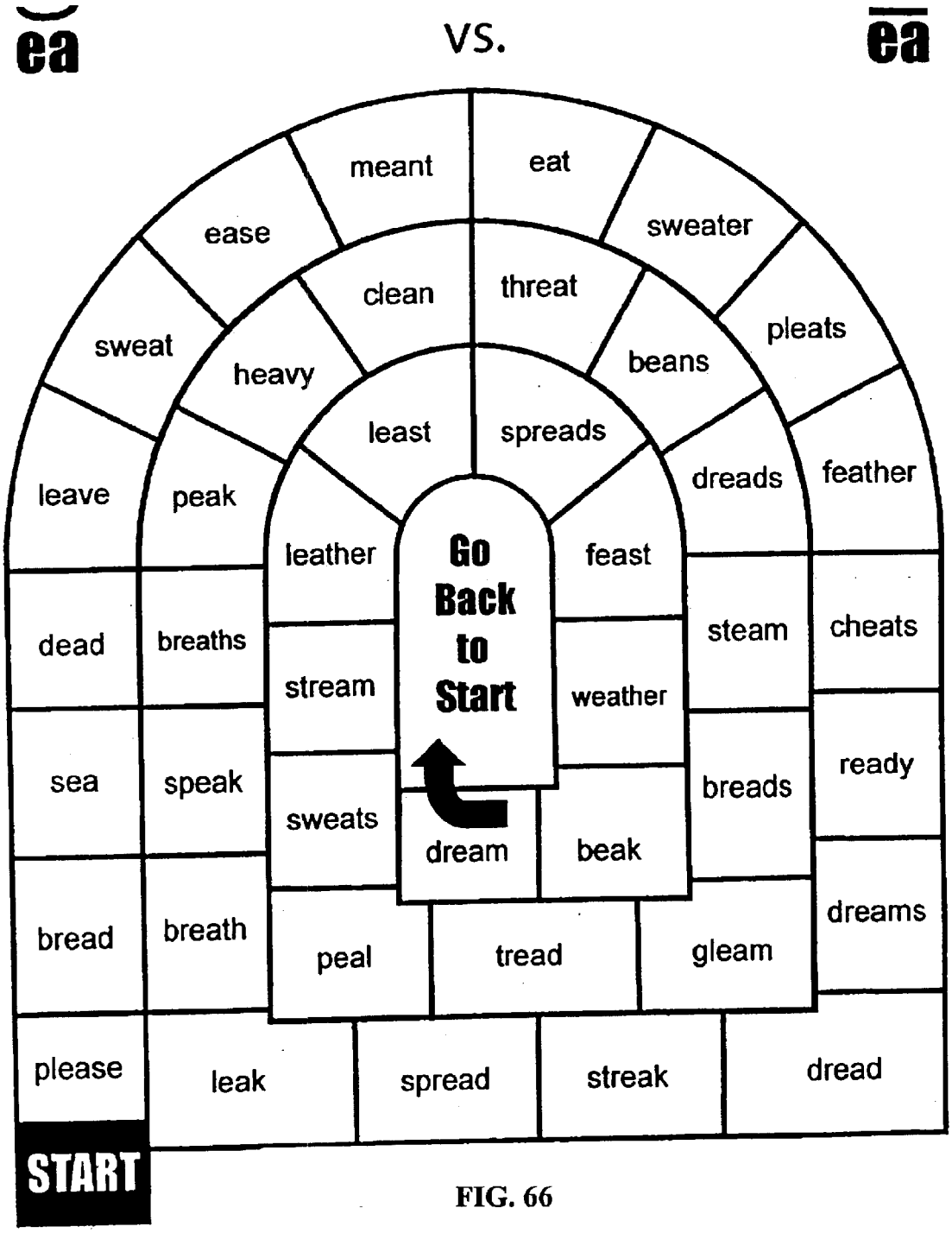
FIG. 66 is an illustrative embodiment of a concept versus concept game as disclosed herein entitled "ea vs. ea", which is an example of a forward-backward-forward game.
Figure 67:
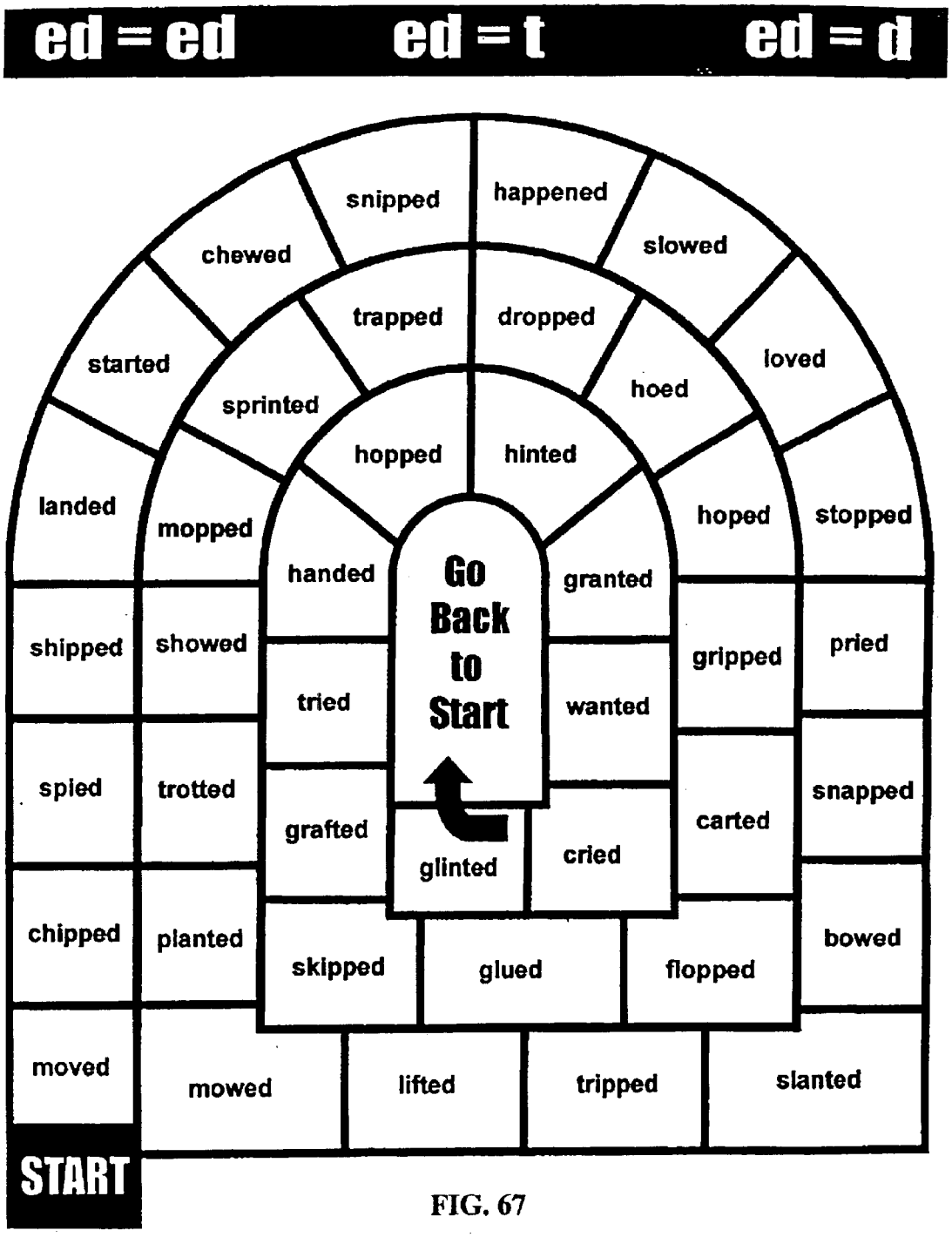
FIG. 67 is an illustrative embodiment of a concept versus concept game as disclosed herein entitled "ed=ed ed=t ed=d", which is an example of a forward-backward-forward game.
Figure 68:
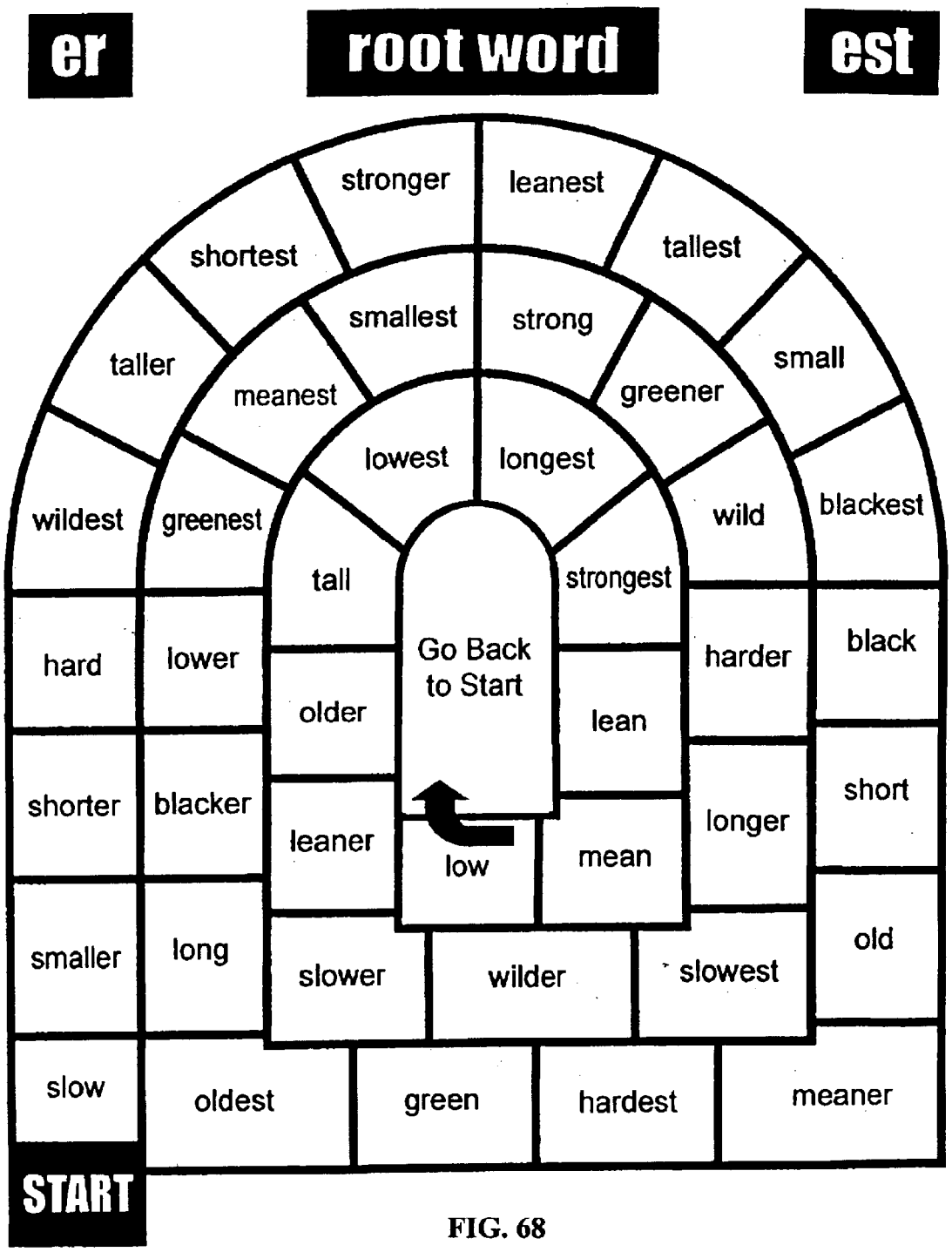
FIG. 68 is an illustrative embodiment of a concept versus concept game as disclosed herein entitled "er root word est", which is an example of a forward-backward-forward game.
Figure 69:
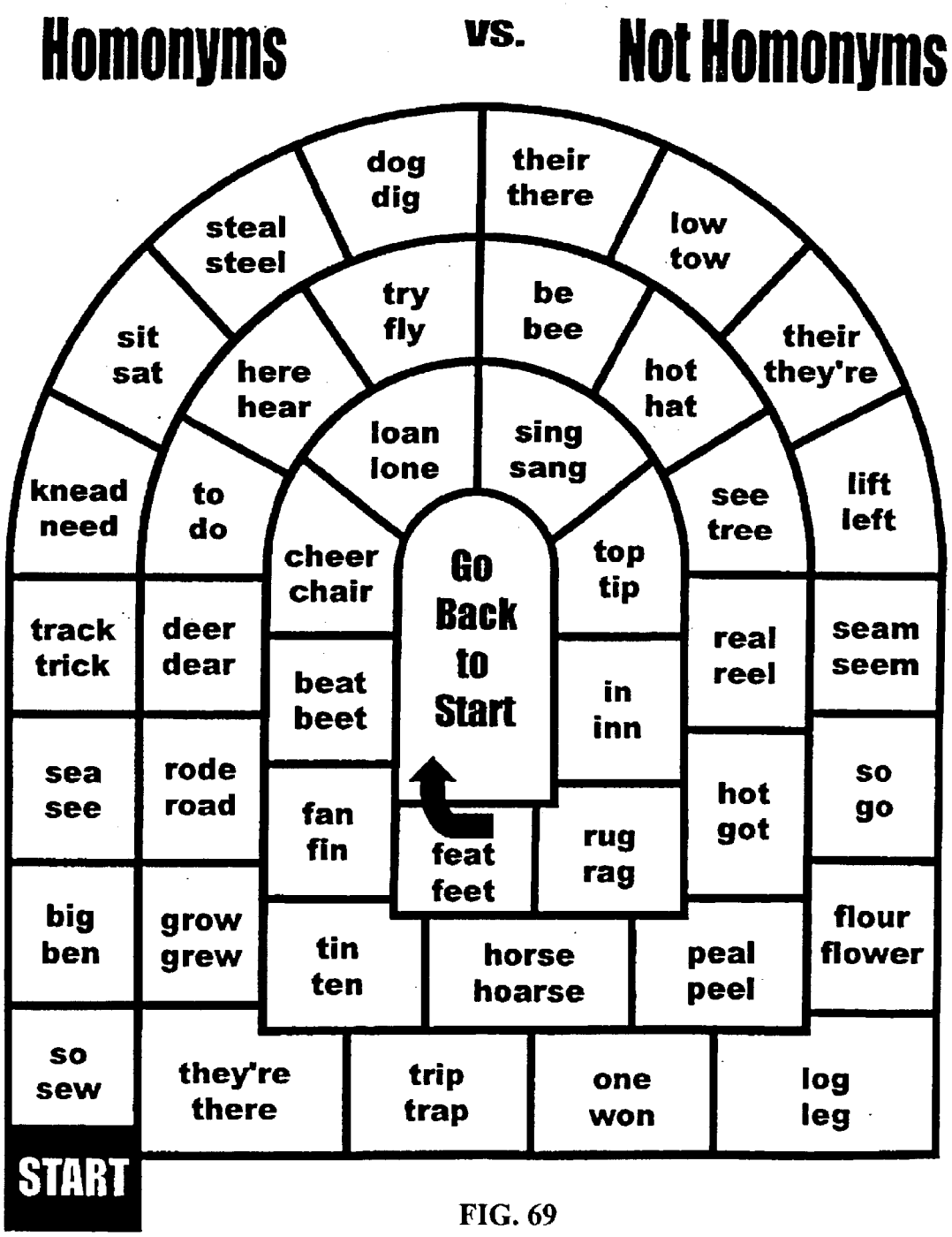
FIG. 69 is an illustrative embodiment of a concept versus concept game as disclosed herein entitled. "Homonyms vs. Not Homonyms", which is an example of a forward-backward-forward game.
Figure 70:
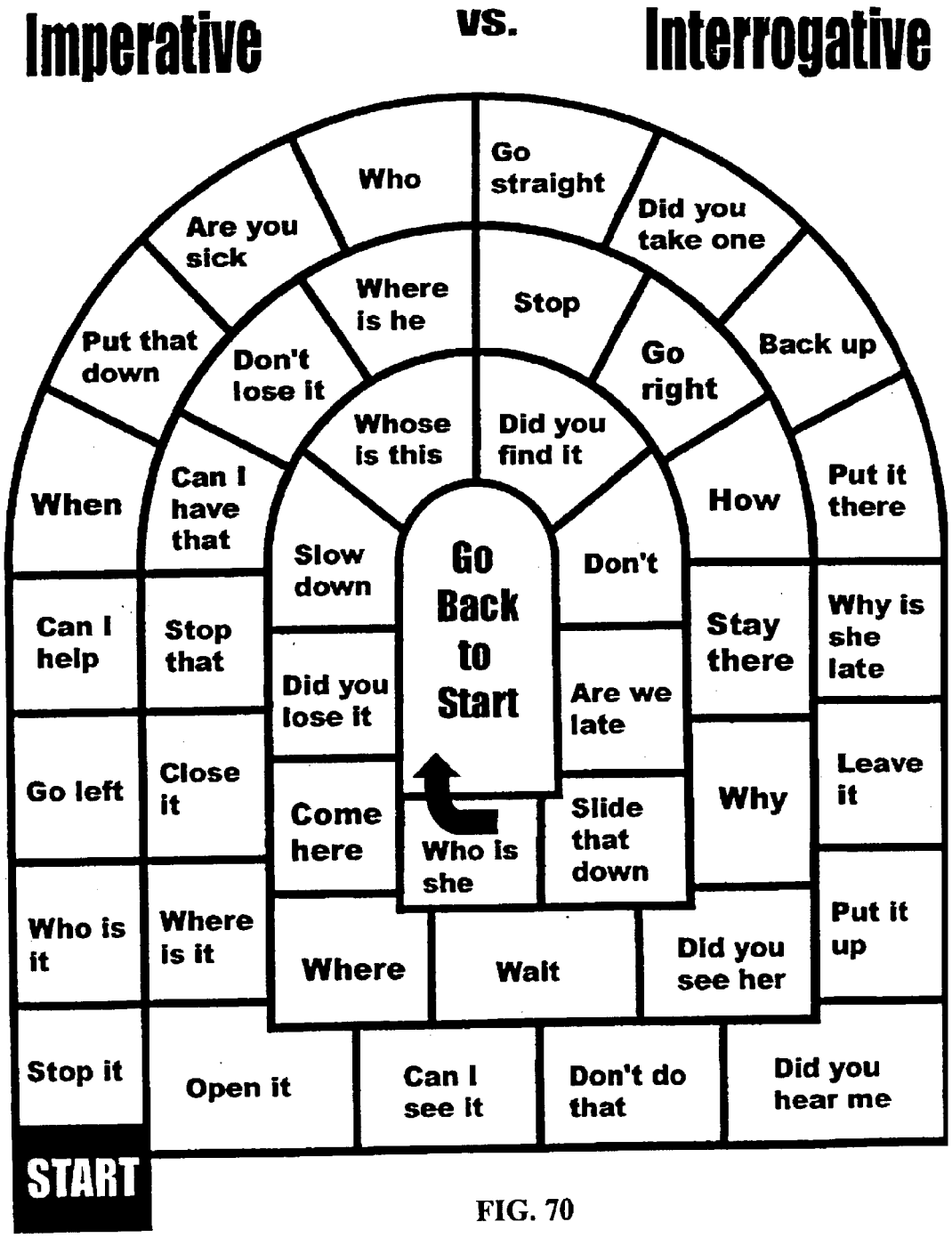
FIG. 70 is an illustrative embodiment of a concept versus concept game as disclosed herein entitled "Imperative vs. Interrogative", which is an example of a forward-backward-forward game.
Figure 71:
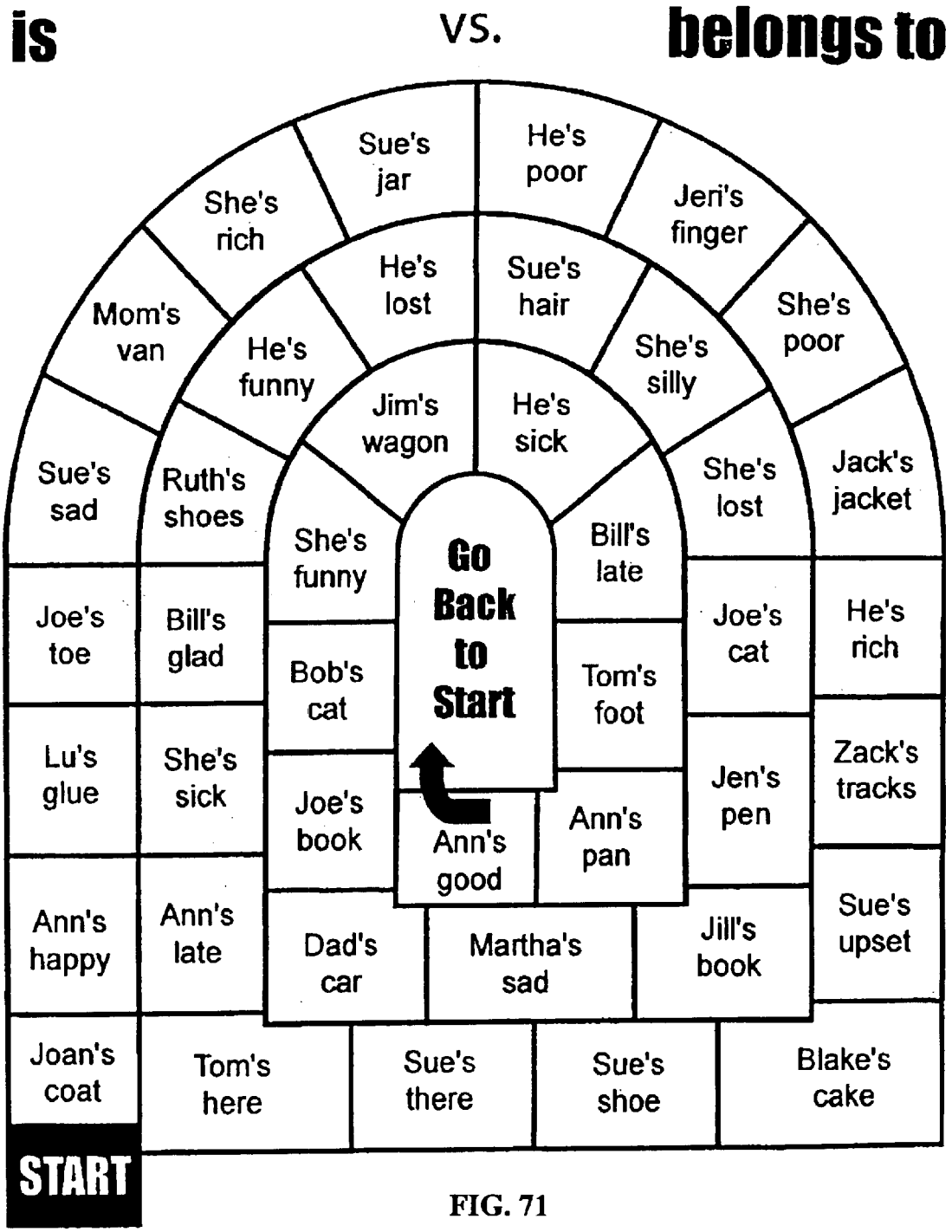
FIG. 71 is an illustrative embodiment of a concept versus concept game as disclosed herein entitled "is vs belongs to", which is an example of a forward-backward-forward game.
Figure 72:
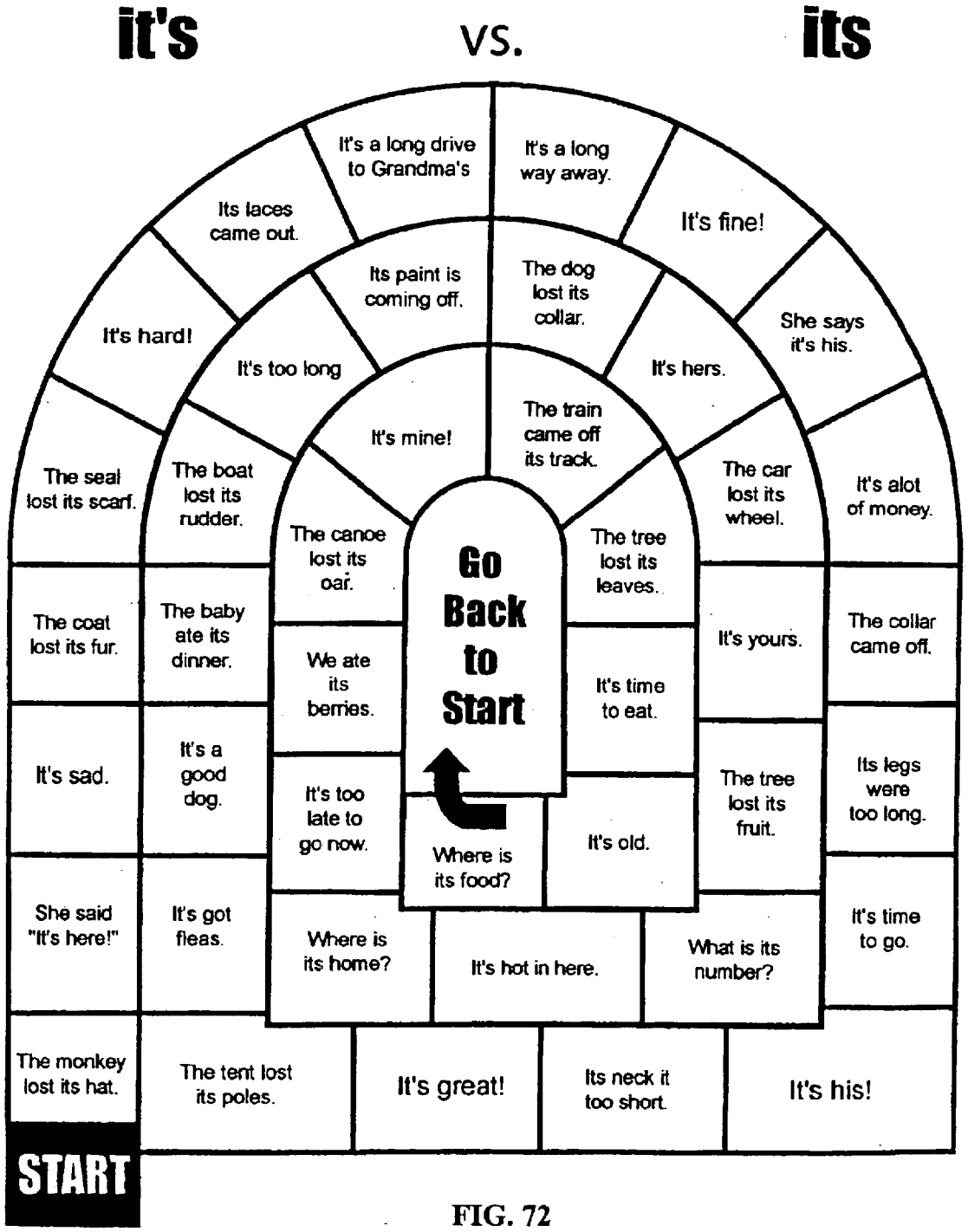
FIG. 72 is an illustrative embodiment of a concept versus concept game as disclosed herein entitled "it's vs. its", which is an example of a forward-backward-forward game.
Figure 73:
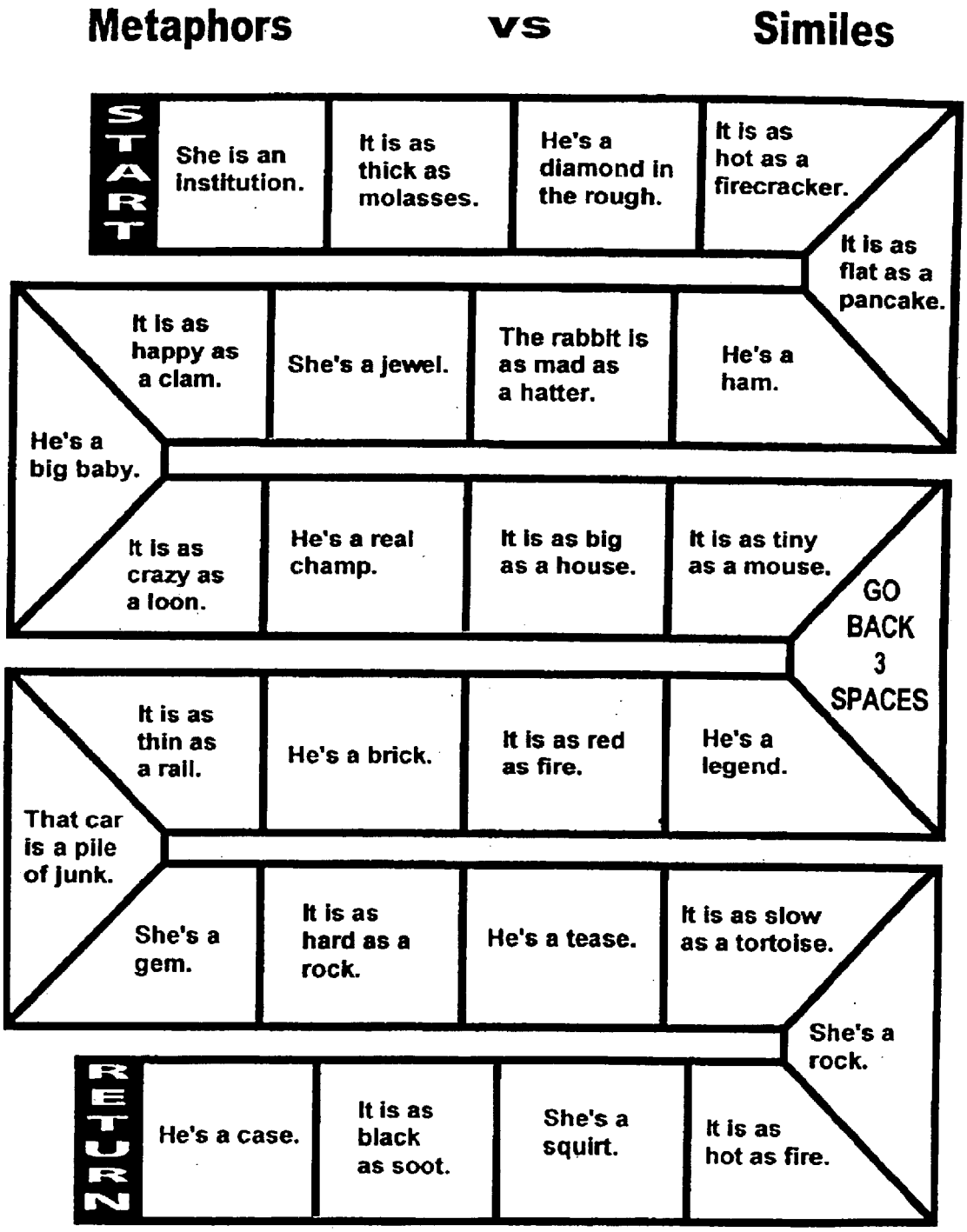
FIG. 73 is an illustrative embodiment of a concept versus concept game as disclosed herein entitled "Metaphors vs. Similes", which is an example of a forward-backward-forward game.
Figure 74:
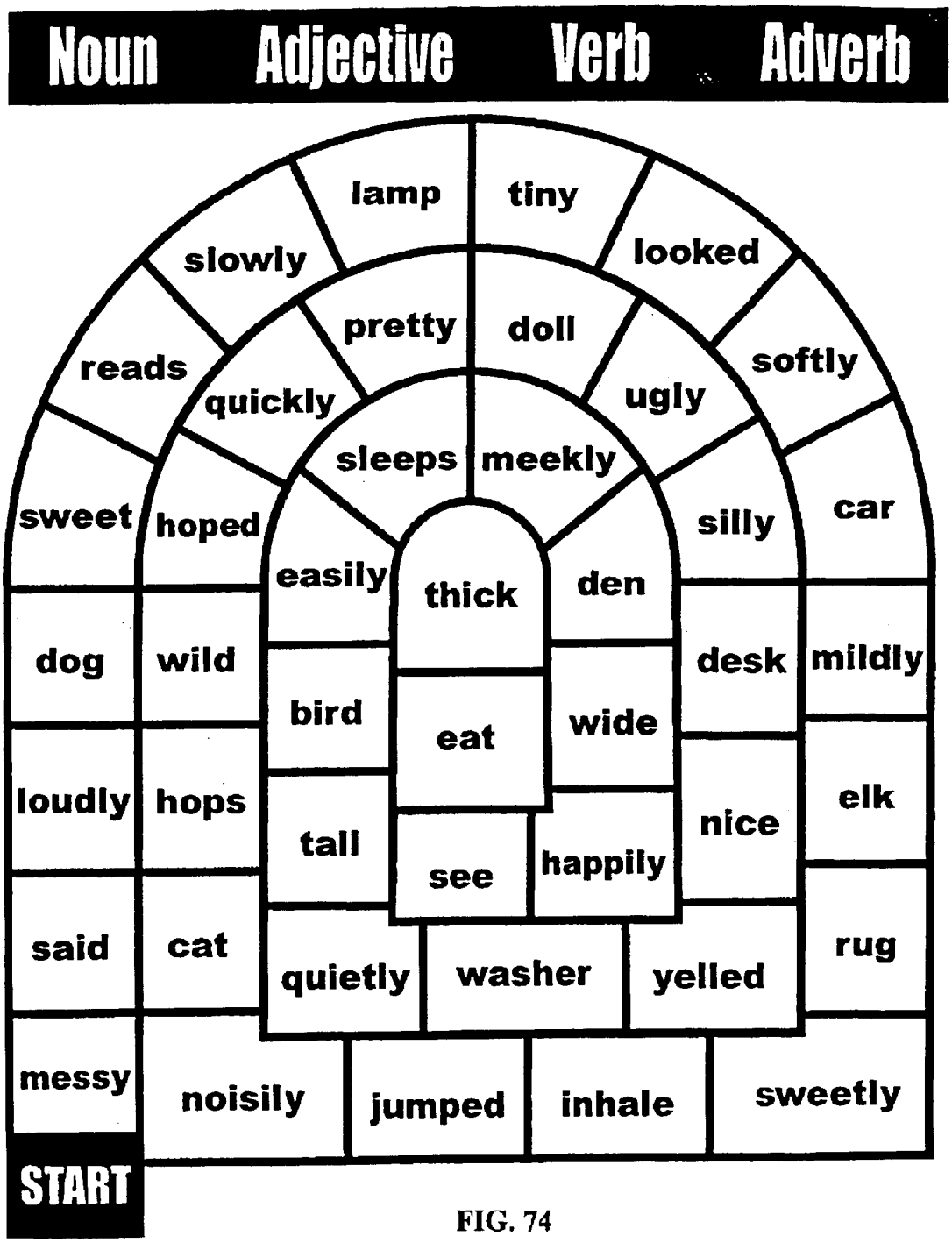
FIG. 74 is an illustrative embodiment of a concept versus concept game as disclosed herein entitled "Noun Adjective Verb Adverb", which is an example of a forward-backward-forward game.
Figure 75:
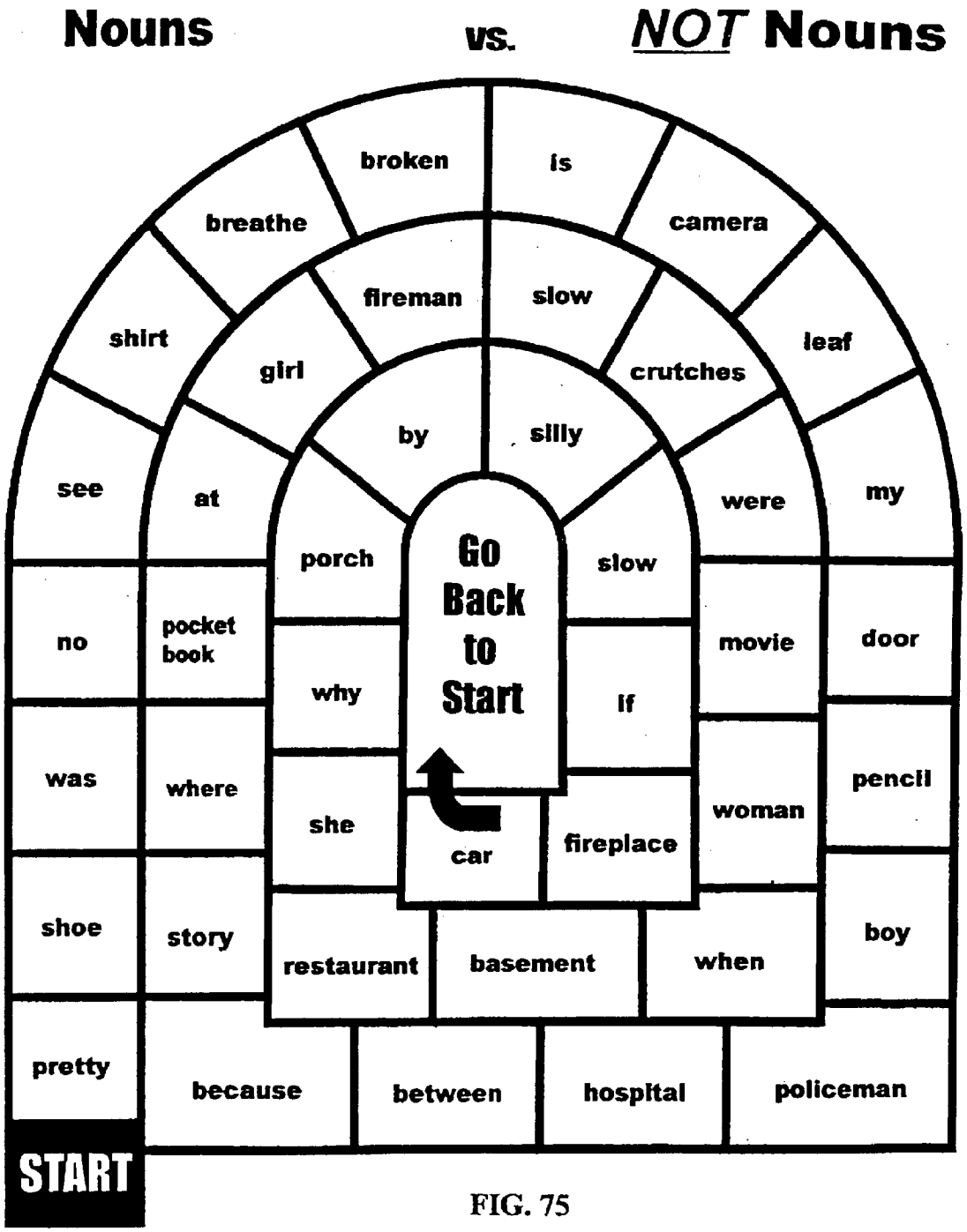
FIG. 75 is an illustrative embodiment of a concept versus concept game as disclosed herein entitled "Nouns vs. NOT Nouns", which is an example of a forward-backward-forward game.
Figure 76:
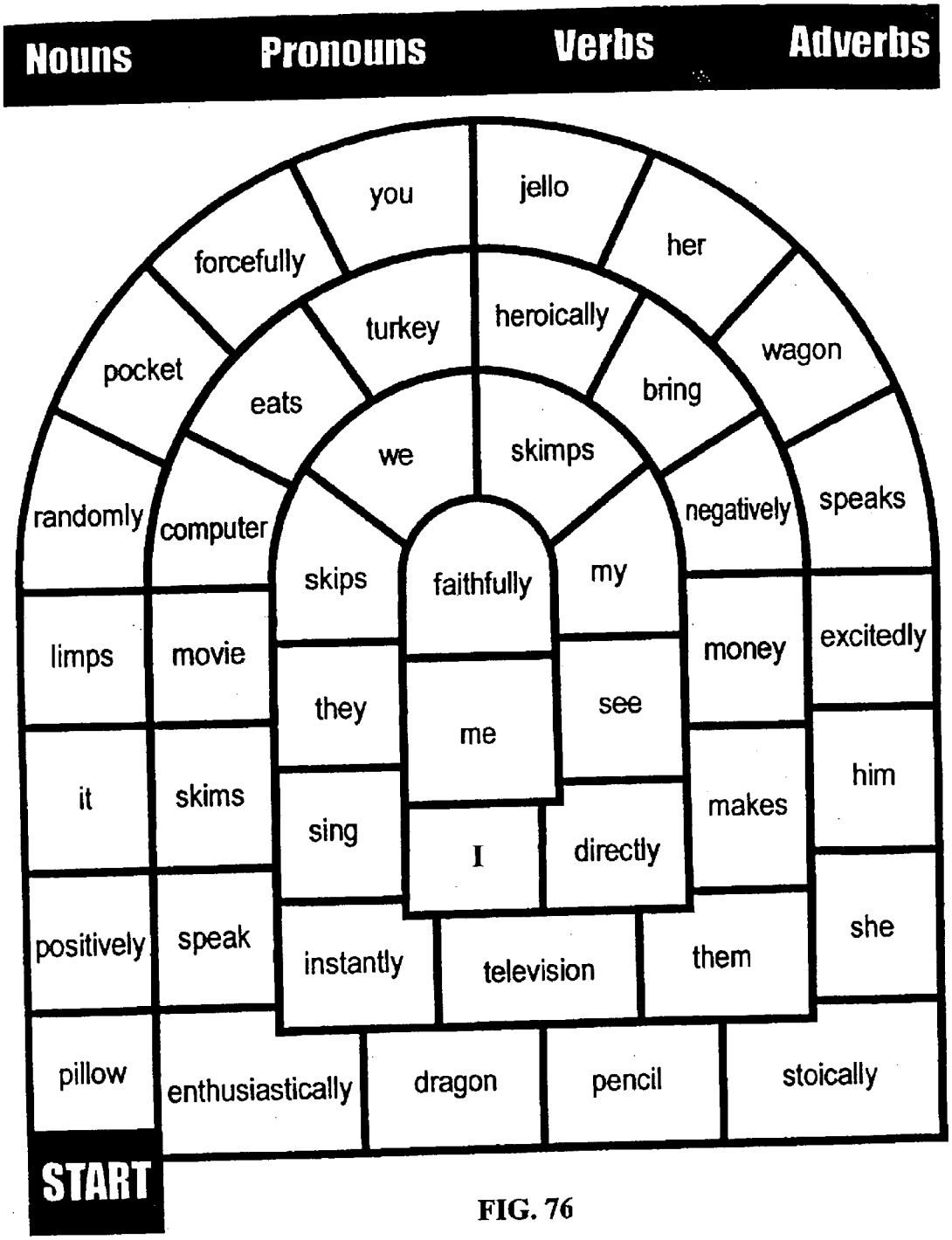
FIG. 76 is an illustrative embodiment of a concept versus concept game as disclosed herein entitled "Nouns Pronouns Verbs Adverbs", which is an example of a forward-backward-forward game.
Figure 77:
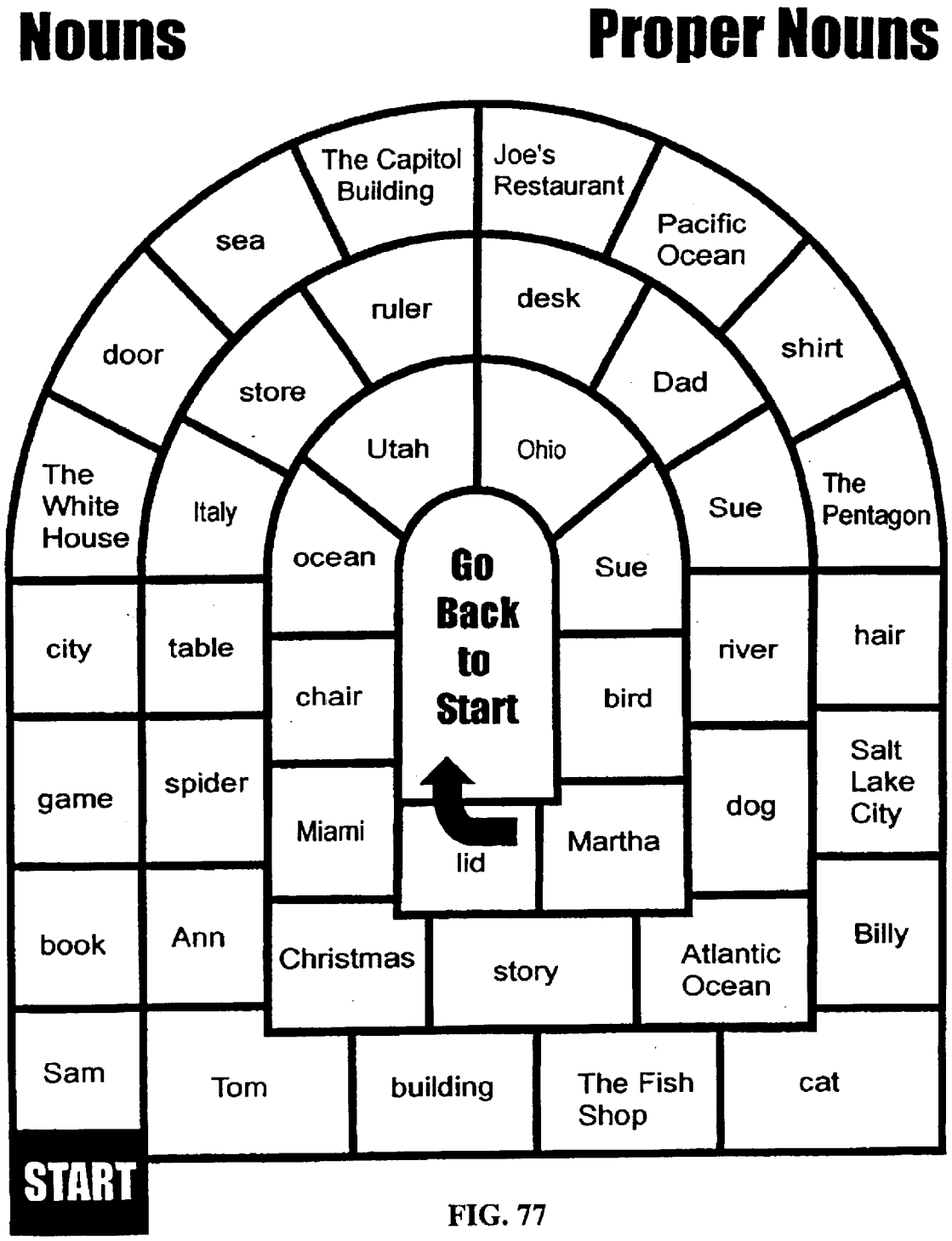
FIG. 77 is an illustrative embodiment of a concept versus concept game as disclosed herein entitled "Nouns Proper Nouns", which is an example of a forward-backward-forward game.
Figure 78:
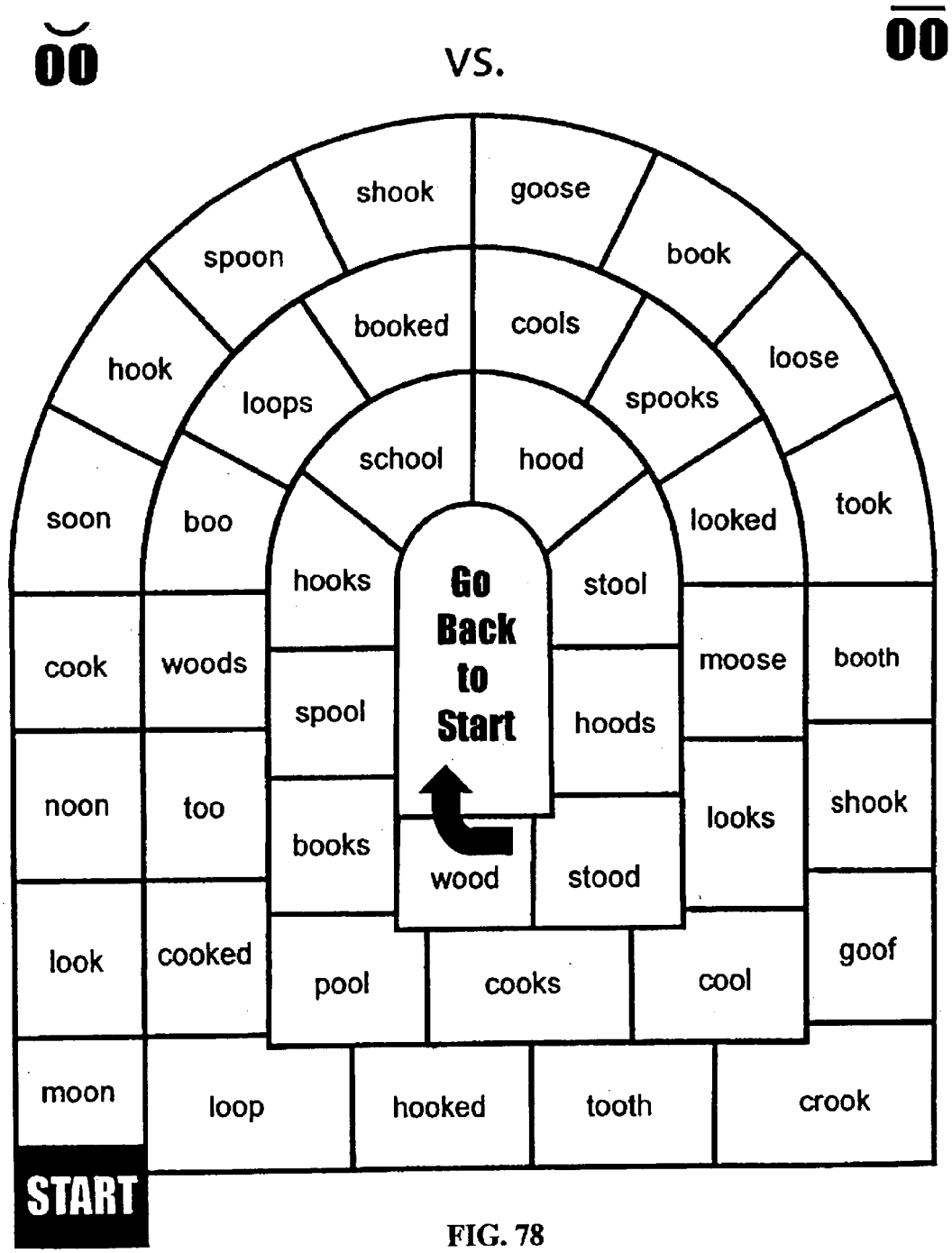
FIG. 78 is an illustrative embodiment of a concept versus concept game as disclosed herein entitled "oo vs oo", which is an example of a forward-backward-forward game.
Figure 79:
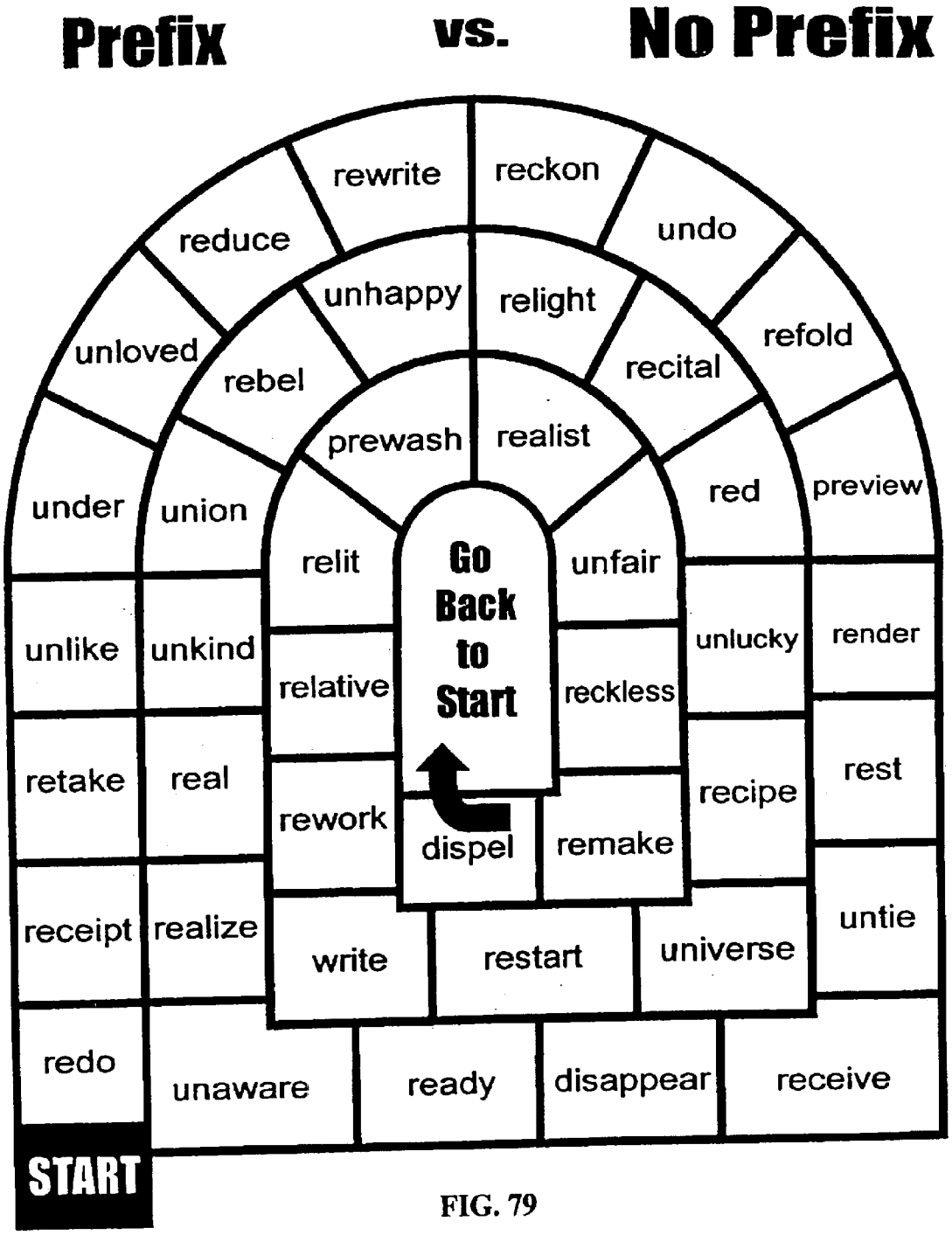
FIG. 79 is an illustrative embodiment of a concept versus concept game as disclosed herein entitled "Prefix vs. No Prefix", which is an example of a forward-backward-forward game.
Figure 80:
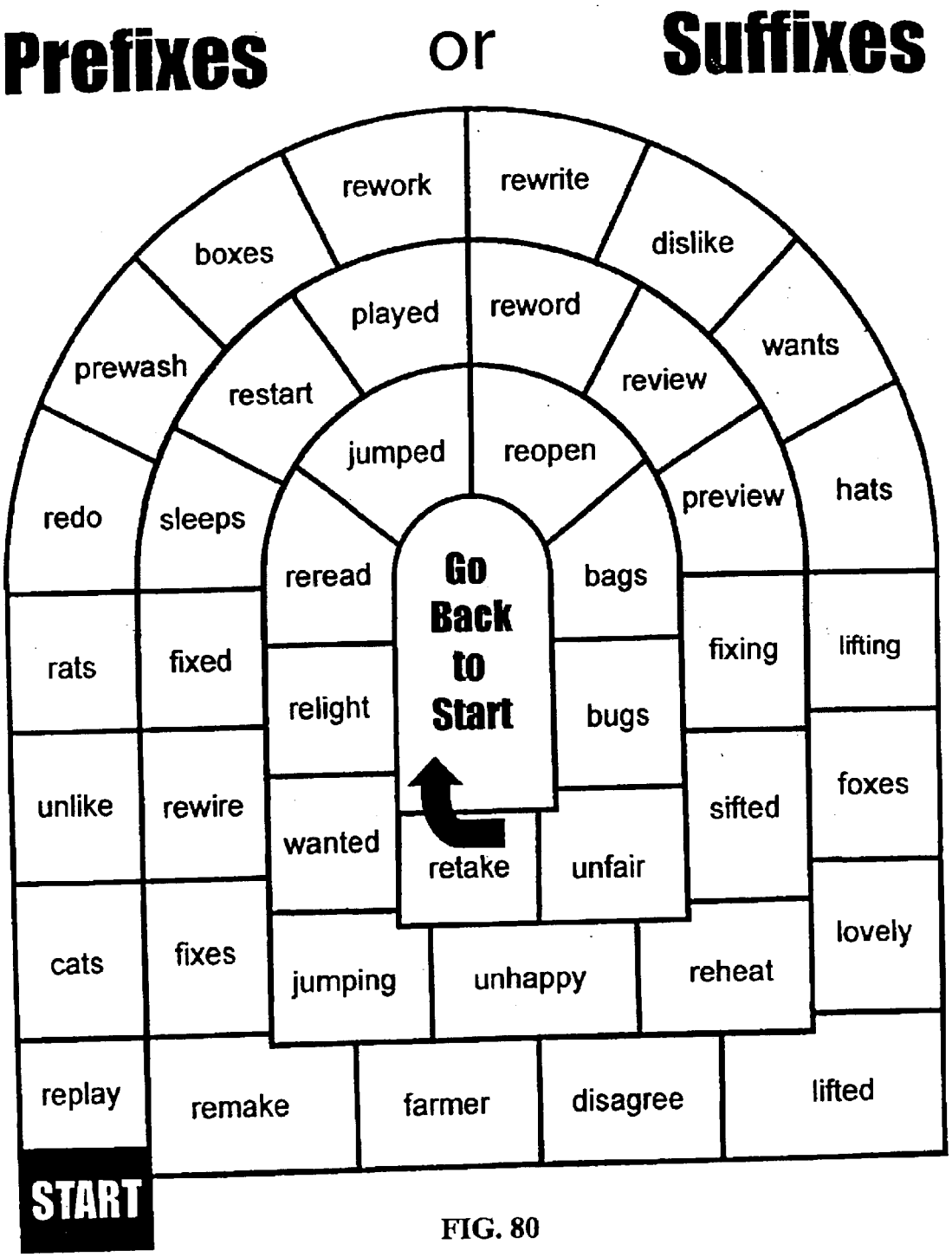
FIG. 80 is an illustrative embodiment of a concept versus concept game as disclosed herein entitled "Prefixes or Suffixes", which is an example of a forward-backward-forward game.
Figure 81:
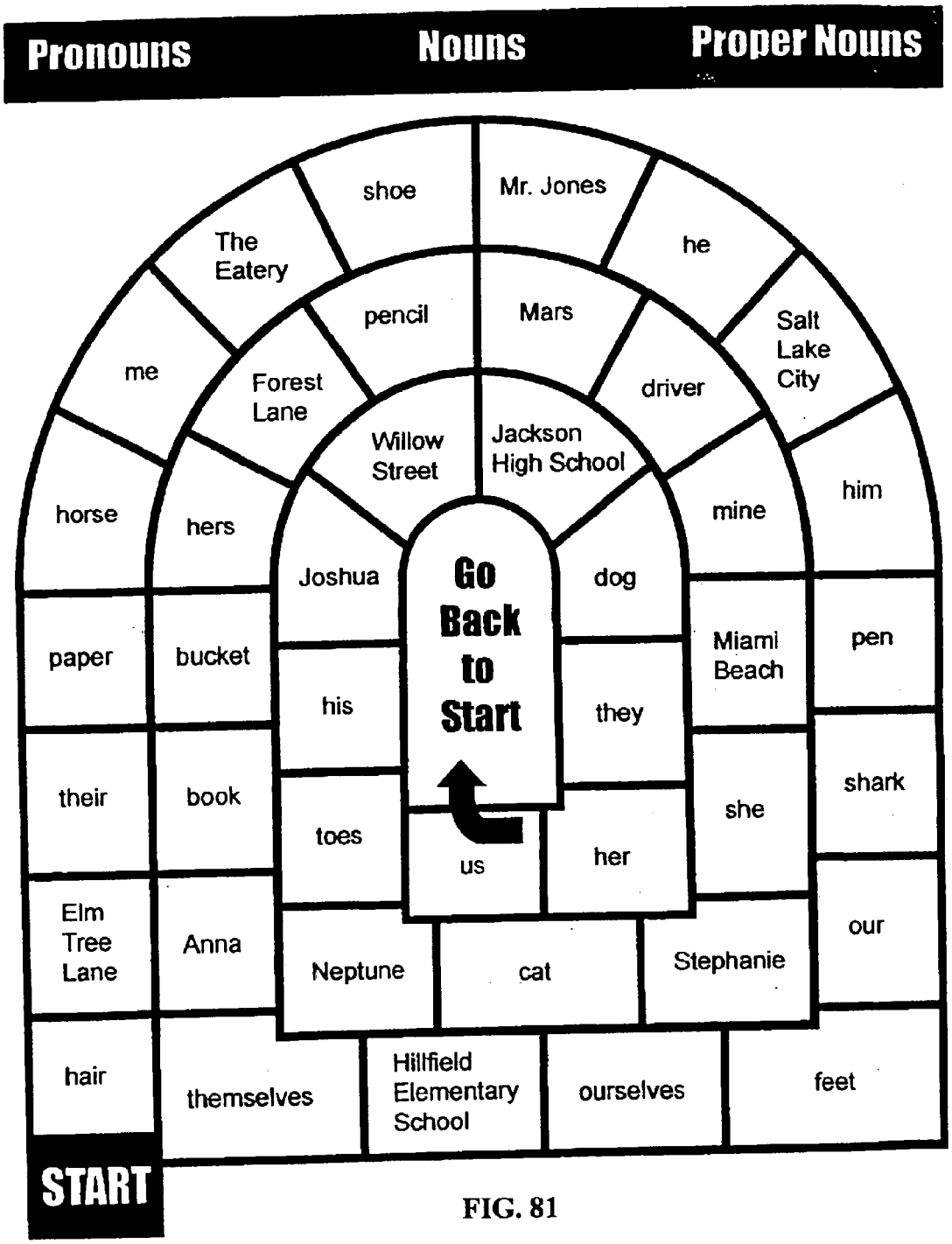
FIG. 81 is an illustrative embodiment of a concept versus concept game as disclosed herein entitled "Pronouns Nouns Proper Nouns", which is an example of a forward-backward-forward game.
Figure 82:
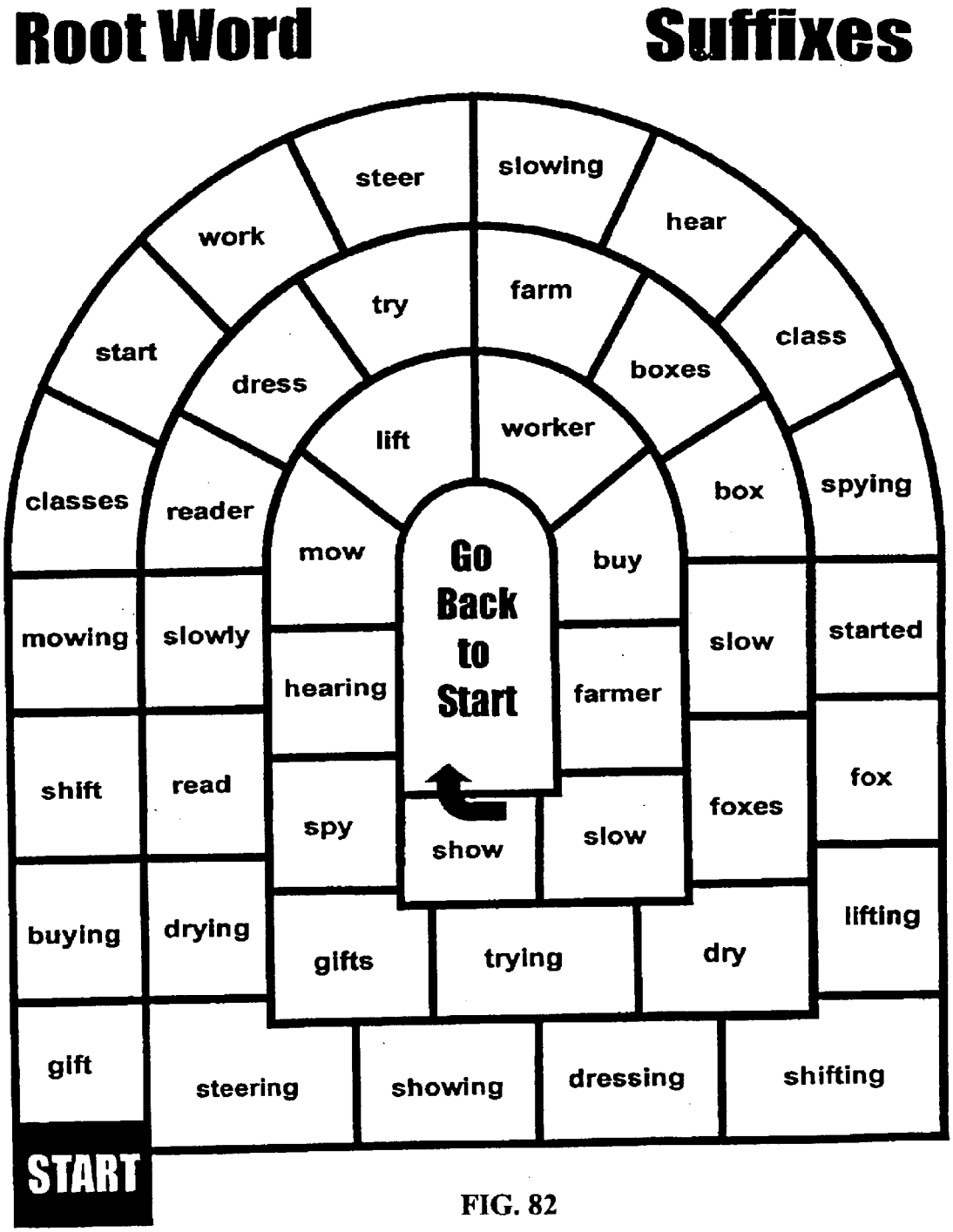
FIG. 82 is an illustrative embodiment of a concept versus concept game as disclosed herein entitled "Root Word Suffixes", which is an example of a forward-backward-forward game.
Figure 83:
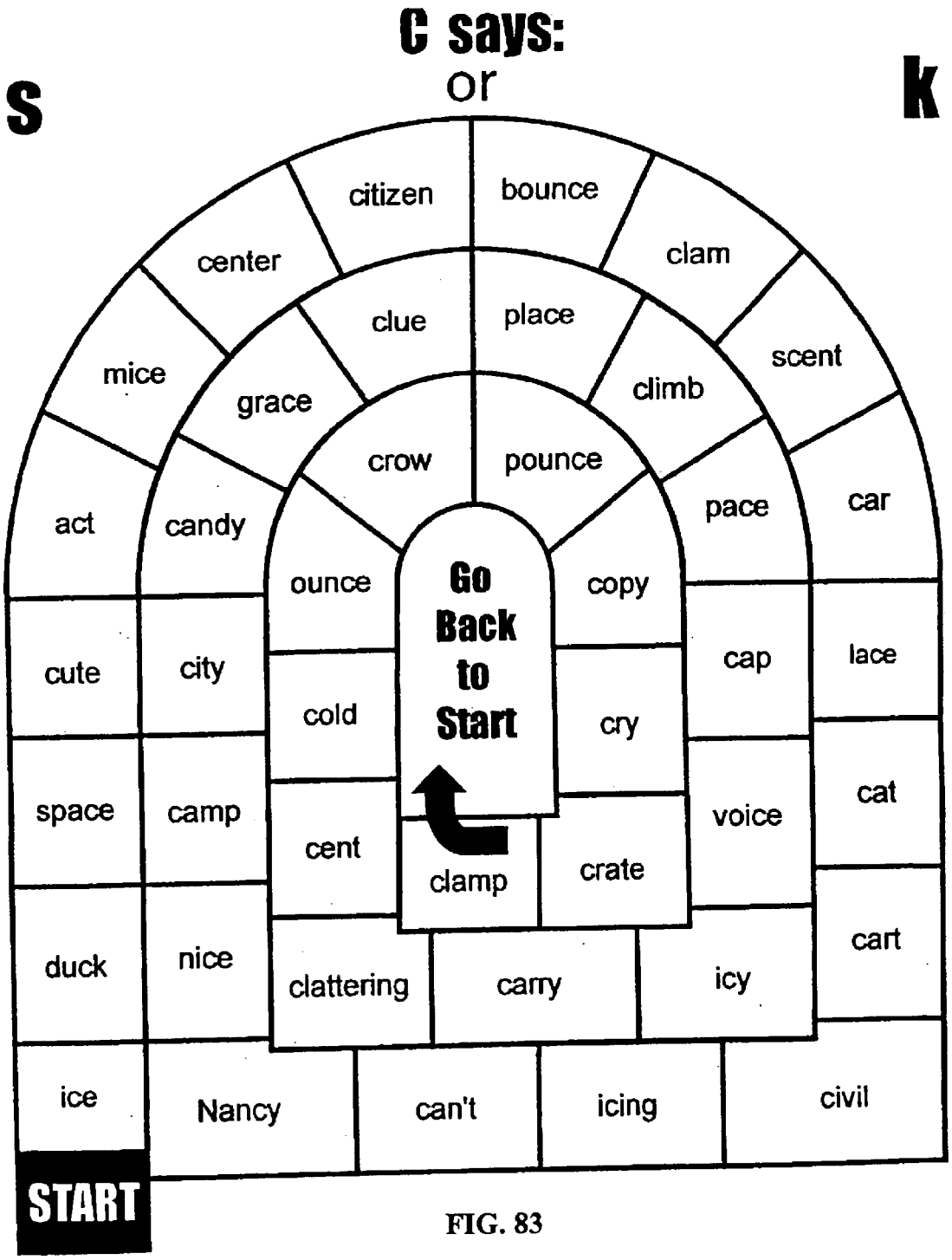
FIG. 83 is an illustrative embodiment of a concept versus concept game as disclosed herein entitled "C says: s or k", which is an example of a forward-backward-forward game.
Figure 84:
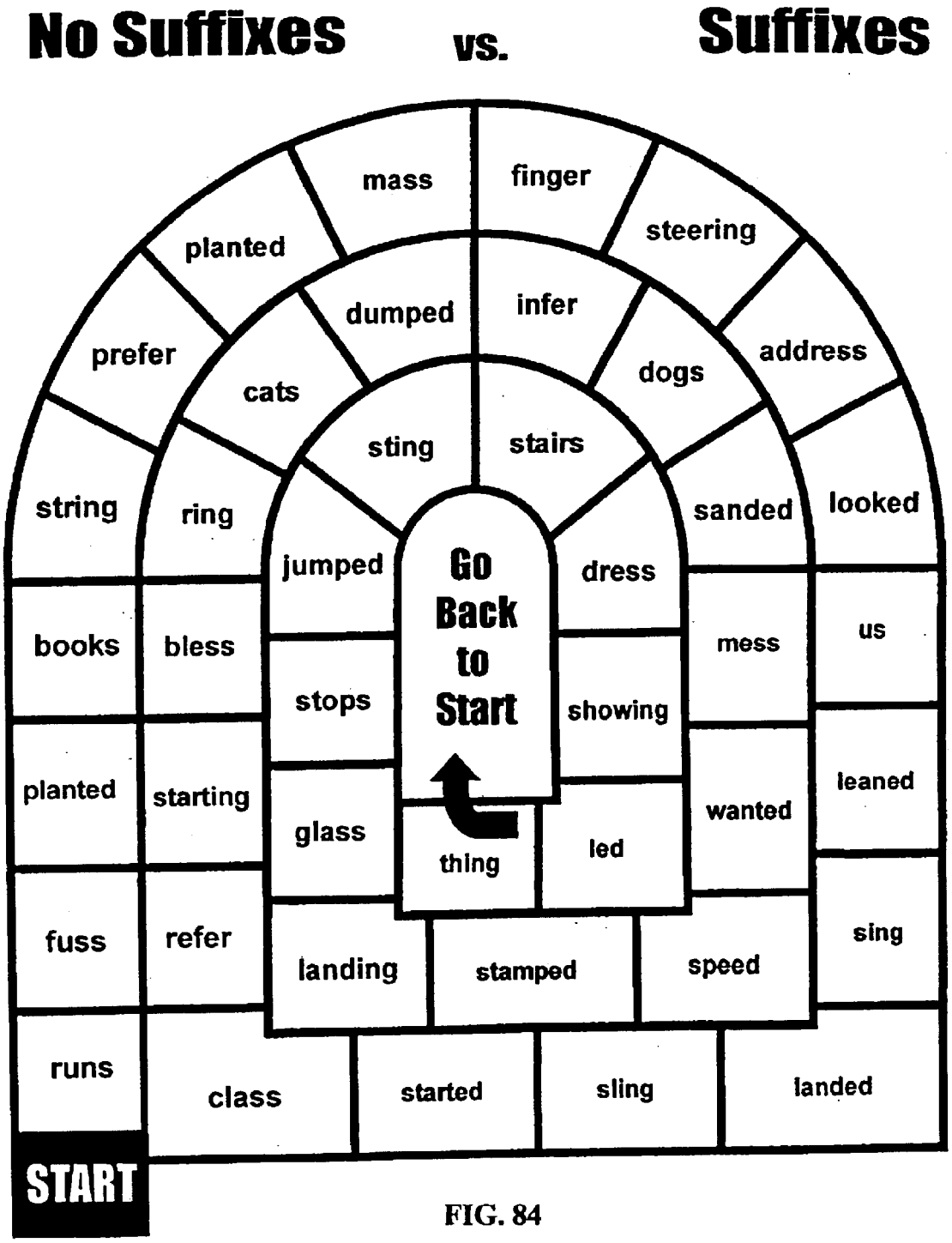
FIG. 84 is an illustrative embodiment of a concept versus concept game as disclosed herein entitled "No Suffixes vs. Suffixes", which is an example of a forward-backward-forward game.

When playing the game in FIG. 33, suppose the first participant beginning at the start position 116 rolls or spins a three (3), the playing piece 150 is moved to the corresponding space 112 three steps away from the start position 116. In this case the computation 114 is a math problem: 9×_=63. The participant must now determine the right answer, i.e., is the answer 7, 8 or 9? After the participant determines that this is a division problem in which 63 is divided by 9, the participant then answers that the correct answer is 7. At this point the concept relating to division of the number 7 would be given a point. The next participant may then take his/her turn and roll or spin, and proceeds as outlined above. The above process continues until the playing piece 150 reaches the target point 118, where it is indicated that the playing piece 150 must go back or return to the start 116, i.e., the playing piece 150 must spiral-back to the start 116. Once again, the spiraling-in and out may be done to extend the playing time of the game.

It will be appreciated that when the playing piece 150 has reached the target point 118, the participants can spiral-back to the start position 116, or the participants may begin at the start position 116 once again and move toward the target point 118, whichever method is desired. It will be appreciated that all participants may follow the same method of play, i.e. either spiral-back or return to the start position 116. The game ends when the specified signal is reached. Whichever concept 102 has the most points at the end of the game wins.

An example of playing the continuous play board game will now be detailed by reference to the game of FIG. 86. It will be seen that three concepts 102 are competing in this particular game, namely types of angles whether acute, right or obtuse. The game proceeds as outlined above with respect to the forward-backward-forward games, with the following exception. It will be appreciated that the game board 110 has no ending point or no target point 118, but the game merely continues when the playing piece 150 reaches the first space adjacent to the start position 116. Accordingly, an arbitrary number of complete advancements or turns around the board 110 may be determined prior to play beginning, which when reached signals the end of the game, or the first of the competing concepts 102 to reach a certain point total may also signal the end of the game.

It will be appreciated that the board games 100 described above, no matter what sub-category a particular game may fall into, may be grouped or packaged together in kits or packets and distributed to participants, purchasers or the like. It will be appreciated that each kit or packet may be organized in various ways, which may be determined by one of skill in the art having possession of this disclosure, without undue experimentation. However, it should be noted that Applicant has found it to be advantageous to include in each kit or packet of games at least one game that has at least thirty-five (35) spaces, and at least one game having at least three (3) competing concepts, and at least one game that is a continuous play game. It will be appreciated that a single game may contain all of the above limitations, or a single game may contain one of the above limitations, or a single game may contain a combination of the above limitations. However, it will likewise be appreciated that all of the above limitations are not required of each game in a given kit or packet, and each of the above limitations may be exhibited in only a single game of the entire kit or packet. Applicant has also found it advantageous to include at least eight (8) games in each game kit or packet comprising a total of at least ten (10) different subjects or concepts represented in the kit or packet.

Concept Searching Games

The workings, teachings and themes of the concept searching games category referred to above may be illustrated by reference to FIGS. 91–97. It will be appreciated that FIG. 91 is an exemplary embodiment of the concept searching games category. Each concept searching game may also be grouped into three sub-classes, namely: (a) word searching games (illustrated in FIGS. 91–97), (b) number searching games (not illustrated), and (c) answer searching games (not illustrated).

It will be appreciated that each concept searching game may comprise a search board 210, a list 212 of words, concepts, questions, or other computation 114, a grid of spaces 220 wherein each space 222 may comprise a symbol, letter, number, word or other communication device to convey a meaning to the participant (collectively referred to herein as "symbol"), and a coding system or scheme 214. It will be appreciated that the coding system or scheme may be a series of colors, symbols, signals or indications used to visually represent ideas, concepts, equations, methods, notions and the like to visually transmit meanings and significance of the ideas, concepts, equations, methods, notions and the like to participants and others, for example teachers or educators.

The basic concepts, themes, and teachings of concept searching games category can be explained by reference to FIG. 91, which is a word searching game. Specifically, the subject matter of FIG. 91 is English, and the competing concepts 102 are nouns versus not nouns. In this game, a participant may choose one of a plurality of items 215, which may be words, phrases, ideas, numbers, symbols, or other communication device from the list 212, and may then determine whether that word is a noun or not a noun, which are competing concepts 102. It will be appreciated that the teaching concepts 102 may be different than those described herein, and may be modified by one of ordinary skill in the art having possession of this disclosure without undue experimentation.

For example, suppose a first participant chose the word "silly" 216 from the list 212. That participant would then determine whether that word is a noun or not a noun. In this case, "silly" 216 is not a noun, but is an adverb, and would locate the letters in the gird of spaces 220 that forms the word "silly" on the search board 210. In this particular case, "silly" 216 is identified on the search board 210 by item 218 on the top row near the left hand side of the page. At this point, the participant would color the word "silly" 216 orange, since the coding scheme 214 instructions near the bottom of the page indicate such. In the present case, the coding scheme 214 is a color coding scheme that provides a visual indication, which signifies to the other participants, teachers, educators or the like what the participant has determined, namely that the word "silly" 216 is not a noun. Such a color coding scheme allows others, such as a teacher, to quickly determine whether the participant understood the concepts 102 being played in the game.

During the game, or at the end of the game when all of the words on the list 212 have been located and identified as a "noun" or "not a noun" by use of the coding scheme 214, each time the correct concept 102 is identified on the board 210 as indicated by the correct color, that concept 102 may receive a point. The coding scheme 214 allows a teacher to quickly identify whether the word or idea was correctly identified and colored according to the concept 102 to which the word or idea belongs. When all of the words or ideas have been identified, for example by the teacher, numbers may be associated with each correctly labeled concept 102, and the concept 102 with the most words or ideas, which corresponds to points, wins.

It will be appreciated that other aspects of the concept searching game category may be used, such as number searching games, and answer searching games. For example, the same principles from the searching game as described above may be used and played with math and numbers, where a problem is worked out and then the answer must be located on the board 210. The same principles from the searching game described above may also be used where a question may first be posed, such as a scientific question, and the answer to such a question is then located on the board 210. In either scenario, the game playing concept in each searching game is the same or similar, i.e., to determine an answer to a computation 114, problem, inquiry, or other probe, find the answer and then color code the answer into a correct conceptual category, per the instructions of the game.

It will be appreciated that the concept searching games may also be packaged or grouped together into kits or packets similar to the board games described above.

In accordance with the features and combinations described above, useful methods for using the games disclosed herein include the following:

A method for at least one participant to play a board game wherein at least three concepts compete against each other and no individual participant wins or loses, the game having a game board with a plurality of advancement spaces that form an advancement track, the advancement track comprising a start position and a target point, the method comprising the steps of:

(a) placing at least one playing piece on the start position of the advancement track;

(b) using a chance device to randomly select a number of spaces to move the at least one playing piece;

(c) moving the at least one playing piece along the advancement track a corresponding number of spaces as directed by the chance device toward the target point of the advancement track;

(d) answering a computation that is associated with the particular space that the playing piece has landed on; and (e) scoring a point for the concept that is associated with a correct answer for the computation.

A method for at least one participant to play a concept searching game wherein a plurality of teaching concepts compete against each other and no individual participant wins or loses, the game having a game board with a plurality of spaces forming a grid, wherein each space comprises a symbol, and wherein each symbol alone or in combination with other symbols relates to an answer that corresponds with one of the plurality of teaching concepts, the method comprising the steps of:

(a) providing a list of a plurality of items, wherein each item corresponds with one of the teaching concepts;

(b) selecting an item from the list;

(c) locating the item on the grid of spaces; and (d) coding the item such that there is a visual indication as to which of the teaching concepts said item corresponds.

Those having ordinary skill in the relevant art will appreciate the advantages provide by the features of the present disclosure. For example, it is a potential feature of to provide an educational game where at least two concepts compete against each other. It is also a potential feature to provide an educational game where at least three concepts compete against each other. It is a potential feature of the present disclosure to provide an educational game that stimulates and fosters an atmosphere where the learning process may flourish. It is another potential feature to provide a kit or packet of educational games that may comprise board games with forward-backward-forward games and continuous play games associated therein. It is another potential feature to provide a kit or packet of concept searching games, possibly including word searching games, number searching games, and answer searching games that may comprise a visual aspect, such as color coding scheme, to the game.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A game for teaching educational concepts to at least one participant, wherein the game comprises:

a game board comprising a plurality of spaces, wherein each of the plurality of spaces comprises at least one computation, and wherein each computation relates to one of at least three pre-determined teaching concepts;

at least one playing piece for advancement about the game board; and wherein each of the three teaching concepts competes against each of the other teaching concepts, thereby producing a concept versus concept game theme, such that no individual participant wins or loses.

2. The game for teaching educational concepts of claim 1, wherein the game board comprises at least thirty-five computations.

3. The game for teaching educational concepts of claim 1, wherein the game board comprises at least thirty-five spaces.

4. The game for teaching educational concepts of claim 1, wherein the game is a forward-backward-forward game.

5. The game for teaching educational concepts of claim 1, wherein the game is a continuous play game.

6. A game kit for teaching educational concepts to at least one participant, wherein the game kit comprises:

a plurality of games, wherein at least one of the plurality of games comprises at least one game having a game board with a plurality of spaces;

wherein each of the plurality of spaces of the at least one game comprises a computation, and wherein each computation relates to one of at least three pre-determined teaching concepts; and wherein each of the three teaching concepts competes against each of the other teaching concepts, such that competition between participants is avoided.

7. The game kit for teaching educational concepts of claim 6, wherein the at least one game comprises at least thirty-five spaces.

8. The game kit for teaching educational concepts of claim 6, wherein the at least one game is a continuous play game.

9. The game kit for teaching educational concepts of claim 6, wherein the at least one game is a forward-backward-forward game.

10. The game kit for teaching educational concepts of claim 6, wherein the kit comprises at least eight different games.

11. The game kit for teaching educational concepts of claim 6, wherein the kit comprises at least ten different teaching concepts related to the plurality of games.

12. A game kit for teaching educational concepts to at least one participant, wherein the game kit comprises:

a plurality of games, wherein at least one of the plurality of games comprises at least one game having a game board with at least thirty-five playing spaces;

wherein each of the at least thirty-five playing spaces of the at least one game comprises a computation, and wherein each computation relates to one of at least three pre-determined teaching concepts; and wherein each of the three teaching concepts competes against the other teaching concepts, such that one of the competing teaching concepts wins the game, and not an individual participant.

13. A game kit for teaching educational concepts to at least one participant, wherein the game kit comprises:

a plurality of games, wherein each game comprises a game board, wherein each of the game boards comprises a plurality of spaces, and each of the plurality of spaces comprises a computation that relates to one of a plurality of pre-determined teaching concepts;

wherein a first of the plurality of teaching concepts competes against at least two of the other plurality of teaching concepts; and wherein at least one of the games is a continuous play game.

14. The game kit for teaching educational concepts of claim 13, wherein the game board of the continuous play game comprises a plurality of rows of spaces, and wherein the rows are configured such that a resulting game path is non-rectangular.

15. A game kit for teaching educational concepts to at least one participant, wherein the game kit comprises:

a plurality of games, wherein each game comprises a game board, wherein each of the game boards comprises a plurality of spaces, and each of the plurality of spaces comprises a computation that relates to one of a plurality of pre-determined teaching concepts;

wherein a first of the plurality of teaching concepts competes against at least two of the other plurality of teaching concepts; and wherein at least ten different teaching concepts are represented in the plurality of games.

16. A game kit for teaching educational concepts to at least one participant, wherein the game kit comprises:

a plurality of games, wherein each game comprises a game board, wherein each of the game boards comprises a plurality of spaces, and each of the plurality of spaces comprises a computation that relates to one of a plurality of pre-determined teaching concepts;

wherein a first of the plurality of teaching concepts competes against at least two of the other plurality of teaching concepts; and wherein the plurality of games comprises at least eight different games within the game kit.

17. A game for teaching educational concepts to at least one participant, wherein the game comprises:

a game board comprising a plurality of spaces that together define a forward-backward-forward path, wherein each of the plurality of spaces comprises a computation, and wherein each computation relates to one of a plurality of pre-determined teaching concepts;

at least one playing piece for advancement about the game board; and at least one chance device having at least one representational attribute, wherein the representational attribute corresponds to a random space on the game board where the playing piece advances;

wherein a first of the plurality of teaching concepts competes against at least two other of the plurality of teaching concepts, and wherein the game is characterized by an absence of participants competing against each other.

18. A game for teaching educational concepts to at least one participant, wherein the game comprises:

a playing surface comprising a plurality of individual spaces that forms a grid, wherein each of the plurality of spaces comprises at least one symbol, and wherein each symbol alone or in combination with other symbols relates to an answer defined to be within one of a plurality of pre-determined teaching concepts;

a list of items;

a coding system used by a participant to categorize each of the items into its corresponding teaching concept to which each item relates; and wherein a first of the plurality of teaching concepts competes against at least one of the other plurality of teaching concepts.

19. The game for teaching educational concepts of claim 18, wherein the game is selected from a group consisting of word searching games, number searching games, and answer searching games.

20. A game kit for teaching educational concepts to at least one participant, wherein the game kit comprises:

a plurality of games, wherein each game comprises a game board, wherein each of the game boards comprises a plurality of spaces, and each of the plurality of spaces comprises a computation that relates to one of a plurality of pre-determined teaching concepts;

wherein a first of the plurality of teaching concepts competes against at least two of the other plurality of teaching concepts;

wherein at least one of the plurality of games has at least thirty-five spaces and at least thirty-five computations;

wherein at least one of the plurality of games is a continuous play game having a series of rows connected to each other by at least one space, wherein the series of rows forms a non-rectangular game path;

wherein at least one of the plurality of games is a forward-backward-forward game, wherein a playing piece spirals-in from a start position toward a target point, and thereafter spirals-out, thereby returning to the start position;

wherein the game kit comprises at least ten different concepts; and wherein the plurality of games comprises at least eight different games within the game kit.

21. A method for at least one participant to play a board game wherein at least three concepts compete against each other and no individual participant wins or loses, the game having a game board with a plurality of advancement spaces that form an advancement track, the advancement track comprising a start position and a target point, the method comprising the steps of:

(a) placing at least one playing piece on the start position of the advancement track;

(b) using a chance device to randomly select a number of spaces to move the at least one playing piece;

(c) moving the at least one playing piece along the advancement track a corresponding number of spaces as directed by the chance device toward the target point of the advancement track;

(d) answering a computation that is associated with the particular space that the playing piece has landed on; and (e) scoring a point for the concept that is associated with a correct answer for the computation.

22. A method for at least one participant to play a concept searching game wherein a plurality of teaching concepts compete against each other and no individual participant wins or loses, the game having a game board with a plurality of spaces forming a grid, wherein each space comprises a symbol, and wherein each symbol alone or in combination with other symbols relates to an answer that corresponds with one of the plurality of teaching concepts, the method comprising the steps of:

(a) providing a list of a plurality of items, wherein each item corresponds with one of the teaching concepts;

(b) selecting an item from the list;

(c) locating the item on the grid of spaces; and (d) coding the item such that there is a visual indication as to which of the teaching concepts said item corresponds.

23. A game kit for teaching educational concepts to at least one participant, wherein the game kit comprises:

a plurality of games, wherein each game comprises a game board, wherein each of the game boards comprises a plurality of spaces, and each of the plurality of spaces comprises a computation that relates to one of a plurality of pre-determined teaching concepts;

wherein a first of the plurality of teaching concepts competes against at least two of the other plurality of teaching concepts;

wherein at least one of the plurality of games has at least thirty-five spaces and at least thirty-five computations;

wherein at least one of the plurality of games is a continuous play game having a series of rows, each row comprising a sequence of individual spaces, wherein said rows are positioned row by row in a consecutive sequence, wherein the series of rows forms a non-rectangular game path;

wherein at least one of the plurality of games is a forward-backward-forward game, wherein a playing piece spirals-in from a start position toward a target point, and thereafter spirals-out, thereby returning to the start position;

wherein the game kit comprises at least ten different concepts; and wherein the plurality of games comprises at least eight different games within the game kit.

24. The game kit for teaching educational concepts of claim 23, wherein all spaces are in a consecutive sequence, such that each successive space is directly connected to its preceding space.

* * * * *